US007048969B2

(12) United States Patent
Ichikawa et al.

(10) Patent No.: US 7,048,969 B2
(45) Date of Patent: May 23, 2006

(54) COATING DEVICE AND COATING METHOD

(75) Inventors: Kazuki Ichikawa, Shizuoka-ken (JP); Nobuyoshi Kaneko, Shizuoka-ken (JP); Go Nishino, Shizuoka-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/254,842

(22) Filed: Sep. 26, 2002

(65) Prior Publication Data

US 2004/0043154 A1 Mar. 4, 2004

(30) Foreign Application Priority Data

| | | |
|---|---|---|
| Sep. 28, 2001 | (JP) | 2001-304302 |
| Oct. 29, 2001 | (JP) | 2001-330502 |
| Nov. 28, 2001 | (JP) | 2001-362022 |
| Feb. 15, 2002 | (JP) | 2002-037972 |
| Mar. 25, 2002 | (JP) | 2002-083486 |
| Mar. 25, 2002 | (JP) | 2002-083487 |
| Mar. 25, 2002 | (JP) | 2002-083488 |
| Mar. 29, 2002 | (JP) | 2002-097624 |

(51) Int. Cl.
*B05D 1/28* (2006.01)
*B05D 1/40* (2006.01)
*B05C 11/02* (2006.01)

(52) U.S. Cl. ..... 427/359; 427/361; 427/428.01; 427/428.06; 427/428.11; 427/428.18; 427/428.2; 118/110; 118/118; 118/244; 118/410; 118/414

(58) Field of Classification Search ..... 427/359, 427/361, 428; 118/110, 118, 244, 410, 414
See application file for complete search history.

(56) References Cited

U.S. PATENT DOCUMENTS

| | | | | |
|---|---|---|---|---|
| 4,263,870 | A * | 4/1981 | Saito et al. | 118/259 |
| 4,456,637 | A * | 6/1984 | Takeda et al. | 427/355 |
| 5,083,527 | A * | 1/1992 | Naruse | 118/414 |
| 5,820,935 | A * | 10/1998 | Kashiwabara et al. | 427/359 |
| 5,843,529 | A | 12/1998 | Peiffer | |
| 6,251,563 | B1 * | 6/2001 | Van Damme et al. | 430/302 |

FOREIGN PATENT DOCUMENTS

| | | | |
|---|---|---|---|
| EP | 997 774 | A1 * | 5/2000 |
| JP | 59-123568 | * | 7/1984 |
| JP | 01-249170 | | 10/1989 |
| JP | 02-090972 | * | 3/1990 |
| JP | 2-048167 | | 4/1990 |
| JP | 08117682 | | 5/1996 |
| JP | 2001-129459 | * | 5/2001 |

* cited by examiner

*Primary Examiner*—Katherine Bareford
(74) *Attorney, Agent, or Firm*—Sughrue Mion, PLLC

(57) ABSTRACT

A coating device and a coating method are provided. The coating device comprises a coating station for coating a coating liquid on a band-shaped substrate running continuously, and a coat-adjusting station disposed downstream of the coating station for adjusting the coating liquid on the substrate so that the coating liquid layer is coated on the substrate at a predetermined thickness. The coating station and the coat-adjusting station comprise first and second bars for respectively coating and measuring the liquid agent. The coating liquid can be coated on evenly and in a stable manner even if the coating operation is performed with the substrate running at a high speed.

72 Claims, 20 Drawing Sheets

COATING DEVICE AND COATING METHOD

BACKGROUND OF THE INVENTION

1. Field of the Invention

The present invention relates to a coating device and a coating method. More specifically, it relates to a coating device and a coating method capable of performing a stable and even coating operation, even in the case of coating a coating liquid agent on the surface of band-shaped substrate, with the substrate running at a high speed.

Furthermore, the invention relates to a coating device and a coating method using a bar coater. More specifically, it relates to a bar coating device and a bar coating method capable of coating a coating liquid agent on an object to be coated being conveyed in a constant direction at a high speed, preferably adopted for cases where the object to be coated has a rough surface.

Furthermore, the invention relates to a bar coating device comprising a bar and a primary side weir member disposed upstream of the bar, capable of effectively preventing drying or adhesion of a coating liquid on the primary side weir member, and a coating method using the coating device.

2. Description of the Related Art

Photographic sensitive materials, printing papers, magnetic recording materials, coated metal plates, planographic printing plate precursors, or the like have been produced by coating a coating liquid such as a plate-making layer forming liquid on a substrate such as a support web.

A bar coater, a slide bead coater, an extrusion coater, of the like have been used for the application of the coating liquid. In particular, the bar coater has been used widely because it is easy to handle.

The bar coater comprising a bar that is rotatable in the same or opposite direction relative to the conveyance direction of the substrate while contacting the lower surface of the continuously running substrate has been conventionally used. In that bar coater, by ejecting the coating liquid upstream of the bar in the substrate conveyance direction (hereinafter referred to simply as "upstream") while the substrate is running so as to form a bead and taking up the coating liquid by the rotation of the bar, the coating liquid is adhered onto the lower surface of the substrate. The bar may be slaved to the running of the substrate and rotated thereby.

Moreover, in addition thereto, a bar coater disclosed in the specification of the Japanese Utility Model Application Laid-Open No. 63-126213, comprising a first weir plate disposed adjacent to a bar and upstream of the bar, with the thickness of the upper end portion thereof tapered toward the downstream conveyance direction of the substrate hereinafter simply referred to as "downstream") and the upper end portion bent toward the bar, having a flat surface of the length 0.1 to 1 at the top portion; and a bar coater disclosed in the official gazette of the Japanese Patent Application Publication (JP-B) No, 58-004589 comprising a bar, a first weir plate disposed on the upstream side thereof, with the upper end portion thickness made thinner toward the downstream side, and a second weir plate disposed downstream of the bar, have been commonly used.

For the above bar coaters, a coating liquid is generally discharged between the first weir plate and the bar so as to be coated on the substrate.

Moreover, in the case where the weir plate is provided upstream of the bar, those methods of coating the coating liquid on the substrate by ejecting the coating liquid between the bar and the weir member while forcibly rotating the bar at a circumferential speed different from the conveyance speed of the substrate, have mainly been used.

However, for any of the above bar coaters, when the substrate is running at a high speed, stripe-like defects of an equal pitch can easily be generated. Moreover, when the support web is run at a high speed, an accompanying film of air following the support web, can form on the surface of the support web.

When an entrained air film is formed on the surface of the support web, the entrained air film is brought by the support web to the bead as the coating part, and this generates such defects as coating film cuts and coating irregularities in the coating film of the coating liquid formed on the surface of the support web. Thus there is a problem involved in that the coating liquid cannot be coated on in a stable manner.

Moreover, for the bar coater provided with the weir plate, the coating liquid is intentionally discharged between the first weir plate and the bar, and it cannot always be provided evenly along the substrate width direction.

Therefore, the coating liquid discharged intermittently dries and adheres on the top portion of the first weir plate so that due to the adhered coating liquid solid component, coated surface problems such as coating streaks and solid component adhesion can be generated on the coated surface of the substrate.

Furthermore, in order to coat a coating liquid on an object to be coated such as a metal plate, or eliminate excessive coating liquid from the object to be coated (that is called, "measurement"), a bar coating device 502 as shown in FIG. 20 can be used.

For the bar coating device 502, a columnar (cylindrical) coating bar 506 is provided for a metal plate 504. The columnar coating bar 506 is conveyed at a constant speed in a direction orthogonal to the direction in which the metal plate 504 is conveyed (arrow F1 direction) so as to be contacted with the coated surface (lower surface) of the metal plate 504. The coating bar 506 is rotated at a circumferential speed equal to the conveyance speed of the metal plate 504 by the friction between the metal plate 504 and the coating bar 506. The rotation brings up a coating liquid 508 to provide a bead 510 between a weir member 512 and the metal plate 504. That is, the coating liquid in the bead 510 is coated on the metal plate 504 and the excessive coating liquid is eliminated from the metal plate 504, i.e., measured.

However, for the bar coating device 502, the so-called entrained air enters in at the time of coating so that the bead 510 is not stable. In particular, the conveyance speed of the metal plate 504 has recently been set at high speeds, so that due to the high speeds, the risk of the inability to maintain stability in the bead 510 is increased. If the bead 510 is instable, for example, the coating liquid 508 cannot be coated evenly in the entire width direction of the metal plate 504, so that it is difficult to obtain an evenly coated surface. This is especially true in the case where the surface of the metal plate 504 is coarse, since entrained air can easily be generated, it is further difficult to obtain an evenly coated surface.

SUMMARY OF THE INVENTION

Accordingly, an object of the present invention is to provide a coating device and a coating method capable of providing a stable coating without generating various above-mentioned kinds of defects in the coating film, even when coating a substrate such as a support web running at a high speed.

Moreover, another object of the invention is to obtain a bar coating device and a bar coating method capable of providing an evenly coated surface on an object to be coated with a coarse surface, even in the case where there is a high conveyance speed.

A first aspect of the present invention is a coating device for coating a liquid agent on a band-shaped substrate running in a predetermined direction, the coating device comprising: a coating station for coating a liquid agent on at least one surface of the substrate, and a coat-adjusting station disposed downstream of the coating station in the substrate conveyance direction, for adjusting the liquid agent amount to a predetermined thickness.

According to the coating device of the first aspect of the invention, the coating station serving as a coating means for coating a coating liquid on a substrate, and the coat-adjusting station serving as a measuring means or the coat-adjusting means for adjusting the coating liquid coated on the substrate into a predetermined thickness, such that the liquid agent coated on the substrate by the coating station is eliminated in the case of excess, and replenished in the case of shortage, are provided in the same coating device.

With this coating device, since the coating amount on the substrate is adjusted by the coat-adjusting means the coating amount of the coating liquid can be adjusted in the coating means regardless of the predetermined thickness required for the coating liquid layer. Therefore, even if the substrate is running at a high speed, by coating the coating liquid with the coating means sufficiently or to an excessive degree, entrained air film on the substrate surface can effectively be blocked so that the generation of defects such as coating film cuts or coating irregularities derived from the entrained air film can be prevented effectively.

The substrate is not particularly limited as long as it is a band-shaped, a thin plate-like or a film-like substance with flexibility. Specifically, aluminum support webs such as planographic printing plate precursor support members made of an aluminum thin plate, a film base for such photographic recording materials as photographic films and movie films; baryta paper such as a developing paper; recording material substrates made of polyester film, or the like used for magnetic recording material such as audio recording tapes, video tapes, and flexible discs; metal thin plates such as color iron plates, for coated metal plates, or the like can be presented.

Moreover, the band-shaped substrate may be a tape-like substance made of various kinds of papers such as a crafted paper, a parchment paper and a polyethylene coated paper.

To the coated surface of the band-shaped substrate, various kinds of treatments, such as sand-blasting and anodizing process can be applied.

The conveyance speed of the band-shaped substrate can be optionally set according to the production speed, the designed coating thickness of the coating liquid, the surface quality of the coated surface, or the like However, it is preferably 10 m/minute or more and particularly preferably in a range of 40 to 200 m/minute.

Examples of the coating liquid include photosensitive layer forming liquids or heat sensitive layer forming liquids for being coated on a support web of a planographic printing plate precursor and forming a plate-making layer; oxidization protecting layer forming liquids comprising a solution of an oxygen non-permeating resin such as a polyvinyl alcohol as a main component for being coated on the plate-making layer; or base forming liquids for forming a base for improving the adherence between the support web and the plate-making layer on the sand-blasted surface of the support web; and various kinds of solvents.

As the coating liquid, in addition thereto, photosensitive agent emulsions used for forming a photosensitive layer for photographic films, movie films and developing paper, or the like; halation preventing layer forming liquids used for forming a halation preventing layer for the photographic films or movie films; magnetic recording layer forming liquids for forming a magnetic recording layer in the magnetic recording material; various kinds of paints used for base, middle or upper coatings of the coated metal plates, or the like can be presented. However, as long as the coating liquid of the invention is a solution, a suspension, a solvent, or the like, to be coated onto the substrate, it is not limited to the above. However, the viscosity of the coating liquid is preferably 100 mPa·s or less, and particularly preferably 50 mPa·s or less. Moreover, the surface tension is preferably in a range of 20 to 70 mN/m.

Another layer may be formed preliminarily on the coated surface of the substrate. The thickness of the substrate is generally about 0.1 to 1 mm. However, it is not limited to this range.

In the coating device, the adjusting means may be provided for adjusting an amount of the coating liquid before drying the coating liquid coated on the substrate by the coating means. By performing this adjustment by the adjusting means before drying the coated coating liquid, generation of defects on the coated surface derived from entrained air on the substrate surface can be further prevented effectively.

The adjusting means may include a bar having a round cross section provided parallel with the running surface as the substrate running path (second coating bar). The bar may be a smooth bar (as a bar-shaped member with the surface formed smoothly). Since the coating liquid film is formed between the smooth bar and the substrate, direct contact of the smooth bar with the substrate can be prevented so that the surface of the substrate is not damaged by the smooth bar. The rotation direction of the smooth bar may either be opposite or the same as the conveyance direction of the substrate. The rotational frequency is preferably 500 rpm or less.

The bar for the adjusting means may be a bar-shaped member disposed parallel with the running surface as the substrate running path, with a groove formed in the circumferential direction on the surface. This may be referred to also as an adjusting bar or a measuring bar. For a bar thus formed, the tensile force applied to the substrate, the wrap angle as the angle of the substrate wrapping over the bar, or the like need not be changed for controlling the thickness of the liquid layer. By having the groove formed deeper in the bar, the coating liquid layer can be adjusted to be thicker. In contrast, by having the groove formed more shallow, the coating liquid layer can be adjusted to be thinner. Therefore, since the coating thickness of the coating liquid can be controlled by using a bar having different groove depths, the driving of the coating device need not be changed for control.

In the coating device, the bar formed in any of the above-mentioned shapes may be rotated with a rotational frequency of 500 rpm or less in the same or opposite direction of the running substrate direction. By setting the rotational frequency of the smooth bar in this range, the generation of the defects in the coated surface can be prevented particularly effectively.

The coating means may comprise a coating bar (first coating bar) to be rotated in the same direction as the substrate conveyance direction while contacting with the running substrate, and a liquid supplying means, upstream of the coating bar, for supplying the coating liquid between the coating bar and the substrate at the time of coating the coating liquid. For the bar type coating device, since a large amount of the coating liquid supplied from the liquid supplying means is taken up by the coating bar, the large amount can be coated on the substrate surface. Therefore, since it is possible to easily eliminate entrained air film, even when the substrate running at a high speed and the entrained air film formed on the substrate surface is made thicker, defects derived from entrained air are not easily generated.

The coating station may be a kind for coating the coating liquid on the substrate without contacting the substrate. If, therefore, the substrate does not contact the coating station, the substrate surface cannot be damaged by the coating means. The coating device can therefore be preferable for coating the coating liquid on the substrate with a coating film formed preliminarily.

The coating device may comprise a non-contact type coating bar for coating without contacting with the substrate. The bar may have a smooth surface, and be provided parallel with the substrate running surface. Furthermore, the coating device may comprise a liquid supplying means for supplying the coating liquid between the upstream side of the smooth bar and the substrate at the time of coating the coating liquid.

The non-contact type coating means for coating without contacting the substrate may be an extrusion coater having a slit-like liquid ejection opening for ejecting the coating liquid toward the running surface as the substrate running path in the substrate width direction, for forming the cross-link of the coating liquid between the substrate and the opening.

A second aspect of the present invention is a coating device for coating a liquid agent on a band-shaped substrate running in a predetermined direction, the coating device comprising: a first coating bar for coating a liquid agent on at least one surface of the substrate; and a second coating bar disposed downstream of the first coating bar in the substrate conveyance direction, for adjusting the coating amount of the liquid agent by evening the liquid agent to a predetermined thickness, wherein the first coating bar and the second coating bar are disposed such that the time interval for the substrate to move from a coating position where the liquid agent is coated by the first coating bar, to an adjusting position where the liquid agent is adjusted by the second coating bar, is 0.25 seconds or less.

For this bar type coating device, to the substrate being conveyed, that is, the object to be coated, the coating liquid is coated by the first coating bar (preliminary-coating bar) so as to be adhered preliminarily to form a preliminary-coated layer. Thereby, the entrained air on the object to be coated can be eliminated. Next, the coating liquid amount is adjusted (measured) by the second coating bar (adjusting bar or the measuring bar) to provide the desired coating layer on the object to be coated. By using the two coating bars (preliminary-coating bar and the adjusting (measuring) bar) for coating the coating liquid on the object to be coated, an evenly coated surface can be obtained in the entire width direction by reducing and preferably preventing the generation of entrained air. Accordingly, since the first coating bar can be considered to have a function of preliminarily-coating the coating liquid, it may be referred to also as the preliminary-coating bar.

Particularly in the case of this bar type coating device, the interval between the first coating bar (preliminary-coating bar) and the second coating bar (adjusting bar) is set to 0.25 second or less interval from the time the object to be coated contacts the first coating bar to the time it contacts the second coating bar. Thereby, since re-generation or building of entrained air can be prevented when the object to be coated is in a position from the first coating bar to the second coating bar, in the case where the surface roughness of the object to be coated is coarse, when, for example, it has a 0.20 μm or more arithmetic average coarseness Ra, an evenly coated surface can be obtained.

According to the second aspect of the invention, it is preferable to provide a rotation driving device for rotating at least one of the first coating bar and the second coating bar at a circumferential speed different from the conveyance speed of the object to be coated.

That is, at least one of the first coating bar and the second coating bar is rotated forcibly by the rotation driving device at a circumferential speed different from the conveyance speed of the object to be coated instead of rotation by the friction with the object to be coated. Thereby, since the bead can be stabilized, an even coated surface quality can be obtained even in the case the conveyance speed of the object to be coated is made higher or the viscosity of the coating liquid is made higher.

In the second aspect of the invention, a coating liquid containing an organic solvent may be used as the coating liquid. In the case where a coating liquid containing an organic solvent is used as the coating liquid, since the coating liquid coated by the first coating bar evaporates quickly, the entrained air can be generated particularly easily. However, even in that case, generation of the entrained air can be further prevented with certainty.

The peripheral temperature in the area from the first coating bar to the second coating bar may be maintained at 30° C. or lower. Thereby, excessive evaporation of the coating liquid can be prevented in the area from the first coating bar to the second coating bar so that generation of the entrained air can be further prevented with certainty.

A third aspect of the present invention is a coating device for coating a liquid agent on a band-shaped substrate running in a predetermined direction, the coating device comprising: a first coating bar for coating a liquid agent on at least one surface of the substrate; and a second coating bar disposed downstream of the first coating bar in the substrate conveyance direction, for adjusting the coating amount of the liquid agent by evening the liquid agent to a predetermined thickness, wherein a coating amount ratio of the coating amount of the liquid agent coated on the substrate after the substrate has passed the first coating bar with respect to the coating amount of the liquid agent coated on the substrate after the substrate has passed the second coating bar is 0.8 to 4.0.

According to the third aspect, the coating amount of the coating liquid after the substrate passes the first coating bar (preliminary-coating bar) is set at a coating amount ratio of 0.8 to 4.0 with respect to the coating amount of the coating liquid after the substrate passes the second coating bar (adjusting bar or the measuring bar). By having the coating amount ratio at 0.8 or more, the entrained air can be eliminated with certainty so that liquid exhaustion in the preliminary adhering coating can be prevented. Moreover, by having the coating amount ratio at 4.0 or less, bead can be made smaller at the time of adjustment with the second coating bar so as to maintain stability in the bead and prevent generation of the so-called coating. That is, by having the 0.8 to 4.0 coating amount ratio, an evenly coated surface can be obtained even in the case, for example, when the conveyance speed of the object to be coated is increased.

Furthermore, it is possible to provide a rotation driving device for rotating the first coating bar or the second coating bar at a circumferential speed different from the conveyance speed of the object to be coated. That is, the first coating bar or the second coating bar is rotated forcibly by the rotation driving device at a circumferential speed different from the conveyance speed of the object to be coated instead of rotation by friction with the object to be coated. Thereby, since the bead can be stabilized, an evenly coated surface can be obtained even in the case where the conveyance speed of the object to be coated or the viscosity of the coating liquid is increased.

A fourth aspect of the present invention is a coating device for coating a liquid agent on a band-shaped substrate running in a predetermined direction, the coating device comprising: a coating station for coating a liquid agent on at least one surface of the substrate, and a coat-adjusting station disposed downstream of the coating station in the substrate conveyance direction, for adjusting the liquid agent amount to a predetermined thickness, wherein the coating station comprises a first coating bar having a circumferential surface and disposed substantially parallel to the substrate surface for coating the liquid agent on the substrate surface, which coating bar rotates so that a side of the circumferential surface of the coating bar faces the substrate and moves in the same direction as the substrate conveyance direction at a circumferential speed of at least 1/15 of, and no more than equal to, a substrate conveyance speed.

According to the coating device, the coating liquid can be coated in a stable manlier even in the case where the band-shaped substrate conveyance speed is high, so that the evenness of the coated surface formed by coating the coating liquid on the band-shaped substrate is high.

The coat-adjusting station has a function of evening the coating liquid to a predetermined thickness for adjusting the amount of the coating liquid by scraping off the coating liquid, to reduce the adhered amount in the case where the coating liquid amount adhered on the band-shaped substrate by the coating station is excessive, and by further adhering the coating liquid on the band-shaped substrate in the case where the coating liquid amount adhered on the band-shaped substrate by the coating station is insufficient.

The rotation speed, in other words, the circumferential speed of the first coating bar can be optionally set according to the coating thickness of the coating liquid in a range of 1/15 or more of, and equal to or less than, the band-shaped substrate conveyance speed. Moreover, in the case where the weir plate is provided upstream of the first coating bar, the circumferential speed can be optionally set in that range according to the weir plate height, the coating thickness of coating liquid, or the like.

The conveyance speed of the band-shaped substrate can be set optionally according to the production speed, the coating thickness of the coating liquid, the surface quality required for the coated surface, or the like. It is preferably 10 m/minute or more, and particularly preferably in a range of 40 to 200 m/minute.

The amount of the coating liquid ejected from the coating station can be optionally set according to the conveyance speed of the band-shaped substrate, the height of the weir member, the coating thickness of the coating liquid, or the like. It is preferably in a range of 10 to 100 cc/$m^2$.

Furthermore, the circumferential speed of the first coating bar may be 1/15 to 3/4 of the conveyance speed of the band-shaped substrate. By setting accordingly, a coated surface with a higher evenness can be obtained.

Moreover, the circumferential speed of the first coating bar may be 1/10 to 1/2 of the conveyance speed of the band-shaped substrate. Thereby, a coated surface with a particularly high evenness can be obtained.

For the coating device of the fourth aspect of the invention, the coating liquid layer is evened to a predetermined thickness by the coat-adjusting station for adjusting the coating amount before the coating liquid adhered on the band-shaped substrate is dried.

Since the coat-adjusting station comprises the second coating bar, by controlling the circumferential speed and the rotation direction of the second coating bar, there can be a wide range of control of the coating thickness of the coating liquid. The second coating bar may be rotated in the same direction as the conveyance direction of the band-shaped substrate, or in the opposite direction. In the case the second coating bar is rotated in the same direction as the conveyance direction of the band-shaped substrate, where the band-shaped substrate has a joint, an advantage for preventing the generation of coating failure derived from the joint at the time the joint of the substrate passes the coat-adjusting station can be provided.

The coating device of the invention can be adopted to a planographic printing plate precursor. Even when the support web runs at a high speed, the coating liquid can be coated evenly on the support web without causing the adhesion of liquid to the back side thereof. As the support web, specifically, an aluminum support web that is an aluminum thin plate with at least one surface sand-blasted, can be presented.

As the coating liquid used in the coating device, a plate-making layer forming liquid for forming a plate-making layer, an anti-oxidation layer forming liquid for forming an anti-oxidation layer to be coated on the plate-making layer, or the like can be presented.

The plate-making layer forming liquid may be a photosensitive layer forming liquid containing a photosensitive resin used for forming a visual light exposure type plate-making layer, or a laser photosensitive layer forming liquid containing a heat sensitive resin or a photo polymerizable resin used for forming a laser exposure type plate-making layer.

A fifth aspect of the invention is a coating device for coating a liquid agent on a band-shaped substrate running in a predetermined direction, the coating device comprising: a coating station for coating a liquid agent on at least one surface of the substrate, and a coat-adjusting station disposed downstream of the coating station in the substrate conveyance direction, for adjusting the liquid agent amount to a predetermined thickness, wherein the coating station comprises: a first coating bar having a circumferential surface, disposed substantially parallel to the substrate surface, the first coating bar for coating the liquid agent on the substrate surface and rotating with the side of the circumferential surface thereof that faces the substrate moving in the same direction as the substrate conveyance direction; and a weir member having a height and disposed upstream of the first coating bar in the substrate conveyance direction and facing the first coating bar, for forming a bead of the liquid agent between the first coating bar and the substrate, with a height of the weir member top surface being the same as or higher than a lowermost point of the circumferential surface of the first coating bar, and lower than an uppermost point of the circumferential surface of the first coating bar by 1 mm or more.

According to the coating device of the above-mentioned embodiment, since the height of the weir member in the coating station is in the above-mentioned range, the liquid level height of the coating liquid ejected between the first coating bar and the weir member at the time of coating is the same as or higher than the lowermost point of the surface of the first coating bar and lower than the uppermost point of the surface of the first coating bar by 1 mm or more.

Therefore, since a part of the first coasting bar is always in contact with the coating liquid, a sufficient amount of coating liquid can be taken up by the first coating bar so as to be coated onto the band-shaped substrate. Therefore, even in the case where the band-shaped substrate conveyance speed is high, the coating liquid can be coated evenly. Moreover, the coating liquid does not move circulate around to and adhere to the surface opposite to the coated surface to be coated with the coating liquid of the band-shaped substrate.

Furthermore, the coat-adjusting station has a function of adjusting the coating liquid adhered on the band-shaped substrate to a predetermined thickness by scraping off the coating liquid to reduce the coating layer thickness in the case where the coating amount of the coating liquid by the coating station is excessive, and by coating on more coating liquid in the case where the coating liquid thickness by the coating station is insufficient.

As the weir member comprising the coating station, a wall-shaped member provided vertically upright facing the first coating bar, or the like can be presented. Moreover, the top portion of the wall-shaped member may be bent toward the first coating bar. The surface of the weir member at the top portion thereof, facing the first coating bar, is preferably a surface that is parallel to the tangential plane that contacts a part of the outer circumferential surface of the first coating bar, that part faces the top portion of the weir member.

The first coating bar is preferably made of a metal due to metal's strength and wear resistance. It is particularly preferably made of a stainless steel for not only its excellent strength and wear resistance but also for its the excellent corrosion resistance.

The first coating bar may be a smooth bar with the surface formed smoothly. It may be a bar with a groove formed along the circumferential direction in the surface. Moreover, it may be a wire bar with a wire wound around in the circumferential direction on the surface.

For the bar with a groove, the groove depth is preferably in a range of 0.05 to 1 mm, particularly preferably in a range of 0.07 to 0.5 mm. Moreover, the groove pitch is preferably in a range of 0.05 to 0.1 mm, particularly preferably in a range of 0.1 to 0.6 mm.

As the cross-sectional shape of the groove, various kinds of shapes, such as a sine curve, a trapezoid, a semi circle and a triangle can be used.

For the wire bar, the wire diameter is preferably in a range of 0.07 to 1 mm, particularly preferably in a range of 0.07 to 0.6 mm. The wire material is preferably a metal for metal's the wear resistance and corrosion resistance, and it is particularly preferably a stainless steel.

Hard chromium plating may be applied to the surface of the first coating bar for further improving the wear resistance.

The rotation speed of the first coating bar can be optionally set according to the height of the weir member, the coating thickness of the coating liquid, or the like. However, it is preferable to rotate the first coating bar at a circumferential speed of 1/15 or more of, and equal to or less than, the band-shaped substrate conveyance direction speed.

The above-mentioned description for the first coating bar may be adopted to the other aspects of the present invention concerning the first coating bar.

The amount of coating liquid ejected in the coating station can be optionally set according to the conveyance speed of the band-shaped substrate, the height of the weir member, the coating thickness of the coating liquid, or the like. It is preferably in a range of 10 to 100 cc/$m^2$.

A sixth aspect of the present invention is a coating device for coating a liquid agent on a band-shaped substrate running in a predetermined direction, the coating device comprising: a coating station for coating a liquid agent on at least one surface of the substrates and a coat-adjusting station disposed downstream of the coating station in the substrate conveyance direction, for adjusting the liquid agent amount to a predetermined thickness, wherein the coating station comprises: a first coating bar having a circumferential surface, disposed substantially parallel to the substrate surface, the first coating bar for coating the liquid agent on the substrate surface and rotating with the side of the circumferential surface thereof that faces the substrate moving in the same direction as the substrate conveyance direction; and a weir member having a height and disposed upstream of the first coating bar in the substrate conveyance direction and facing the first coating bar, for forming a bead of the liquid agent between the first coating bar and the substrate, with an interval between the surface of the weir member that faces the first coating bar and the circumferential surface of the first coating bar being 3 mm or more.

For the coating station of the above-mentioned coating device, since the interval between the weir member and the first coating bar is 3 mm or more, even in the case where the coating liquid is brought up by the first coating bar, the liquid level height of the coating liquid in the coating station can be stable. Therefore, since the amount of coating liquid distribution supplied from the coating station to the band-shaped substrate is even, the coating liquid can be adhered on the entire surface of the band-shaped substrate evenly.

The height of the top surface of the weir member may be provided such that it is same the as or higher than the height of the lowermost point of the surface of the first coating bar and lower than the height of the uppermost point of the surface of the first coating bar by 1 mm or more. Moreover, the interval between the side of the weir member facing the first coating bar and the outer circumferential surface of the first coating bar is to be 3 mm or more.

Thereby, since a part of the first coating bar is always in contact with the coating liquid, a sufficient amount of coating liquid can be taken up by the first coating bar so as to be adhered on the band-shaped substrate.

Moreover, since the interval between the weir member and the first coating bar is provided at 3 mm or more, even in the case where the coating liquid is taken up by the first coating bar, the liquid level height of the coating liquid in the coating station can be stable. Therefore, the amount of coating liquid distribution supplied from the coating station to the band-shaped substrate can be even.

Therefore, even in the case where the band-shaped substrate conveyance speed is high, the coating liquid can be coated particularly evenly. Moreover, the coating liquid does not move circulate around and adhere to the surface opposite to the coated surface to be coated with the coating liquid of the band-shaped substrate.

The interval between the surface of the side of the weir member facing the first coating bar and the outer circumferential surface of the first coating bar may be provided at 3 to 30 mm. Thereby, a more even coated surface can be obtained.

The circumferential speed of the first coating bar may be in a range of 1/15 or more of, and equal to or less than, the substrate conveyance speed. In the coating station, since the coating liquid ejected between the weir member and the first coating bar can be taken up sufficiently by the first coating bar, the coating liquid can be adhered evenly on the band-shaped substrate so that a highly even coated surface can be obtained.

Furthermore, in the coating station the coat-adjusting station may comprise a second coating bar for evening the coating liquid adhered on the band-shaped substrate to a predetermined thickness. In the coat-adjusting station, in the case where the rotational frequency of the second coating bar is increased, the coating thickness of the coating liquid in the coating substance to be obtained is reduced. When the rotational frequency of the second coating bar is reduced, the coating thickness of the coating liquid in the coating substance to be obtained is increased. Therefore, by increasing or reducing the rotational frequency of the second coating bar, the coating thickness can also be increased or reduced.

Moreover, the second coating bar may be provided so as to be rotated in the direction opposite to the conveyance direction of the band-shaped substrate. Since the adhered coating liquid can be evened to a predetermined thickness in the coat-adjusting station, even in the case where a large amount of the coating liquid is adhered on the band-shaped substrate in the coating station and the conveyance speed of the band-shaped substrate is high, the entrained air taken into the band-shaped substrate can be eliminated effectively so that the generation of problems in the quality of the coated surface can be prevented.

The second coating bar may be rotated in the same direction as the conveyance direction of the band-shaped substrate. Since the relative speed of the second coating bar with respect to the band-shaped substrate is less than in the case of a rotation that is opposite, the amount of coating liquid taken up in the coat-adjusting station is smaller. Therefore, a same direction rotation is preferable for the case of obtaining a larger coating thickness.

The band-shaped substrate conveyance speed can be provided at 100 m/minute or more. In this case, since the conveyance speed of the band-shaped substrate is high, the coating liquid can be coated efficiently.

The coating device of the present aspect of the invention is applicable to a planographic printing plate precursor. Description in the other aspects can be referred to for the planographic printing plate precursor applications.

A seventh aspect of the present invention is a coating device for coating a liquid agent on a band-shaped substrate running in a predetermined direction, the coating device comprising: a coating station for coating a liquid agent on at least one surface of the substrate, and a coat-adjusting station disposed downstream of the coating station in the substrate conveyance direction, for adjusting the liquid agent amount to a predetermined thickness, wherein the coating station comprises: a first coating bar disposed substantially parallel to the substrate surface and including a circumferential surface, a side of which faces the substrate, the first coating bar for coating the liquid agent on the substrate surface and being rotated with the side of the circumferential surface that faces the substrate moving in the same direction as the substrate conveyance direction; a weir member disposed upstream of the first coating bar in the substrate conveyance direction and facing the first coating bar, for forming a bead of the liquid agent between the first coating bar and the substrate; and a rectifying member disposed between the weir member and the first coating bar, for forming a liquid agent flow to be raised along the surface of the first coating bar.

In the coating station, the coating agent is supplied between the weir member and the first coating bar so that the coating agent is taken up by the first coating bar toward the band-shaped substrate. Since the rectifying member is provided between the weir member and the first coating bar, the coating liquid flow can be generated between the first coating bar and the rectifying member toward the band-shaped substrate. Accordingly, the coating liquid flow to be raised along the surface of the first coating bar can be formed. Then, a part of the coating liquid raised along the surface of the first coating bar is adhered on the band-shaped substrate, and the remainder thereof flows down between the rectifying member and the weir member along the surface on the side opposite to the side facing the first coating bar.

Therefore, it can be considered that a circulating flow rising along the downstream surface of the rectifying member, passing over the rectifying member, and then descending along the upstream surface of the rectifying member is generated in the vicinity of the rectifying member.

Therefore, the fluctuation of the amount of coating liquid adhered on the band-shaped substrate can be restrained, and the generation of coated surface disturbances derived from the fluctuation can also be restrained, so that the coating liquid can be coated on the surface of the band-shaped substrate with an even thickness.

In contrast, in the coat-adjusting station, the coating liquid is adjusted to be evened to a predetermined thickness by scraping off excessive coating liquid to reduce the adhering amount in the case where the coating liquid amount adhered on the band-shaped substrate in the coating station is excessive, and further, by adhering the coating liquid on the band-shaped substrate in the case where the coating liquid amount adhered on the band-shaped substrate in the coating station is insufficient.

In the coat-adjusting station, it is possible to provide a coating bar the same as the first coating bar installed at the coating station.

As for the rectifying member installed at the coating station, a rectifying plate as a plate-shaped member elongating toward the band-shaped substrate running surface can be presented. However, as long as the rectifying member has a function of generating circulation flow it is not limited to the rectifying plate.

The rectifying plate may be a flat plate-shaped member extending from the bottom part of the coating station toward the band-shaped substrate. It is preferable that the tip portion, that is, the top portion thereof is bent toward the first coating bar.

As the weir member, a plate-shaped member extending upward toward the running surface, which is the running path of the band-shaped substrate, can be given. The weir plate may be provided upright in the vertical direction so as to face the first coating bar. Moreover, a bent portion that bends toward the first coating bar may be provided at the top portion of the weir member. Furthermore, the bent portion may be formed in an "L" shape. Moreover, a cylindrical surface may be formed on the surface of the weir member that faces the first coating bar so as to approach to the first coating bar.

The rotation speed of the first coating bar can be set optionally according to the height of the weir member, the coating thickness of the coating liquid, or the like. The first coating bar is rotated preferably at a circumferential speed of at least 1/15 of, and no more than equal to, the band-shaped substrate conveyance speed in the same direction as the substrate conveyance direction.

The conveyance speed of the band-shaped substrate can be set optionally according to the production speed, the coating thickness of the coating liquid, the desired surface quality of the coated surface, or the like. It is preferably 10 m/minute or more, and particularly preferably in a range of 40 to 200 m/minute.

The coating liquid ejection amount in the coating station can be set optionally according to the conveyance speed of the band-shaped substrate, the height of the weir member, the coating thickness of the coating liquid, or the like. It is preferably in a range of 15 to 100 cc/$m^2$.

The rectifying member may be a plate-shaped member provided parallel to the weir member, with a bent portion bent toward the first coating bar formed in the tip portion. It is thought that by providing the bent portion, the circulation flow that flows around the bent portion of the rectifying member from the downstream side to the upstream side can be formed more stably. The fluctuation of the amount of coating liquid adhered on the band-shaped substrate can be restrained further effectively and the coated surface disturbance derived from the fluctuation can be restrained further effectively so that a more evenly coated surface can be obtained.

The bent portion in the rectifying member may be formed parallel to a tangential plane that contacts a part of the first coating bar, which part is facing the bent portion. Since the coating liquid flow is formed parallel to the tangential plane of the first coating bar between the tip portion of the weir member and the first coating bar, the fluctuation of the amount of coating liquid adhered on the band-shaped substrate can be restrained particularly effectively so that generation of the coated surface disturbance derived from the fluctuation can be suppressed. Therefore, a particularly evenly coated surface can be obtained.

Furthermore, the shortest distance between the surface of the tip portion of the rectifying member on the side facing the first coating bar and the outer circumferential surface of the first coating bar may be 1 mm or less. The shortest distance is also the distance between the bent portion of the rectifying member and the tangential plane of the first coating bar. Thereby, generation of an uncoated part in the case of using a high viscosity coating liquid can be prevented.

Moreover, the distance from the tip of the rectifying member to the running surface may be provided by 3 mm or less. Thereby, generation of bead streaks, which are stripe-like thinly coated parts along the longitudinal direction can be prevented effectively.

The shortest distance between the surface of the tip portion of the rectifying member on the side facing the first coating bar and the outer circumferential surface of the first coating bar may be 0.05 to 1 mm. Thus, generation of an uncoated part in the case of using a highly viscous coating liquid can be prevented particularly effectively.

The distance from the tip of the rectifying member to the running surface of the substrate may be 0.05 to 3 mm. This is particularly effective for preventing generation of the bead streaks.

Moreover, the band-shaped member may be a support web, which is the substrate for the planographic printing plate precursor. Examples of the coating liquid to be coated on the support web, include photosensitive layer forming liquids, heat sensitive layer forming liquids and base forming liquids. Moreover, in the case where the support web has a plate-making layer on the surface, an oxidization protecting layer forming liquid may be coated thereon. By coating the plate-making layer forming liquid on the sand-blasted surface of the support web, and using this support web for production of a planographic printing plate precursor, a planographic printing plate precursor that does not have a defect part in the plate-making layer can be obtained.

An eighth aspect of the invention is a coating device for coating a liquid agent on a band-shaped substrate running in a predetermined direction, the coating device comprising: a coating station for coating a liquid agent on at least one surface of the substrate, and a coat-adjusting station disposed downstream of the coating station in the substrate conveyance direction, for adjusting the liquid agent amount to a predetermined thickness, wherein the coat-adjusting station comprises: a bar disposed substantially parallel to the substrate surface, for evening and adjusting the liquid agent coated on the substrate to a predetermined thickness; and a block disposed upstream of the bar in the substrate conveyance direction and facing the bar, for forming a bead of the liquid agent between the bar and the substrate.

The coat-adjusting station has a function of evening the coating liquid adhered at the coating station so as to adjust the coating liquid on the substrate to a predetermined thickness as mentioned above by scraping off the coating liquid in the case where the coating liquid adhering amount is excessive at the coating station, and coating more of the coating liquid in the case where the coating liquid adhering amount is insufficient.

However, in the case where the fluctuation is generated in the coating liquid adhering amount at the coating station, a pressure change is generated in the width direction of the bar installed at the coat-adjusting station as well so that an evenly coated surface cannot be obtained.

In the above-mentioned aspect of the invention, since the bead of the coating liquid is formed between the block and the bar on the upstream side and the substrate at the coat-adjusting station so that the fluctuation of the coating liquid adhering amount generated at the coating station can be absorbed in the bead, the pressure change is not generated in the width direction of the bar and an evenly coated surface can be obtained.

As an example of the upstream side block, a weir member provided upright vertically facing the bar can be given. In the weir member, it is preferable that the upstream side block has a bent portion formed at the tip portion that is bent toward the bar, that is, the top portion. Furthermore, it is preferable that the surface of the bent portion on the side facing the bar is formed parallel to the tangential plane contacted with a part of the bar facing the tip of the bent portion. Since the bead can be formed further stably, even in the case where the coating liquid adhering amount in the coating station fluctuates, generation of the coating failure on the coated surface can be particularly suppressed.

The bar may be a forward rotation bar to be rotated in the same direction as the conveyance direction of the band-shaped substrate, or it may be a backwardly rotating bar to be rotated in the direction opposite to the conveyance direction of the band-shaped substrate. However, for stably forming the bead between the upstream side block and the band-shaped substrate, and prevention of generation of the coating failure such as the uncoated part or the thinly coated part at a joint portion of the band-shaped substrate, the forward rotation bar is preferable.

The rotation speed of the bar can be set optionally according to the coating thickness of the coating liquid and the adhering amount of the coating liquid in the coating station. In general, it can be set at a circumferential speed range of −30 m/minute to +30 m/minute. The minus-sign indicates the backward rotation and the plus-sign indicates the forward rotation.

The coating amount of the coating liquid on the band-shaped substrate after the substrate passes the coat-adjusting station in the coating device is in general 5 to 100 cc/$m^2$ and is preferably in a range of 10 to 40 cc/$m^2$. The ejection amount of the coating liquid at the coating station can be set optionally according to the conveyance speed of the band-shaped substrate, the coating amount of the coating liquid after coat-adjustment, or the like. It is preferably in a range of 15 to 100 cc/$m^2$.

The shortest distance from the surface of the bent portion of the upstream side block on the side facing the bar to the outer circumferential surface of the bar may be 3 mm or less. Since the bead can be formed particularly stably among the bar, the upstream side block and the band-shaped substrate, the fluctuation of the coating liquid adhering amount generated in the coating station can be absorbed particularly effectively. Therefore, the conveyance speed of the band-shaped substrate can be particularly increased so that even in the case where the coating liquid adhering amount fluctuates drastically at the coating station, the fluctuation can be absorbed in the bead, and thus generation of the coating failure with stripe-like thinly coated part formed along the longitudinal direction such as the bead streaks and the stripe-like dots can be prevented.

Furthermore, the above-mentioned shortest distance can be in a range of 0.05 to 3 mm. Even in the case where the conveyance speed of the band-shaped substrate is increased so that the band-shaped substrate flutters at the coating station, coating irregularity derived from the fluttering can be absorbed in the bead at the coat-adjusting station so that the coating failure can be prevented.

The distance from the tip of the upstream side block to the running surface which is the running path of the band-shaped substrate can be 3 mm or less. Since the bead can be formed particularly stably between the bar and the upstream side block and the band-shaped substrate, the fluctuation of the coating liquid adhering amount generated at the coating station can be absorbed particularly effectively in the coating device. Therefore, even in the case where the conveyance speed of the band-shaped substrate is increased, generation of the coating failure can be prevented effectively.

Moreover, the above-mentioned distance can be in a range of 0.1 to 3 mm. Even in the case where the conveyance speed is increased to the extent that the band-shaped substrate flitters, since the fluctuation of the coating liquid adhering amount generated at the coating station can be absorbed in the bead at the coat-adjusting station, the coating failure is not generated.

The coating station may comprise a coating bar for adhering the coating liquid to the band-shaped substrate.

As the coating bar, a smooth bar, a bar with a groove, and a wire bar may be used similarly to the bar installed at the coat-adjusting station. Moreover, the rotation direction may either be the forward rotation or the backward rotation. As the coating bar, since a strong force for taking up the coating liquid and adhering the same to the band-shaped substrate is preferable, a bar with a groove or a wire bar with the forward rotation is preferable.

The distance from the tip portion of the upstream side block of the coat-adjusting station to the outer circumferential surface of the bar along the band-shaped substrate conveyance direction may be in a range of 1.2 to 11 mm. Thereby, the bead can be formed particularly stably in the coat-adjusting station.

The coating device according to the above-mentioned aspect of the invention can also be used for production of the planographic printing plate precursor. Thereby, a planographic printing plate precursor can be produced with a high production speed and a low defective goods generation ratio. Since the bead can be formed stably in the coat-adjusting station, the fluctuation of the coating liquid adhering amount in the coating station can be absorbed effectively in the bead, and thus generation of the coated surface disturbance derived from the fluctuation can be restrained so that the coating liquid can be coated evenly on the surface of the support web of the planographic printing plate precursor.

As examples of the coating liquid to be coated on the support web, photosensitive layer forming liquids, heat sensitive layer forming liquids and base forming liquids can be given. In the case where the support web has a plate-making layer on the surface, the coating device of the invention may be used for coating the oxidization protecting layer forming liquid thereon in the plate-making layer forming process. Planographic printing plate precursor that does not have a failure part in the plate-making layer can be obtained.

A ninth aspect of the invention is a coating device for coating a liquid agent on a band-shaped substrate running in a predetermined direction, the coating device comprising: a bar disposed substantially parallel to at least one surface of the substrate for evening the liquid agent coated on the substrate surface to a predetermined thickness; and a primary side weir member disposed upstream of the bar in the substrate conveyance direction and facing the bar, for forming a bead of the coating liquid agent between the bar and the substrate, wherein an interval between a side of the primary side weir member facing the bar and the circumferential surface of the bar is 2 mm or less.

According to the ninth aspect of the invention, since the distance between the surface of the primary side weir member on the side facing the bar and the outer circumferential surface of the bar is 2 mm or less, the coating liquid can be ejected evenly along the width direction of the band-shaped substrate continuously. Therefore, since the coating liquid adhered on the top portion of the primary side weir member cannot be dried and solidified, generation of the coating streaks or the coated surface problem such as adhesion of a solid component, or the like can be prevented. The distance between the side of the primary side weir member facing the bar and the outer circumferential surface of the bar is 2 mm or less, preferably 1 mm or less, and particularly preferably 0.05 to 1 mm.

The primary side weir member may be a wall-shaped member disposed vertically upright and facing the bar. Moreover, in the wall-shaped member, the top portion may be bent toward the bar. A surface of the primary weir member in the vicinity of the top portion thereof facing the bar is preferably parallel to a tangential line that contacts a part of the outer circumferential surface of the bar, which part faces the top portion of the primary weir member.

Moreover, the primary side weir member may have a vertical surface formed at the top portion thereof, which is facing the bar. Furthermore, a horizontal surface facing the running surface of the band-shaped substrate may be formed at the top of the primary side weir member.

The bar may be rotated in the direction opposite to the conveyance direction of the band-shaped substrate, that is, rotated backwardly, it may be rotated in the same direction as the conveyance direction, or it may remain still.

In the case where the bar is rotated in the direction opposite to the conveyance direction of the band-shaped substrate, the rotational frequency is preferably 500 rpm or less. In the case where the bar is rotated in the same direction as the conveyance direction of the band-shaped substrate, a circumferential speed of the bar is preferably the same as or lower than the conveyance speed of the band-shaped substrate.

The description provided for the above-mentioned aspects can be referred to for the band-shaped substrate and the coating liquid as well.

The circumferential speed of the bar of the coating device may be different from the conveyance speed of the band-shaped substrate. In this case, the bar may be rotated forwardly or backwardly or it may be fixed at the time of coating the coating liquid.

In the coating device of the above-mentioned embodiment, by controlling the rotational frequency of the bar, the coating thickness of the coating liquid on the coated surface of the band-shaped substrate can be adjusted. For example, in the case where the bar is rotated forwardly, by reducing the rotation speed of the bar, the coating thickness of the coating liquid onto the band-shaped substrate can be increased. In contrast, in the case where the bar is rotated backwardly, by increasing the rotation speed thereof, the coating thickness of the coating liquid onto the band-shaped substrate can be reduced.

The coating device of the above-mentioned aspects of the invention may comprise a wetting liquid coating means for coating a wetting liquid for wetting the surface of the bar on the downstream side surface of the bar.

In the coating device, not only the surface upstream of the bar but also the surface on the downstream side thereof can be maintained in a wet state. Thus, a problem such as a film-like solid component being generated by a coating liquid, which is adhered to the surface of the bar, drying and adhering to the coated surface of the band-shaped substrate, and causing a thick coating, or the like, can be prevented.

The wetting liquid coating means may be disposed downstream of the bar relative to the conveyance direction of the band-shaped substrate and facing the bar, and may be comprise a secondary side weir member of a height lower than that of the primary side weir member. The wetting liquid is ejected between the secondary side weir member and the bar so that the wetting liquid is coated on the surface of the bar. Thereby, the coating liquid exists in the vicinity of the bar further stably so that solidification of the coating liquid on the surface of the bar can be prevented particularly effectively.

The wetting liquid, that is, the drying prevention liquid may be the coating liquid. Since the coating liquid is used as the drying prevention liquid, even in the case where the coating liquid and the drying prevention liquid are mixed on the surface of the bar, the composition of the coating liquid can be maintained to be substantially constant. In a coating device having the coating liquid it is particularly preferably collected and reused. Moreover, since a pipe path for supplying the drying prevention liquid need not to be provided independently from the pipe path for the coating liquid, the piping can be simplified dramatically.

The band-shaped substrate may be a support web as the substrate for a planographic printing plate precursor. Thereby, generation of a problem, such as adhesion of the solid component of the dried coating liquid on the undried coated surface in the support web or thick coating by mixing of the solid component into the undried coating liquid, or the like can be prevented effectively.

A tenth aspect of the present invention is a coating method for coating a liquid agent on a band-shaped substrate, the coating method comprising the steps of: running the substrate in a predetermined direction; coating a liquid agent on at least one surface of the running substrate; and coat-adjusting the amount of the coated liquid agent to a predetermined thickness.

According to the coating method of the tenth aspect of the invention, since the coating step for coating the coating liquid on the substrate and the coat-adjusting step for adjusting the coating liquid coated on the substrate to a predetermined thickness are provided separately, the coating amount in the coating step can be set regardless of the predetermined thickness required for the coating liquid layer. Therefore, even if the substrate is running at a high speed, by coating the coating liquid in a sufficient amount or to excess in the coating step, entrained air film on the substrate surface can effectively be blocked so that the generation of defects such as film cuts or coating irregularities derived from the entrained air film can be prevented effectively.

An eleventh aspect of the invention is a coating method for coating a liquid agent on a band-shaped substrate, the coating method comprising the steps of: running the substrate in a predetermined direction; coating a liquid agent on at least one surface of the running substrate; and coat-adjusting the amount of the coated liquid agent to a predetermined thickness, wherein the conveyance time of the substrate between the coating step and the coat-adjusting step is 0.25 seconds or less.

For this coating method of the eleventh aspect of the present invention, to the substrate being conveyed, that is, the object to be coated, the coating liquid is coated in the coating step (that is, a first coating step or a preliminary-coating step) so as to be adhered preliminarily to form a preliminary-coated layer. Thus, the entrained air on the object to be coated can be eliminated. Next, the coating liquid amount is adjusted (measured) by the coat-adjusting step (that is, a second coating step, an adjusting step or a measuring step) to provide the desired coating layer on the object to be coated. By using the two coating steps (first and second coating steps) for coating the coating liquid on the object to be coated, an evenly coated surface can be obtained in the entire width direction by reducing and preferably preventing the generation of entrained air.

Particularly in the case of this coating method, the interval between the coating step (first coating step or preliminary-coating step) and the coat-adjusting step (second coating step or adjusting step) is 0.25 second or less from the time the object to be coated is coated in the first coating step to the time it is coated in the second coating step. Thus, since re-generation or building of entrained air can be prevented when the object to be coated is in a time interval from the first coating step to the second coating step, in the case where the surface roughness of the object to be coated is coarse, when, for example, it has a 0.20 μm or more arithmetic average coarseness Ra, an evenly coated surface can be obtained.

In the eleventh aspect of the invention, the liquid agent may contain an organic solvent.

A twelfth aspect of the invention is a coating method for coating a liquid agent on a band-shaped substrate, the coating method comprising the steps of: running the substrate in a predetermined direction; coating a liquid agent on at least one surface of the running substrate; and coat-adjusting the amount of the coated liquid agent to a predetermined thickness, wherein a coating amount ratio of the coating amount of the liquid agent coated on the substrate immediately after the coating step to the coating amount of the liquid agent after the coat-adjusting step is 0.8 to 4.0.

Furthermore, in the case where at least one of the coating step and the coat-adjusting step includes a step of coating the liquid agent on the substrate surface using a bar disposed substantially parallel to the substrate surface, the bar may be rotated at a circumferential speed different from the conveyance speed of the substrate.

A thirteenth aspect of the invention is a coating method for coating a liquid agent on a band-shaped substrate, the coating method comprising the steps of: running the substrate in a predetermined direction; coating a liquid agent on at least one surface of the running substrate; and coat-adjusting the amount of the coated liquid agent to a predetermined thickness, wherein the coating step includes a sub-step of coating the liquid agent on the substrate surface using a bar, which is disposed substantially parallel to the substrate surface and rotated such that a circumferential surface on the side facing the substrate moves in the same direction as the substrate conveyance direction at a circumferential speed of at least 1/15 of, and no more than equal to, the substrate conveyance speed.

According to the coating method, the coating liquid can be coated in a stable manner even in the case where the band-shaped substrate conveyance speed is high, so that the evenness of the coated surface formed by coating the coating liquid on the band-shaped substrate is high.

In the above-mentioned coating method, a preferable range of the circumferential speed of the bar is 1/15 to 3/4, and a particularly preferable range is 1/10 to 1/2 of the conveyance speed of the band-shaped substrate. Moreover, in the above-mentioned coating step, it is preferable to adjust the coating thickness in the coat-adjusting step before the coating liquid adhered on the band-shaped substrate in the coating step is dried.

A fourteenth aspect of the invention is a coating method for coating a liquid agent on a band-shaped substrate, the coating method comprising the steps of: running the substrate in a predetermined direction; coating a liquid agent on at least one surface of the running substrate; and coat-adjusting the amount of the coated liquid agent to a predetermined thickness, wherein the coating step includes a sub-step of coating the liquid agent on the substrate surface using a bar disposed substantially parallel to the substrate surface, by forming a bead between the bar and the substrate by a weir member disposed upstream of the bar in the substrate conveyance direction, facing the bar, with a height of the top surface of the weir member being at least as high as a height of the lowermost point of the surface of the bar, and lower than an uppermost point of the surface of the bar by 1 mm or more, so that the liquid agent is coated on the substrate surface from the bead.

According to the above-mentioned coating method, even in the case where the conveyance speed of the band-shaped substrate is high, an evenly coated surface without the generation of coating failures in the coated surface can be obtained.

A fifteenth aspect of the invention is a coating method for coating a liquid agent on a band-shaped substrate, the coating method comprising the steps of: running the substrate in a predetermined direction; coating a liquid agent on at least one surface of the running substrate; and coat-adjusting the amount of the coated liquid agent to a predetermined thickness, wherein the coating step includes a sub-step of coating the liquid agent on the substrate surface using a bar disposed substantially parallel to the substrate surface, by forming a bead between the bar and the substrate by a weir member disposed upstream of the bar in the substrate conveyance direction and facing the bar, and disposed so that the interval between a surface on the side of the weir member facing the bar and the circumferential surface of the bar is 3 mm or more, so that the liquid agent is coated on the substrate surface from the bead.

In the above-mentioned coating method, since the amount of coating liquid distribution supplied from the coating station to the band-shaped substrate is even, the coating liquid can be adhered on the entire surface of the band-shaped substrate evenly.

A sixteenth aspect of the invention is a coating method for coating a liquid agent on a band-shaped substrate, the coating method comprising the steps of: running the substrate in a predetermined direction; coating a liquid agent on at least one surface of the running substrate; and coat-adjusting the amount of the coated liquid agent to a predetermined thickness, wherein the liquid agent is coated on the substrate surface by disposing a weir member upstream of the bar in the conveyance direction and facing the bar, to form a bead of the liquid agent between the bar and the substrate, and by disposing a rectifying member between the weir member and the bar, to cause, in the bead, a liquid agent current to flow up a surface of the bar.

According to the above-mentioned coating method, since a stable circulating flow can be formed in the vicinity of the rectifying member, the fluctuation of the amount of coating liquid adhered on the band-shaped substrate can be suppressed so that the coating liquid can be coated on the surface of the band-shaped substrate with an even thickness.

A seventeenth aspect of the invention is a coating method for coating a liquid agent on a band-shaped substrate, the coating method comprising the steps of: running the substrate in a predetermined direction; coating a liquid agent on at least one surface of the running substrate; and coat-adjusting the amount of the coated liquid agent to a predetermined thickness, wherein the coat-adjusting step includes a sub-step of adjusting the liquid agent on the substrate surface by evening the liquid agent using a bar disposed substantially parallel to the substrate surface, wherein the coating liquid is evened to a predetermined thickness by forming a bead of the coating liquid between the bar and the substrate by an upstream side block disposed upstream of the bar in the substrate conveyance direction and facing the bar.

Thus, in the coat-adjusting step the bead can be formed in a stable manner so that the fluctuation of the coating liquid adhering amount generated in the coating step can be absorbed. Therefore, even in the case where the band-shaped substrate is running at a high speed, the coating liquid can be coated stably on the band-shaped substrate.

An eighteenth aspect of the invention is a liquid agent coating method for a band-shaped substrate running in a predetermined direction, the method including a step of adjusting a liquid agent coated on the surface of the substrate to a certain thickness using a bar, the method comprising: a step of forming a bead of a coating liquid agent between the bar and the substrate; and a step of coating the liquid agent on the substrate from the bead, wherein an interval between a surface of a primary side weir member disposed upstream of the bar in the substrate conveyance direction and facing the bar, and the outer circumferential surface of the bar is 2 mm or less.

According to the coating method of the above-mentioned aspect of the invention, since drying and solidification of the coating liquid adhered on the top portion of the primary side weir member can be prevented, coated surface problems such as coating streaks and solid component adhesion can be prevented.

BRIEF DESCRIPTION OF THE DRAWINGS

FIG. 3A shows the device not engaged in the operation of coating, and FIG. 3B shows the device engaged in the operation of coating.

DESCRIPTION OF THE PREFERRED EMBODIMENTS

First Embodiment

Figure 1:
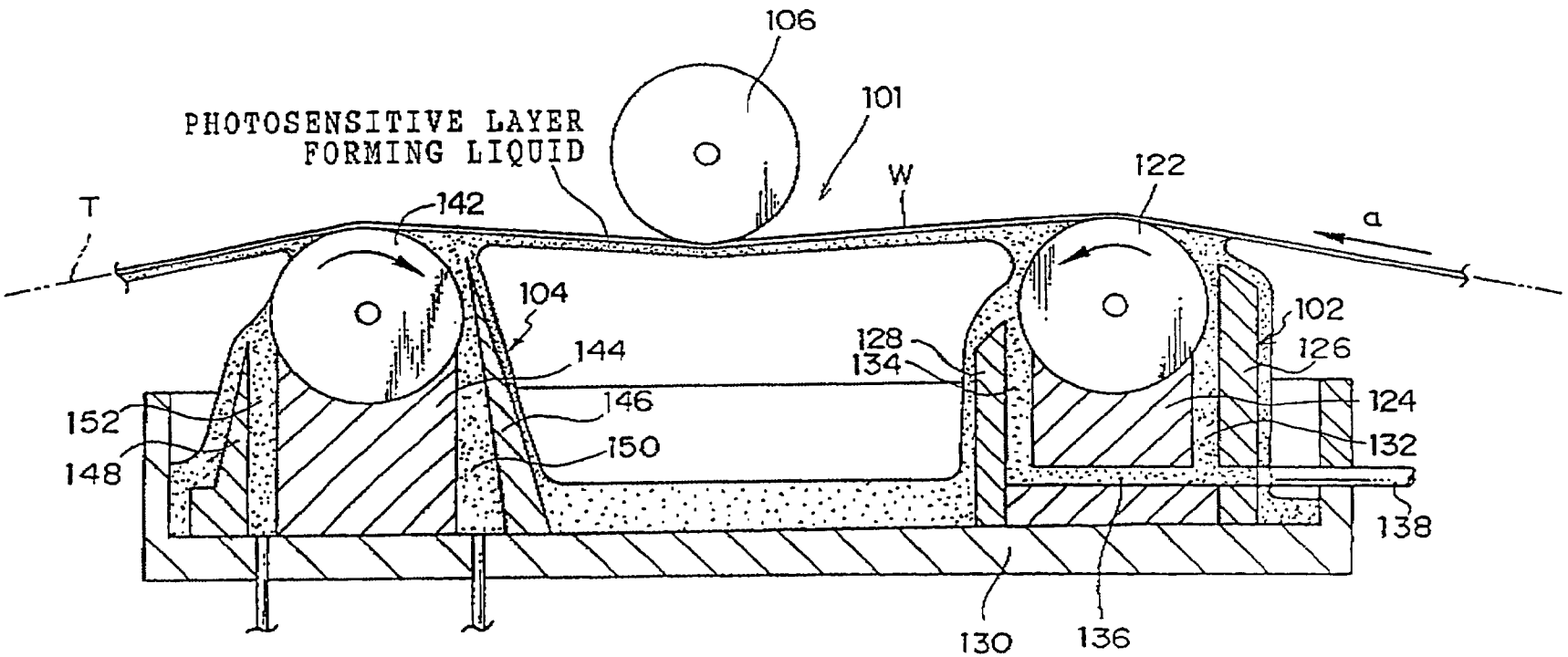
FIG. 1 is a diagram showing the schematic configuration of a coating device

FIG. 1 shows an embodiment of a coating device according to a first embodiment of the present invention for coating a photosensitive layer forming liquid on a support web.

As shown in FIG. 1, the coating device 101 according to the first embodiment comprises a bar coating device 102 having a coating bar 122, and a bar quantifying device 104 having a quantifying bar 142, disposed downstream of the bar coating device 102. The quantifying bar 142 serves also as a second coating bar for adjusting the coating amount of the liquid agent on the coated surface by replenishing the liquid agent coated on the support web by the coating bar 122, or eliminating a part thereof. In this invention, it is referred to also as an adjusting bar or measuring bar. The bar coating device 102 and the bar quantifying device 104 arc both disposed below the running surface T of the support web W.

A pressing roller 106 for pressing the support web W from above toward the coating bar 122 and the quantifying bar 142 at the time of coating the photosensitive layer forming liquid on the support web W, is provided above the running surface T between the bar coating device 102 and the bar quantifying device 104.

In addition to the coating bar 122, the bar coating device 102 comprises a coating bar supporting member 124 for supporting the coating bar 122 from below, an upstream side weir plate 126 disposed upstream of the coating bar supporting member 124, elongated in the vertical direction with respect to the running surface T, and a downstream side weir plate 128 disposed downstream of the coating bar supporting member 124, elongated in the vertical direction with respect to the running surface T.

An upstream side liquid supplying path 132 is formed between the coating bar supporting member 124 and the upstream side weir plate 126 for supplying the photosensitive layer forming liquid upstream side of the coating bar 122, and a downstream side liquid supplying path 134 is formed between the coating bar supporting member 124 and the downstream side weir plate 128 for supplying the photosensitive layer forming liquid downstream side of the coating bar 122. The upstream side liquid supplying path 132 and the downstream side liquid supplying path 134 are communicated below the coating bar supporting member 124 by a communication path 136. The lower end of the upstream side liquid supplying path 132 is connected with a liquid supplying pipe path 138 for supplying the photosensitive layer forming liquid.

In addition to the quantifying bar 142, the bar quantifying device 104 comprises a quantifying bar supporting member 144 for supporting the quantifying bar 142 from below, an upstream side weir plate 146 disposed upstream of the quantifying bar supporting member 144, and elongated obliquely upward toward the quantifying bar 142, and a downstream side weir plate 148 disposed downstream of the quantifying bar supporting member 144, and elongated in the vertical direction toward the running surface T.

An upstream side path 150 is formed between the quantifying bar supporting member 144 and the upstream side weir plate 146 for supplying or discharging the photosensitive layer forming liquid, and a downstream side path 152 is similarly formed between the quantifying bar supporting member 144 and the downstream side weir plate 148 for also supplying or discharging the photosensitive layer forming liquid.

The bar coating device 102 and the bar quantifying device 104 are both placed on a base 130.

It is preferable that the coating bar 122 is rotated with the circumferential surface thereof facing the support web W, and its rotation coincides with the conveyance direction of the support web W (for the invention hereinafter, this may be referred to as the rotation in the same direction or in the forward direction). It may be rotated at the same speed (circumferential speed) to follow the support web W, or a rotation speed to provide a circumferential speed lower than the conveyance speed of the support web W, or a rotation speed to provide a circumferential speed higher than the same. As the coating bar 122, a bar with a groove, a wire bar, or the like may be used. Instead thereof, a smooth bar with the surface formed smoothly may also be used.

The quantifying bar 142 may be rotated with the circumferential surface thereof facing the support web W and moved in the direction opposite to the conveyance direction of the support web W (in the invention hereinafter, this may be referred to as the rotation in the opposite direction or in the backward direction). Moreover, it may be rotated with the circumferential surface moved in the same direction as the conveyance direction. The rotational frequency of the quantifying bar 142 is not particularly limited, but it is preferably 500 rotations per minute or less. As the quantifying bar 142, a bar with a groove, a wire bar, or the like may be used. Instead thereof, a constant amount rod with the surface formed smoothly may also be used as well.

The diameter of the coating bar 122 and the quantifying bar 142 is preferably 3 mm or more, and particularly preferably in a range of 6 to 20 mm.

The operation of the coating device 101 will be explained hereafter.

In the bar coating device 102, the photosensitive layer forming liquid is supplied from the liquid supplying pipe path 138 upstream side of the coating bar 122 through the upstream side liquid supplying path 132. At the same time, the coating liquid is supplied downstream side of the coating bar 122 through the downstream side liquid supplying path 134.

The coating bar 122 coats the photosensitive layer forming liquid on the support web W by taking up the photosensitive layer forming liquid supplied from the upstream side liquid supplying path 132 and clashing the same onto the rear surface of the support web W. The entrained air that accompanies the rear surface of the support web W into the coating device 101 is blocked by the clash of the photosensitive layer forming liquid taken up by the coating bar 122 against the support web W. In contrast, the photosensitive layer forming liquid is coated on the support web W excessively.

The support web W with the photosensitive layer forming liquid coated by the coating bar 122 next passes above the bar quantifying device 104.

As mentioned above, since the quantifying bar 142 is rotated in the direction opposite to the conveyance direction of the support web W, the excessive coating of the photosensitive layer forming liquid by the bar coating device 102 is scraped off by the quantifying bar 142 at the time of passing above the bar quantifying device 104 to adjust the photosensitive layer forming liquid to a predetermined coating thickness.

According to the coating device 101 of the first embodiment, since the entrained air taken in that accompanies the support web W can be blocked by the bar coating device 102, even in the case where the photosensitive layer forming liquid is coated with the support web W running at a high speed, the various kinds of defects mentioned above derived from the entrained air cannot be generated in the coating film, and this enables a stable coating operation.

Furthermore, since conventional bar coaters can be used for the bar coating device 102 and the bar quantifying device 104, the coating device 101 can be provided inexpensively.

Second Embodiment

Figure 2:
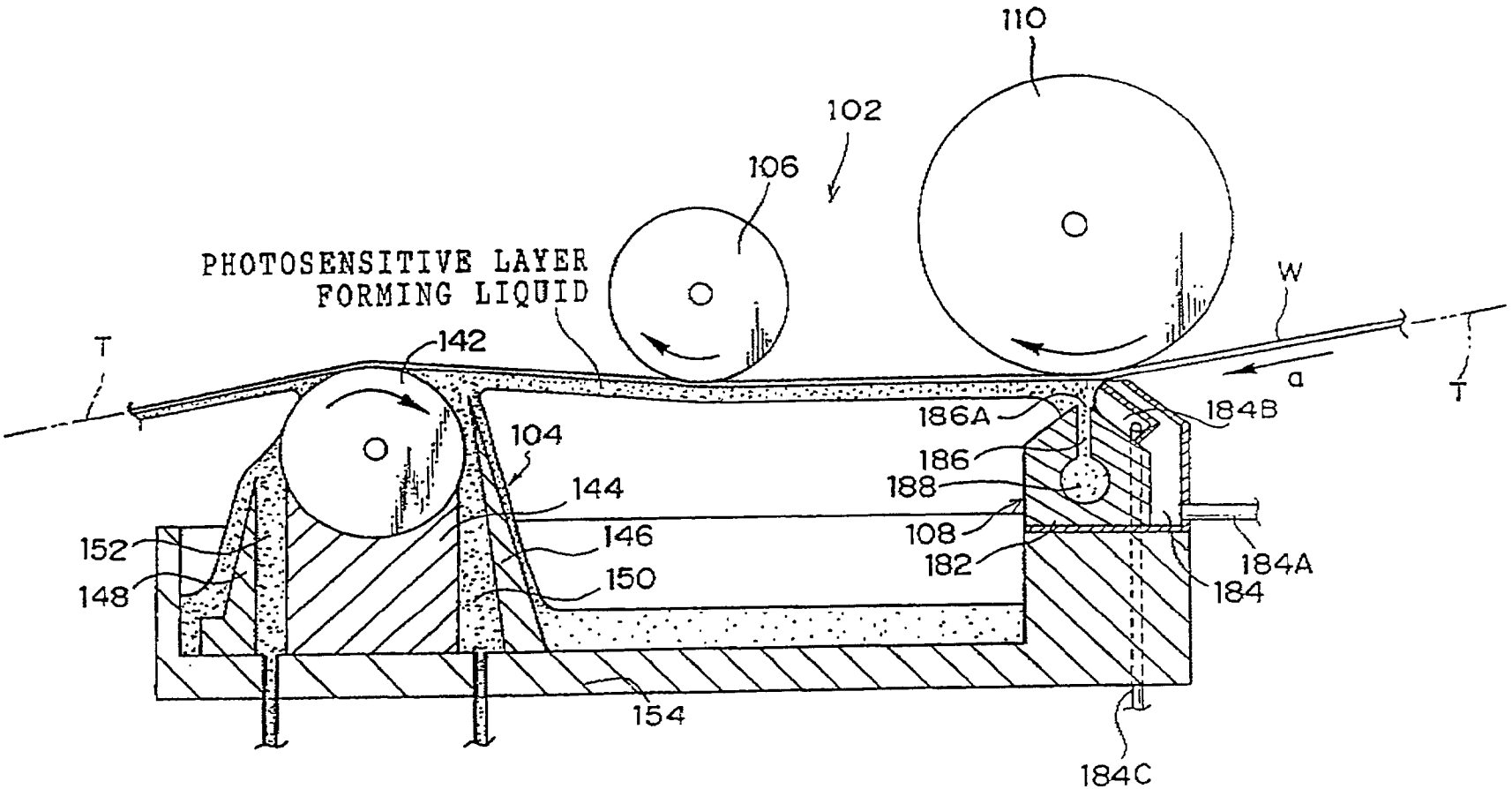
FIG. 2 is a configuration diagram showing the schematic configuration of a coating device according to a second embodiment of the invention using an extrusion coater as an example of a coating means for coating a liquid agent without contact.

FIG. 2 shows an embodiment using an extrusion coater as an example of a non-contact type coating means among the coating devices according to the invention. In FIG. 2, the same numerals as in FIG. 1 refer to the same elements as in FIG. 1.

Similar to the coating device according to the first embodiment, the coating device according to the second embodiment is used for coating a photosensitive layer forming liquid on a support web.

As shown in FIG. 2, the coating device 102 according to the second embodiment comprises an extrusion coater 108, and a bar quantifying device 104 having a quantifying bar 142, disposed downstream of the extrusion coater 108. The extrusion coater 108 and the bar quantifying device 104 are both disposed below the running surface T of the support web W, and are placed on a base 154.

A backup roller 110, around which the supporting web W is partially wound, is provided on the side opposite to the extrusion coater 108 with respect to the running surface T.

A pressing roller 106 for pressing the support web W toward the quantifying bar 142 of the bar quantifying device 104 is provided downstream of the backup roller I 10 above the running surface T.

An cross-sectional view taken along the support web W conveyance direction is shown of the bar quantifying device 104 and the extrusion coater 108 in FIG. 2.

The bar quantifying device 104 has the same configuration as described in the first embodiment.

The extrusion coater 108 comprises a main body 182 disposed along the width direction of the conveyance surface T which represents the support web W conveyance path, and is formed in a wedge-like shape tapered upwards. A pressure reducing chamber 184 is provided adjacently upstream of the main body 182 in the conveyance direction of the support web W. The inside of the pressure reducing member 184 is capable of reducing the pressure.

The main body 182 is provided such that a gap of a predetermined size is formed between the support web W and the top portion of the main body 182 at the time the support web W is conveyed while being partially wrapped around the backup roller 110.

A liquid ejecting path 186 is formed vertically in the inside of the main body 182, and an ejecting opening 186A opened like a slit along the width direction of the conveyance surface T is formed in the top portion. A liquid supplying path 188 for supplying the photosensitive layer forming liquid to the liquid ejecting path 186 is provided along the longitudinal direction of the main body 182 at the lower end of the liquid ejecting path 186 in the main body 182.

The pressure reducing chamber 184 has an opening part opened toward the conveyance surface T, with the bottom part connected with one end of a pressure reducing pipe 184A for reducing the pressure in the pressure reducing chamber 184. The other end of the pressure reducing pipe 184A is connected with a vacuum pump or an aspirator (not shown).

In the vicinity of the opening part in the pressure reducing chamber 184, a trough-like excessive liquid receptacle 184B for receiving excessive photosensitive layer forming liquid not coated on the support web W, which is ejected from the liquid ejecting path 186 is provided adjacent to the main body 182; and a liquid ejecting pipe 184C that elongates downward is provided for guiding the photosensitive layer forming liquid received by the excessive liquid receptacle 184B to the outside.

In the case where the photosensitive layer forming liquid is supplied to the liquid supplying path 188 of the extrusion coater 108, the photosensitive layer forming liquid is ejected from the liquid ejecting opening 186A via the liquid ejecting path 186 toward the sand-blasted surface of the support web W, so as to provide the cross-link of the photosensitive layer forming liquid with respect to the support web W: namely, the coating liquid cross-link. After formation of the coating liquid cross-link, the photosensitive layer forming liquid is adhered on the surface of the support web W while the entrained air film is eliminated. Thereby, the photosensitive layer forming liquid can be coated on.

The support web W coated with the photosensitive layer forming liquid by the extrusion coater 108 next passes above the bar quantifying device 104.

As mentioned above, since the quantifying bar 142 is rotated in the direction opposite to the conveyance direction a of the support web W, the photosensitive layer forming liquid coated on the support web W excessively by the bar coating device is scraped off by the quantifying bar 142 at the time the support web W passes above the bar quantifying device 104, so as to adjust the photosensitive layer forming liquid into a predetermined coating thickness.

According to the coating dice 102 of the second embodiment, the photosensitive layer forming liquid is coated on the support web W by the extrusion coater 108 without the extrusion coater 108 contacting the support web W, and so the surface of the support web W cannot be damaged.

Therefore, the coating device 102 has the same features as those of the coating device 101 of the first embodiment. Furthermore, it can be used particularly preferably in the case of coating the photosensitive layer forming liquid or the heat sensitive layer forming liquid after applying a base treatment by coating and drying a base treatment liquid on the roughened surface of the support web W; and also in the case of forming a heat sensitive layer on the roughened surface of the support web W, and in the case of forming a photo-thermal conversion layer by coating a photo-thermal conversion layer containing a photo-thermal convertible compound thereon.

EXAMPLES I

Examples 11–14 and Comparative Examples 11–14

A support web W was obtained by sand-blasting one side of a surface of an aluminum web according to an conventional method, and processing the sand-blasted surface by anode oxidization.

A photosensitive layer forming liquid was coated on the support web W using the coating device 101 shown in FIG. 1.

The coating conditions of the photosensitive layer coating liquid were as follows.

| | |
|---|---|
| a. Support web W thickness: | 0.3 mm |
| b. Conveyance speed of the support web W: | 150 m/minute |
| c. Coating amount by the bar coating device 102: | 50 cc/m$^2$ |
| d. Measurement amount by the bar quantifying device 104: | 15 cc/m$^2$ |
| e. Diameter of the coating bar 22: | 10 mm |
| f. Diameter of the measuring bar 42: | 10 mm |
| g. Bar rotational frequency: | as shown in Table 1 |
| h. Viscosity of the photosensitive layer forming liquid: | 30 mPa · s |

Results are shown in Table 1.

TABLE 1

| | Bar Rotation Speed (rpm) | | Coated Surface | |
|---|---|---|---|---|
| | Coating Bar | Measuring Bar | Quality | Remarks |
| Example 11 | +4770 (without drive) | −500 | ○ | |
| Example 12 | +300 (with drive) | +500 | ○ | |
| Example 13 | +4770 (without drive) | −500 or less | Δ | |
| Example 14 | −300 (with drive) | +500 or more | Δ | |
| Comparative Example 11 | +4770 (without drive) | without measuring bar | X | Generation of equal pitch streaks, liquid splash of the photosensitive layer forming liquid |
| Comparative Example 12 | without coating bar | −500 (with drive) | X | Bead instability due to the entrained air layer |
| Comparative example 13 | without coating bar | +500 (with drive) | X | Bead instability due to the entrained air layer |
| Comparative example 14 | +500 (with drive) | without measuring bar | X | Bead instability due to the entrained air layer |

In Table 1, "+" denotes the rotation of the bar in the same direction as the conveyance direction of the support web W, and "−" denotes the rotation of the bar in the direction opposite to the conveyance direction of the support web W.

From the results shown in Table 1, it was learned that a good coated surface quality could be obtained by providing the bar quantifying device 104 downstream of the bar coating device 102 without the generation of coating failures in the coated surface, even in the case where the conveyance speed of the support web W was as high as 150 m/minute.

In contrast, in the cases where the measuring bar 42 was not provided, and only the coating bar 122 was used as in comparative examples 11 and 14, although the coating operation could be performed without coating film cuts when the coating bar 122 was not driven, that is, it followed the support web W (comparative example 11), pitch streaks were generated in the entire width; and when the coating bar 122 was driven (comparative example 14), the bead was not stable due to the entrained air layer so that coating film cuts and coating irregularities were partially generated and the coating operation was not performed in a stable manner.

In contrast, in the cases where the coating bar 122 was not used in the comparative examples 12 and 13, and only the quantifying bar 142 was used, the bead was not stable due to the entrained air layer.

From the results, it was learned that both the coating bar 122 and the measuring bar 42 are necessary.

According to the above-mentioned embodiments of the invention, a coating device and a coating method capable of performing a stable coating operation can be provided without the generation of various kinds of defects in the coating film, even in the case where the coating operation is carried out with the substrate running at a high speed.

Third Embodiment

Figure 3A:
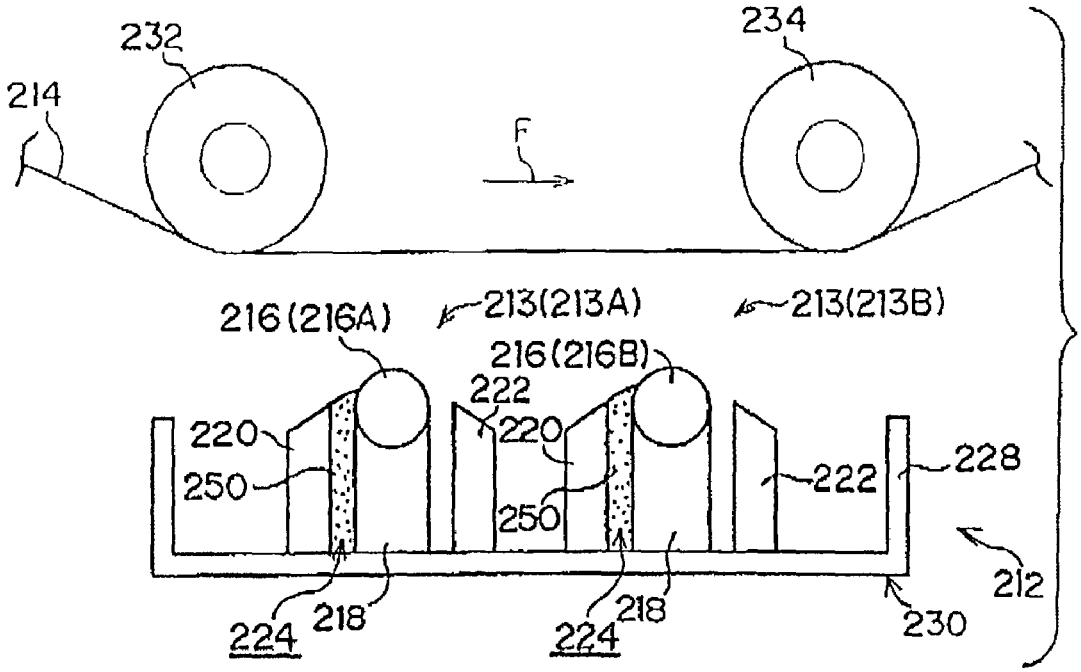
FIG. 3A and FIG. 3B are front views showing the schematic configuration of a bar coating device according to a third embodiment of the invention.
Figure 3B:
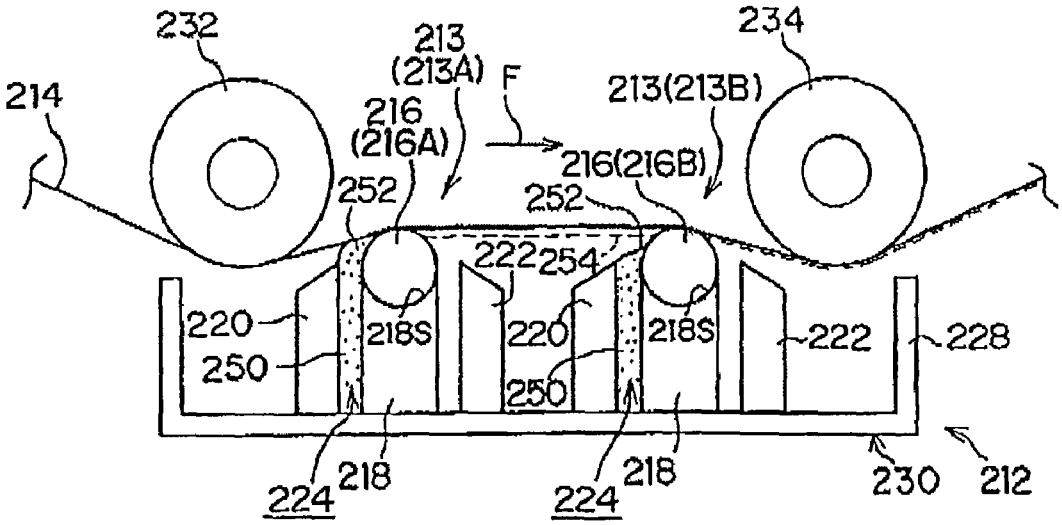
Figure 4:
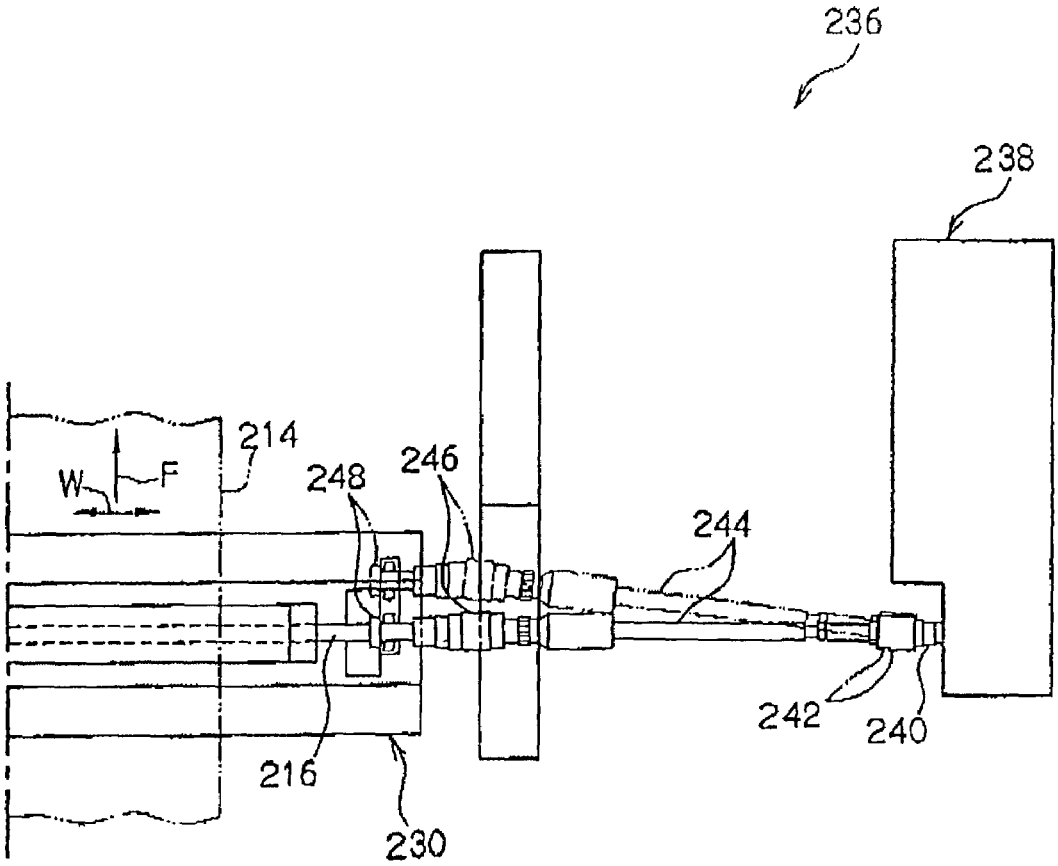
FIG. 4 is a plan view showing a rotation driving mechanism for the bar coating device according to the third embodiment of the invention.
Figure 5:
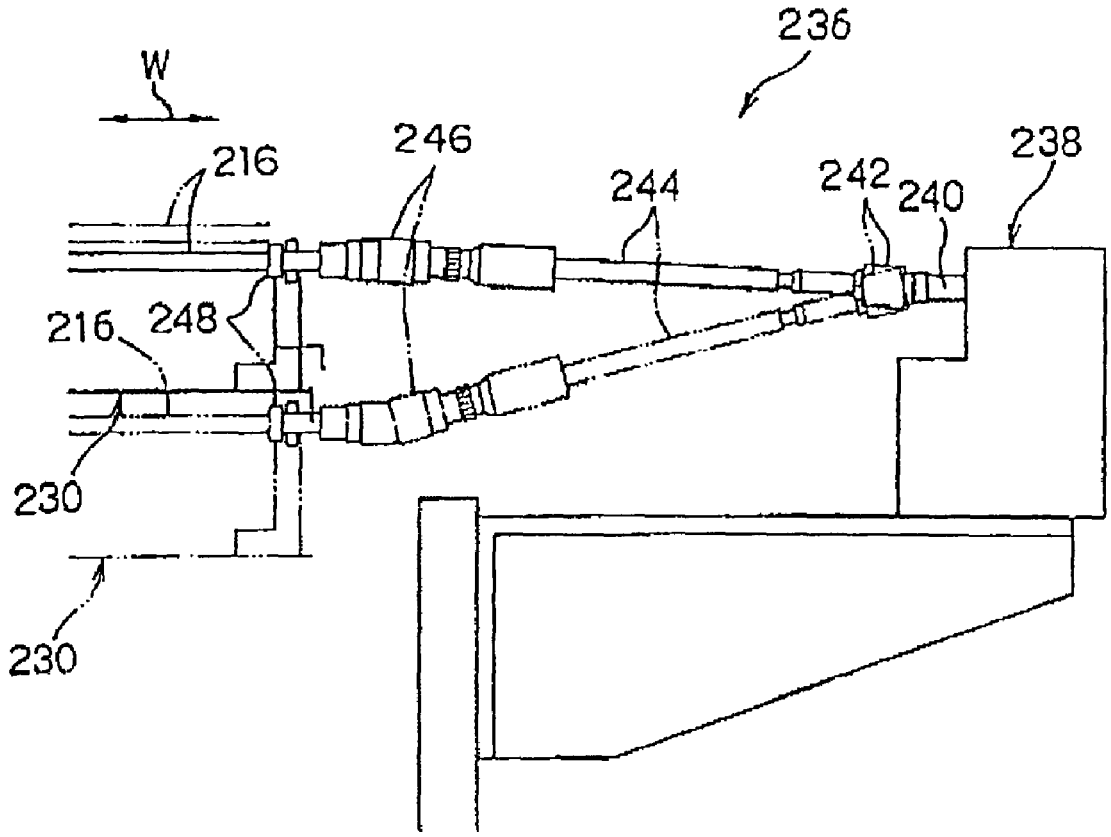
FIG. 5 is a side view showing the rotation driving mechanism for the bar coating device according to the third embodiment of the invention.

FIG. 3A and FIG. 3B show a bar coating device 212 according to a third embodiment of the invention. The bar coating device 212 is assembled in a production line for planographic printing plate precursors, so as to be used for coating a coating liquid 250 (photosensitive liquid, or the like) on an aluminum web 214 as the substrate for a planographic printing plate precursor. The aluminum web 214 is conveyed in the longitudinal direction thereof at a predetermined conveyance speed by a conveyance device that is not illustrated. Hereinafter, the "conveyance direction" refers to the conveyance direction of the aluminum web 214, which is shown by the arrow F in the figure (FIGS. 3A, 3B, 4 and 5). Moreover, the "width direction" refers to the width direction of the aluminum web 214, which is shown by the arrow W in the figure (FIGS. 4 and 5).

The bar coating device 212 comprises coating units 213 having substantially the same configuration, with the coating units 213 disposed at a predetermined interval from each other in the conveyance direction. As will be described later, the coating unit 213A that is upstream in the conveyance direction coats the coating liquid 250 on the aluminum web 214 (preliminary-coating). In contrast, the coating unit 213B that is downstream in the conveyance direction coats the coating liquid 250 on the aluminum web 214, or removes a part of the coating liquid 250 to adjust the coating amount (measurement).

Each coating unit 213 comprises a coating bar 216 disposed so as to contact the aluminum web 214 from below. The coating bar 216 that is upstream in the conveyance direction serves as the preliminary-coating bar 216A, and the coating bar 216 that is downstream in the conveyance direction serves as the adjusting (measuring) bar 216B. The coating bars 216 are formed in a substantially columnar (or substantially cylindrical) shape, and are supported by a bearing members 218 with the longitudinal direction of the coating bar 216 thereof coinciding with the aluminum web 214 width direction.

The upper surfaces of the bearing members 218 are the supporting surfaces 218S formed in an arc-like shape along the outer circumferential surface of the coating bars 216. The coating bars 216 are supported rotatably in contact with the supporting surfaces 218S.

Weir plates 220, 222 are respectively disposed on the upstream side and downstream of the bearing members 218. A predetermined gap is provided between each weir plate 220, 222 and the bearing members 218. In particular, the gap between the upstream weir plate 220 and the bearing member 218 in each coating unit 213 serves as a coating liquid supply path 224. In the upstream side coating unit 213A, the coating liquid 250 provided from a coating liquid supplying device that is not illustrated passes through the coating liquid supply path 224 so that the coating liquid 250 is taken up in successive continuity by rotation of the coating bars 216A and transferred onto the aluminum web 214. Moreover, a bead 252 for the coating liquid 250 is formed between the aluminum web 214, the weir plate 220, and the coating bar 216A, upstream of where the aluminum web 214 contacts the coating bar 216A. Similarly, downstream of the coating unit 213B, the coating liquid 250 is transferred onto the aluminum web 214 and a part of the coating liquid 250 is removed from the aluminum web 214 (substantially a portion of the coating liquid 250 adhered on the aluminum web 214 is replaced).

The two coating units 213 are integrally held by a holder 228 so as to provide a coater 230 as a whole. Moreover, the support rolls 232 and 234 are respectively disposed on the upstream side and downstream side of the coater 230 so as to be in contact with the aluminum web 214 from an above position, and an opposite one to the coater 230. By pressing the aluminum web 214 by the support rolls 232 and 234 from above, the aluminum web 214 can be contacted with the coating bars 216 as a predetermined tension is applied thereon.

Then, by driving an elevating device that is not illustrated, the two coating units 213 (the bearing member 218 and the weir plates 220, 222) of which the coater 230 is comprised can be elevated integrally. As shown in FIG. 3A, since the coating bars 216 do not contact the aluminum web 214 when the integral coater 230 is not elevated and is in a lowered position, they do not coat the coating liquid 250. By elevating the coater 230 as shown in FIG. 3B, the coating bars 216 can be contacted with the aluminum web 214 so as to enable the coating of the coating liquid 250. Moreover, by slightly moving the coater 230 up and down while maintaining contact, desired contact pressure and wrap angle can be provided so that the coating operation can be performed according to the kind of the aluminum web 214 and the coating liquid 250 used.

According to the bar coating device 212 of the third embodiment, the interval between the coating bar 216A and the adjusting (measuring) bar 216B (that is, the interval between the upstream side coating unit 213A and the downstream side coating unit 213B) is set in consideration of the conveyance speed of the aluminum web 214 such that the time from contact of the aluminum web 214 with the preliminary-coating bar 216A to the contact with the adjusting (measuring) bar 216B (the conveyance time in the invention) is 0.25 seconds or less.

FIG. 4 and FIG. 5 show the schematic configuration of a rotation driving device 236 for rotating the coating bars 216.

The rotation driving device 236 comprises a motor and a speed reducing device, or the like, and has a driving source 238 for generating a rotation driving force by a predetermined torque and angular speed. The output shaft 240 of the driving source 238 is interlocked with a shaft 244 via a first universal wrist unit 242. Furthermore, the shaft 244 is interlocked with a changeover member 248 via a second universal wrist unit 246. The changeover member 248 can be moved between a transmitting position where the changeover member 248 is interlocked with the coating bar 216, and is capable of transmitting the rotation driving force (the position shown by the solid line in FIG. 4); and a non-transmitting position where the interlocking with the coating bar 216 is released so that there is no transmission of the rotation driving force (the position shown by the double dotted chain line in FIG. 4).

Moreover, since the driving source 238 and the coating bar 216 are interlocked via the two universal wrist units 246, the rotation driving force of the driving source 238 can be transmitted to the coating bar 216 while constantly maintaining the angle of the coating bar 216 with respect to the output shaft 240 of the driving source 238 (parallel in the third embodiment). For example, even in the case where the coater 230 is moved up and down slightly, or when the coating bar 216 is separated from the aluminum web 214 by lowering the coater 230 as shown by the double dotted chain line in FIG. 5, the output shaft 240 of the driving source 238 and the coating bar 216 are parallel, so that the coating bar 216 can be rotated by receiving the rotation driving force of the driving source 238.

For the bar coating device 212 of the third embodiment, the coating bar 216 can be rotated actively by the rotation driving force from the driving source 238 so as to have the circumferential speed of the coating bar 216, and a circumferential speed different from the circumferential speed corresponding to the conveyance speed of the aluminum web 214 (includes both same and opposite directions).

Next, the method for coating the coating liquid 250 on the aluminum web 214 by the bar coating device 212 of the third embodiment, and the operation of the bar coating device 212 will be explained.

At the time of coating the coating liquid 250 on the aluminum web 214, the aluminum web 214 is conveyed at a constant conveyance speed by a conveyance device that is not illustrated.

Moreover, with the coater 230 elevated as shown in FIG. 3B, so that the preliminary-coating bar 216A and the adjusting (measuring) bar 216B are both in contact with the aluminum web 214, the coating liquid 250 is supplied from a coating liquid supplying device that is not illustrated.

At this time, the coating liquid 250 taken up by the preliminary-coating bar 216A is transferred to the aluminum web 214 so that a preliminary-coated layer 254 is provided on the aluminum web 214. Thereby, generation of the so-called entrained air can be reduced (preferably prevented) in the aluminum web 214.

Next, the coating liquid composing the preliminary-coated layer 254 is adjusted (measured) by the adjusting (measuring) bar 216B to correspond with the conveyance of the aluminum web 214. That is, the coating liquid on the aluminum web 214 can be adjusted (measured) to be made entirely uniform by eliminating excess, or adding to cover shortages so as to provide a coating film of the desired coated amount. Accordingly, by carrying out the coating steps two times, that is, by sufficiently coating (preliminary-coating) and then adjusting (measuring), using the two coating bars 216 (preliminary-coating bar 216A and the adjusting (measuring) bar 216B), an evenly coated surface can be obtained over the entire area in the width direction of the aluminum web 214, with reduction (preferably preventing) in the generation of entrained air.

In particular, for the bar coating device 212 of the third embodiment, the conveyance time from the time the aluminum web 214 contacts the preliminary-coating bar 216A to the time the aluminum web 214 contacts the adjusting (measuring) bar 216B is set to be 0.25 seconds or less. In the case where the conveyance time is longer than 0.25 seconds, particularly in the case of an aluminum web 214 with a coarse surface roughness, there is a risk of re-generation or building up of entrained air in the preliminary-coated layer 254 from the coating (preliminary-coating) by the preliminary-coating bar 216A until reaching the adjusting (measuring) bar 216B. However, according to the third embodiment, since the re-generation or the building up of the entrained air can be prevented, even in the case of an aluminum web 214 with a coarse surface roughness, an evenly coated surface can be obtained.

Moreover, for the bar coating device 212 of the third embodiment, the rotation driving force of the driving source 238 can be transmitted to the coating bar 216 by moving the changeover member 248 to the transmitting position at the time of coating as shown by the solid line 249 44 in FIG. 4. Thereby, the coating bar 216 is rotated actively at a circumferential speed different from the circumferential speed that corresponds to the conveyance speed of the aluminum web 214.

Figure 6:
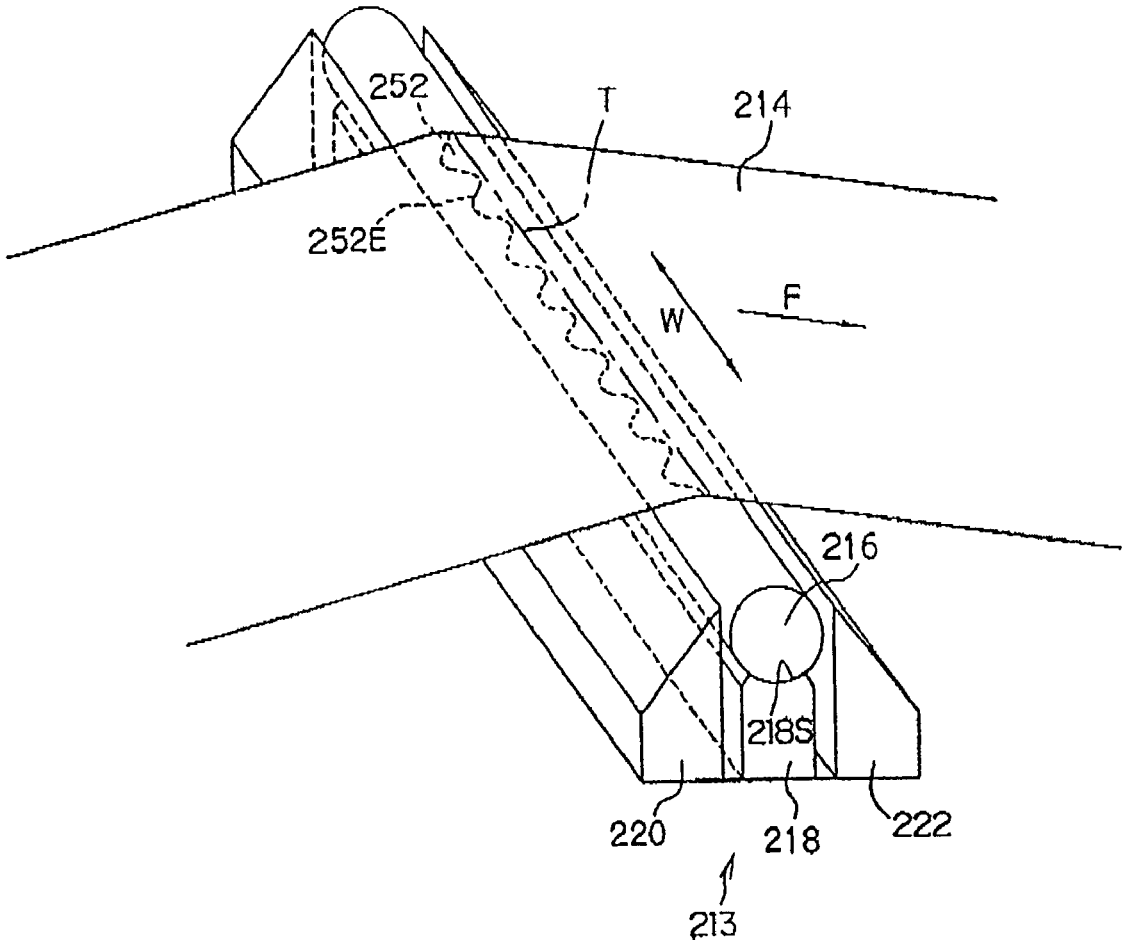
FIG. 6 is a perspective view for illustrating the operation of by the coating bar of the bar coating device according to the third embodiment of the invention.

As shown in FIG. 6, in the bead 252 formed between the aluminum web 214, the weir plate 220, and the coating bar 216, a good coated surface quality can generally be provided in the case where the rim part 252E of the bead 252 has a cyclic curve in the width direction when it is viewed from the contact part T of the aluminum web 214 and the coating bar 216 (shown by the single dash chain line in FIG. 6). In particular, in the case where the rim part 252E has the shape of a sine curve or a shape close to this, the coated surface quality can be further improved.

In the third embodiment, by providing the circumferential speed of the coating bar 216 as different from the circumferential speed which corresponds to the conveyance speed of the aluminum web 214 as mentioned above, the shape of the rim part 252E of the bead 252 can be provided as a shape close to a sine curve, so that the bead 252 can thereby be maintained in a stable manner. Therefore, coating streaks (due to disturbance of the bead), or the like, are not generated in the coated coating liquid 250, so that an evenly coated surface can be obtained.

In particular, even in the case where a highly viscous coating liquid 250 is used or where the conveyance speed of the aluminum web 214 is increased, made, since the bead 252 can be maintained in a stable manner by providing the shape of the rim part 252E of the bead 252 as a shape close to a sine curve, the coated surface quality can be made even. In view of this, the rotation speed of the coating bar 216 is preferably a circumferential speed different from the circumferential speed which corresponds to the conveyance speed of the aluminum web 214 (includes both forward and the backward rotation).

Of course, depending on conditions that include the conveyance speed of the aluminum web 214 and the viscosity of the coating liquid 250, in some cases it is better to rotate (drive) the coating bar 216 by friction with the aluminum web 214 as in the conventional techniques. In this case, by only moving the changeover member 248 to the non-transmitting position as shown by the double dotted chain line in FIG. 5, transmission of the rotation driving force of the driving source 238 to the coating bar 216 can easily be stopped.

Moreover, the coating bar 216 to be rotated by a circumferential speed different from the circumferential speed which corresponds to the conveyance speed of the aluminum web 214, may either be one or both of the preliminary-coating bar 216A and the adjusting (measuring) bar 216B. This can be determined according to conditions that include the conveyance speed of the aluminum web 214 and the viscosity of the coating liquid 250.

As the coating bar 216 of the invention, a bar with a flat circumferential surface, a wire bar with wires closely adhered and wound around in the circumferential direction of the circumferential surface with a groove formed between the adjacent wires, and furthermore, a grooved bar with a groove engraved in the entire length of the width of the bar or in a needed areas in the circumferential direction of the bar circumferential surface, or the like can be used. In view of the bar rolling accuracy (straightness, roundness), the rotation moment, the weight balance, or the like, the outer diameter of the coating bar 216 is preferably in a range of 1 to 30 mm, more preferably in a range of 3 to 25 mm, and particularly preferably in a range of 6 to 15 mm. Metal is preferable as the material for the coating bar 216 for its aspects of corrosion resistance and strength, and a stainless steel is particularly suitable.

In the case where the wire bar is used, an appropriate wire diameter is 0.07 to 1.0 mm, preferably 0.07 to 0.6 mm. A metal is to be used as the material for the wire, and from the aspect of corrosion resistance, wear resistance, and strength, or the like, a stainless steel is most suitable. In order to further improve the wear resistance for the wire bar, plating may be applied on the surface. In particular, hard chromium plating is suitable. In the case where the wire bar is used, the amount coated by each coating unit 213A and 213B can be adjusted depending on the wire size (diameter).

Moreover, in the case where the grooved bar is used in the invention, the groove pitch is to be 0.05 to 1.0 mm, preferably 0.1 to 0.6 mm. As to the cross-sectional shape, one close to a sine curve or a trapezoidal shape is suitable. However, the invention is not limited to these cross-sectional shapes, and those with other cross-sectional shapes can be used as well. In order to further improve wear resistance for the engraved bar also, plating can be applied on the surface. In particular, hard chromium plating is suitable. In the case where the grooved bar is used, the amount coated by each coating unit 213A and 213B can be adjusted depending on the groove size (width and depth).

For any of the configurations adopted for the coating bar 216, the coating amount on the aluminum web 214 after it passes the downstream coating unit 213B is the coating amount necessary for obtaining a desired final product quality for the planographic printing plate precursor. Therefore, the coating amount by the coating bar 216 (adjusting (measuring) bar) of the downstream coating unit 213B is in general to be 3 to 100 ml/m$^2$ in most cases.

The wrap angle of the aluminum web 214 (object to be coated) with respect to each coating bar 216 is not particularly limited as long as the coating liquid can with certainty be coated on (preliminary-coating or adjustment (measurement)) the aluminum web 214, but it is preferably in a range of 1 to 30°, and more preferably in a range of 2 to 20°. The wrap angle can be set at a desired value by adjusting the vertical position (elevation amount) of the coater 230.

The bearing member 218 is not limited as long as it can with certainty support the coating bar 216. However, in the case where a high speed rotation of the coating bar 216 is considered, a bearing member 218 with a low friction coefficient with respect to the coating bar 216 (wire in the case of a wire bar) is preferable for the smooth rotation of the coating bar 216. Furthermore, a bearing member 218 with a high wear resistance is preferable. As a material capable of satisfying the conditions, a fluorine resin, a polyacetal resin, a polyethylene resin, or the like can be presented. Among these examples, a polytetrafluoroethylene known as Teflon (R) (product name of DuPont Corp., USA), and a polyacetal resin known as Derlin (product name of DuPont Corp., USA), are particularly preferable in terms of the friction coefficient and strength (wear resistance). Furthermore, those materials obtained by adding a filler such as a glass fiber, a graphite and a molybdenum disulfide to these plastic materials can be used as well. Furthermore, after production of the bearing member 218 using a metal material, the friction coefficient with respect to the coating bar 2 16 can be made smaller by coating or attaching the above-mentioned plastic materials on the surface thereof. Various kinds of metal materials impregnated with the above-mentioned plastic materials (such as an aluminum impregnated with a polytetrafluoroethylene) can also be used for the bearing member 218.

Moreover, a metal such as an aluminum (the above-mentioned aluminum web 214), a paper, a plastic film, a resin coating film, a synthetic paper, or the like can be used as the object (support) to be coated for coating the coating liquid 250 thereon by the bar coating device 212. In the case where an aluminum plate is used as the support for the planographic printing plate precursor, aluminum materials JIS1050, JIS1100 and JIS 1070 specified in the Japanese Industrial Standards (JIS), an Al—Mg based alloy, an Al—Mn based alloy, an Al—Mn—Mg based alloy, an Al—Zr based alloy, an Al—Mg—Si based alloy, or the like can, for example, be used, In this case, generally the mechanical roughing process, the chemical etching process, the electrolysis roughing process, the anode oxidization process, or the like are performed alone or in combination. As the material for the case in which the plastic film is used, polyolefins such as a polyethylene and a polypropylene, vinyl polymers such as a polyvinyl acetate and a polystyrene, polyamides such as a 6,6-nylon and a 6-nylon, polyesters such as a polyethylene terephthalate and a polyethylene-2,6-naphthalate, cellulose acetates such as a polycarbonate, a cellulose triacetate and a cellulose diacetate, or the like can be used. Moreover, as the resin used for the resin coating paper, polyolefins including a polyethylene can be presented as the representative example. However, it is not limited thereto.

The thickness of the aluminum web 214 is not particularly limited, however, those aluminum web 214 with about a 0.01 mm to 1.0 mm thickness are advantageous in terms of handling and general usability.

The surface roughness of the object to be coated is not particularly limited, however, in the case where the surface roughness is coarse, particularly when the bead 50 is instable, in most cases it is difficult to obtain an evenly coated surface. For example, in the case where the arithmetic average coarseness Ra of the object to be coated is 0.20 μm or more, a more evenly coated surface can be obtained by coating the coating liquid 250 with the bar coating device 212 of the third embodiment.

Furthermore, the coating liquid 250 is not limited to the above-mentioned photosensitive liquids. For example, an aqueous solution or an organic solvent solution of a polymer compound, a pigment dispersion liquid, a colloid solution, or the like can be used as well. A photosensitive liquid capable of forming the following photosensitive layers (1) to (11) can be presented as the coating liquid 250 for forming a photosensitive layer of a planographic printing plate precursor.

(1) A photosensitive layer containing an infrared ray absorbing agent, a compound to generate an acid by heat, and a compound to be cross-linked by an acid.

(2) A photosensitive layer containing an infrared ray absorbing agent and a compound to be alkaline-soluble by heat.

(3) A photosensitive layer comprising two layers: a layer containing a compound to generate a radical by laser beam irradiation, an alkaline-soluble binder, and a polyfunctional monomer or prepolymer, and an oxygen blocking layer.

(4) A photosensitive layer comprising two layers: a physical development center layer, and a silver halide emulsion layer.

(5) A photosensitive layer comprising three layers: a polymer layer containing a polyfunctional monomer and a polyfunctional binder, a layer containing a silver halide and a reducing agent, and an oxygen blocking layer.

(6) A photosensitive layer comprising two layers: a layer containing a novolak resin and a naphthoquinone diazide, and a layer containing a silver halide.

(7) A photosensitive layer containing an organic photoconductor.

(8) A photosensitive layer comprising two to three layers: a laser light absorbing layer to be eliminated by laser beam irradiation, a lipophilic layer and/or a hydrophilic layer.

(9) A photosensitive layer containing a compound to generate an acid by absorbing energy, a polymer compound having a functional group for generating a sulfonic acid or a carboxylic acid by an acid in a side chain, and a compound to provide energy to an acid generating agent by absorbing visible light.

(10) A photosensitive layer containing a quinine diazide compound and a novolak resin.

(11) A photosensitive layer containing a compound to form a cross-linking structure by itself or with another molecule in the layer, even in the case where it is decomposed by a light or an ultraviolet ray; and containing an alkaline-soluble binder.

Moreover, among the coating liquids, although entrained air can easily be generated in those coating liquid that contain an organic solvent, by coating the coating liquid on the aluminum web 214 by the bar coating device 212 according to the third embodiment, generation of the entrained air can be further prevented with certainty.

The viscosity of the coating liquid 250 is not particularly limited, but it is preferably 100 mPa·s or less, and more preferably 50 mPa·s or less.

The temperature in the vicinity of the bar coating device 212 (in particular, the temperature in the area from the preliminary-coating bar 216A to the adjusting (measuring) bar 216B) is not particularly limited, but in the case where the temperature in the area exceeds 30° C., the risk of re-generation or a building up of the entrained air in the preliminary-coated layer 254 increases. Therefore, it is preferable to have the temperature in the area from the preliminary-coating bar 216A to the adjusting (measuring) bar 216B at 30° C. or lower.

Although the bar coating device 212 for coating the photosensitive liquid on the aluminum web 214 (supporting member) in the production line for producing the planographic printing plate precursor has been described in the above-mentioned explanation, the bar coating device 212 of the invention is not limited thereto.

Hereinafter, the third embodiment of the invention will be further explained in reference to an example, but it is not limited thereto.

EXAMPLES II

In this example, the coating liquid 250 was coated on the aluminum web 214 using the bar coating device 212 of the invention.

First, the mechanical roughing process, the chemical etching process, the electrolysis roughing process and the anode oxidization process were performed on the surface of a band-shaped aluminum plate so as to obtain a substrate (aluminum web 214) with a 0.20 μm arithmetic average coarseness Ra and a substrate (aluminum web 214) with a 0.26 μm arithmetic average coarseness. The aluminum webs 214 were coated with the coating liquid 250 by the bar coating device 212 and the coated surface quality was evaluated and the state of the coated surface was observed.

The coating conditions were set as follows.

| | |
|---|---|
| a. Aluminum web width: | 500 mm |
| b. Aluminum web thickness: | 0.3 mm |
| c. Conveyance speed: | 150 m/min |
| d. Coating amount | |
| Preliminary-coating bar: | 0.05 liter/$m^2$ |
| Adjusting (measuring) bar: | 0.015 liter/$m^2$ |
| e. Coating bar diameter: | 10 mm (both of the two) |
| f. Coating bar rotational frequency | |
| Preliminary-coating bar: | same speed and in the same direction as the aluminum web (driven rotation) |
| Adjusting (measuring) bar: | −50/min (backward rotation) |
| g. Viscosity of the coating liquid: | 20 mPa · s |

In general, the conveyance speed of the aluminum web 214 in the planographic printing plate precursor production process is set to be 50 m/min or less in most cases. Therefore, the above-mentioned conveyance speed (150 m/min) is a relatively high speed as the conveyance speed of the aluminum web 214 in the planographic printing plate precursor production process.

In the above-mentioned conditions, the coating liquid was coated on the aluminum web 214 so as to obtain a planographic printing plate precursor with various interval settings between the upstream coating unit 213A and the downstream coating unit 213B, and changes in the time from the contact of the aluminum web 214 with the preliminary-coating bar 216A to the contact with the adjusting (measuring) bar 216B (the conveyance time in the invention).

Evaluation and the observation results are shown in Table 2. Since a significant difference was not observed between the results of the aluminum webs 214 with a 0.20 μm arithmetic average coarseness and with a 0.26 μm arithmetic average coarseness, table 2 only shows the case of the aluminum web 214 with a 0.26 μm arithmetic average coarseness when coated.

TABLE 2

| | Conveyance Time | Coated Surface Quality Evaluation | Observation Result |
|---|---|---|---|
| Example 21 | 0.16 second | ○ | Evenly coated surface obtained |
| Example 22 | 0.20 second | ○ | Evenly coated surface obtained |
| Example 23 | 0.25 second | Δ | Without formation of the coating film in a part of the end part |
| Comparative Example | 0.28 second | X | Without formation of the coating film |

In the evaluation in Table, "○" represents a good result without the generation of a problem or defect; "Δ" represents a result that is slightly poorer than "○", but not to an extent that would cause a problem or trouble in practical use, depending on the kind of the planographic printing plate precursor, the application, or the like, and so "Δ" represents a result that is sufficient for practical use in this regard; and"X" represents the risk of the generation of a problem or trouble.

As is apparent from Table, in the case where the conveyance time was 0.20 seconds or less (examples 21 and 22), a good coated surface quality was provided. Moreover, in the case of a 0.25 second conveyance time (example 23), although the coated surface quality was poorer than the examples 21 and 22, the result was not to an extent that would cause a problem, depending on the kind of the planographic printing plate precursor or the application.

In contrast, in the case of a 0.28 second conveyance time (comparative example), the coating film was not formed and an evenly coated surface quality was not obtained.

In the above-mentioned embodiments of the invention, an evenly coated surface can be obtained, particularly even when the conveyance speed is increased for an object to be coated with a coarse surface roughness.

Once more, with reference to FIGS. 3A and 3B, the explanation of the third embodiment will be continued.

In the bar coating device 212 of the third embodiment, the coating amounts W1, W2 are set such that the relationship of $0.8 \leqq W1/W2 \leqq 4.0$ (1) is satisfied where the coating amount of the coating liquid 250 is W1 after the support web (aluminum web 214) passes upstream in the conveyance direction coating unit 213A, and the coating amount of the coating liquid 250 is W2 after the support web (aluminum web 214) passes downstream in the conveyance direction coating unit 213B.

In particular, according to the bar coating device 212 of the third embodiment, as shown in the above-mentioned formula (1), the ratio (coating amount ratio) W1/W2 of the coating amount W1 of the coating liquid 250 after the support web (aluminum web 214) passes upstream in the conveyance direction coating unit 213A with respect to the coating amount W2 of the coating liquid 250 after the support web (aluminum web 214) passes downstream in the conveyance direction coating unit 213B is set at 0.8 or more and 4.0 or less. In the case where the coating amount ratio is less than 0.8, since the amount coated at the upstream coating unit 213A is relatively small, particularly when the aluminum web 214 is conveyed at a high speed, the entrained air on the aluminum web 214 cannot be eliminated with certainty, so that so-called liquid exhaustion (local shortage of the coating amount of the coating liquid 250) is generated, and thus an evenly coated film is not easily formed even after the aluminum web 214 passes the downstream coating unit 213B. In contrast, in the case where the coating amount ratio is more than 4.0, since the amount coated at the upstream coating unit 213A is relatively large, the preliminary-coated layer 254 on the aluminum web 214 is unstable so that particularly immediately before reaching the downstream coating unit 213B (inlet side) the bead can be made larger. Due to the unstableness of the preliminary-coated layer 254, coating streaks, or the like can easily be generated in the coating film after the aluminum web 214 passes the downstream coating unit 213B. According to the third embodiment, by setting the coating amount ratio (W1/W2) at 0.8 or more and 4.0 or less, even in the case where the coating liquid 250 is coated on while conveying the aluminum web 214 at a high speed, generation of these troubles can be prevented and an evenly coated surface can be obtained.

In consideration of only the amount coated at each coating unit 213A and 13B, in the case where the coating amount ratio is 0.8 or more and less than 1.0, additional to the preliminary-coated layer 254 provided on the aluminum web 214 by the upstream coating unit 213A, the coating liquid is further coated by the downstream coating unit 213B. Moreover, in the case where the coating amount ratio is 1.0, the coating liquid is not added to or eliminated from the preliminary-coated layer 254 by the downstream coating unit 213B. In the case where the coating amount ratio is more than 1.0 and is 4.0 or less, a part of the coating liquid providing the preliminary-coated layer 254 is eliminated by the downstream coating unit 213B. Actually, however, in any case, the coating liquid providing the preliminary-coated layer 254 is partially removed by the downstream coating unit 213B and the coating liquid 250 is additionally coated on. Thereby, partial replacement of the coating liquid is substantially carried out.

The case of the coating amount ratio for the bar coating device 212 will be explained in further details with reference to an example. This concerns the coating amount of the coating liquid by the conveyance direction upstream coating unit 213A, and the coating amount of the coating liquid by the conveyance direction downstream coating unit 213B as specified and mentioned above. However, the embodiment of the invention is not limited to the example.

EXAMPLES III

In this example, the coating liquid 250 was coated on the aluminum web 214 using the bar coating device 212 of the invention.

First, the mechanical roughing process, the chemical etching process, the electrolysis roughing process, and the anode oxidization process were performed on the surface of a band-shaped aluminum plate so as to obtain a substrate (aluminum web 214) with a 0.48 μm arithmetic average coarseness Ra. The aluminum web 214 was coated with the coating liquid 250 by the bar coating device 212, and the coated surface quality was evaluated and the state of the coated surface was observed.

The coating conditions were set as follows.

| | |
|---|---|
| a. Aluminum web width: | 500 mm |
| b. Aluminum web thickness: | 0.3 mm |
| c. Conveyance speed: | 150 m/min |
| d. Coating amount: | 0.02 liter/$m^2$ |
| e. Coating bar diameter: | 10 mm (both of the two) |
| f. Coating bar rotational frequency | |
| Preliminary-coating bar: | same speed and in the same direction as the aluminum web (driven rotation) |
| Adjusting (measuring) bar: | −50/min (backward rotation) |
| g. Viscosity of the coating liquid: | 30 mPa · s and 40 mPa · s |

In the above-mentioned conditions, the coating liquid was coated on the aluminum web 214 so as to obtain a planographic printing plate precursor with the coating amount ratio (W1/W2) changed by keeping the coating amount W2 at the downstream side coating unit 213B constantly (15.0 ml/m$^2$) and changing the coating amount W1 at the upstream side coating unit 213A. In the above-mentioned embodiment of the invention, the coating amount ratio (W1/W2) is in the specific range, and thus each coating amount W1, W2 is not particularly limited as long as it is performed under the same condition. For example, by cutting the aluminum web 214 after coating the aluminum web 214 into a predetermined size and drying the same so as to measure the weight thereof (depending on the cases, the weight of the liquid evaporated in the drying operation is taken into consideration), and comparing the weight with that of the aluminum plate of the same size without coating of the coating liquid 250, the actual coated amount value can be measured accurately.

Moreover, since the invention is performed such that, after coating (preliminary-coating) at the upstream coating unit 213A, the coating (measurement) continues to be performed at the downstream coating unit 213B, it is difficult to accurately measure the coating amount W1. Therefore, in the examples and the comparative examples, the relationship between the shape of the coating bar 216, or the like and the coating amount W1 is obtained in advance by performing only coating (preliminary-coating) at the upstream coating unit 213A without performing coating (measurement) at the downstream side coating unit 213B.

Evaluation and the observation results are shown in Table 3.

Moreover, in the case where the coating amount ratio (W1/W2) is more than 4.0 (Comparative Example 33), coating streaks are generated, and the coated surface quality is poor as well.

In contrast, in the case where the coating amount ratio (W1/W2) is 1.0 to 2.75 (Example 32), the coated surface quality is good in either of the coating liquids of the 30 mPa·s and 40 mPa·s viscosities. Moreover, in the case where the coating amount ratio (W1/W2) is 0.80 to 0.87 (Example 31) or 3.0 to 4.0 (Example 33), and in the case where the viscosity of the coating liquid is 40 mPa·s, the coated surface quality is slightly poorer than the example 32, but not to an extent that would cause a problem or defect in the practical use.

In the above-mentioned embodiment of the invention, an evenly coated surface quality can be obtained even in the case where the conveyance speed of the object to be coated is made higher.

Fourth Embodiment

Figure 7:
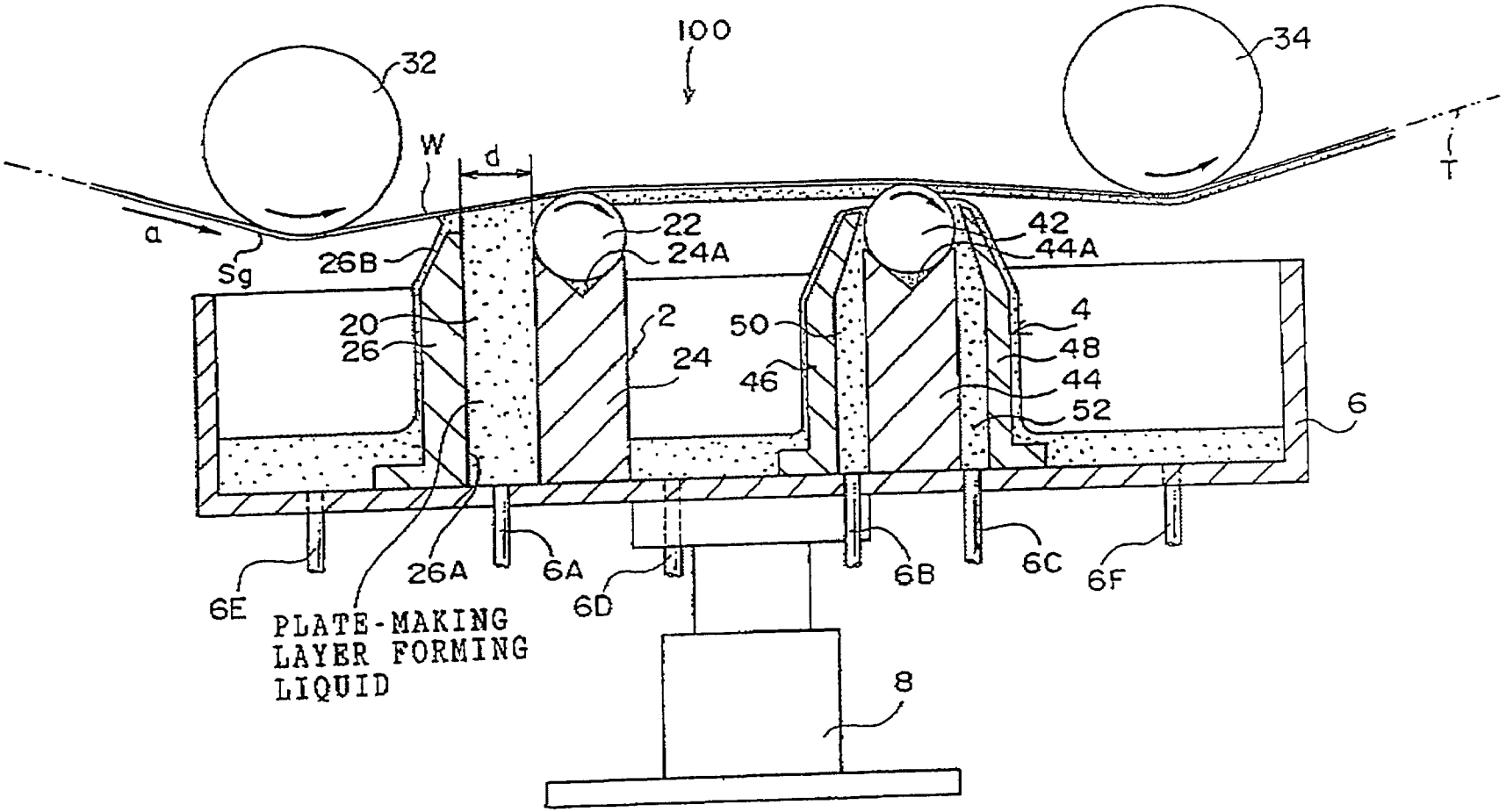
FIG. 7 is a schematic diagram showing a coating device according to another embodiment of the invention.

FIG. 7 shows the schematic configuration of a coating device according to a fourth embodiment of the invention.

The coating device 100 according to the fourth embodiment is a coating device for coating a plate-making layer forming liquid, as an embodiment of the coating liquid of the invention, on a support web W, as an embodiment of a band-shaped member of the invention.

TABLE 3

| | W1 | W2 | | Coated Surface Quality | | | |
|---|---|---|---|---|---|---|---|
| | | | | Coating Liquid of 30 mPa · s Viscosity | | Coating Liquid of 40 mPa · s Viscosity | |
| | (ml/m$^2$) | (ml/m$^2$) | W1/W2 | Evaluation | Observation Result | Evaluation | Observation Result |
| Comparative Example 31 | 10.0 | 15.0 | 0.67 | X | No coating | X | No coating |
| Comparative Example 32 | 11.3 | 15.0 | 0.75 | Δ | Parts without formation of the coating film generated in substantially half of the surface | X | No coating |
| Example 31 | 12.0 to 13.1 | 15.0 | 0.80 to 0.87 | ◎ | Evenly coated surface quality obtained | ○ | Parts without formation of the coating film remained |
| Example 32 | 15.0 to 41.3 | 15.0 | 1.0 to 2.75 | ◎ | Evenly coated surface quality obtained | ◎ | Evenly coatcd surface obtained |
| Example 33 | 45.0 to 60.0 | 15.0 | 3.0 to 4.0 | ◎ | Evenly coated surface quality obtained | ○ | Coating streaks generated parts |
| Comparative Example 33 | 67.5 | 15.0 | 4.5 | Δ | Coating streaks generated in the substantially half of the surface | X | Coating streaks generated in the entire surface |

In the evaluation in Table, "◎" represents a good result without the generation of a problem or defect, "○" represents a result slightly poorer than "◎", but not to an extent that would cause a problem or defect in practical use, "Δ" represents a result even poorer than "○" such that a problem or defect may be generated depending on the kind of the planographic printing plate precursor, the application, or the like, and "X" representsthe risk of the generation of a problem or defect.

As is apparent from Table 3, in the case where the coating amount ratio (W1/W2) is less than 0.80 (Comparative Examples 31 and 32), the coating liquid 250 may not be coated on the aluminum web 214, and the coated surface quality is poor as well.

As shown in FIG. 7, the coating device 100 according to the fourth embodiment comprises a coating section 2 for adhering the plate-making layer forming liquid to the sand-blasted surface Sg of the support web W, and an coat-adjusting section 4 disposed downstream of the coating section 2 with respect to the support web W conveyance direction shown by the arrow a in FIG. 7, for adjusting the plate-making layer forming liquid that was adhered by the coating section 2 to a predetermined thickness.

Both the coating section 2 and the coat-adjusting section 4 are fixed on the bottom surface of a box-like base 6 with the upper surface opened.

The base 6 is elevatably supported from below by an elevating device 8. When the plate-making layer forming liquid is to be coated on the support web W, the base 6 is elevated by the elevating device 8, and when the coating operation is not being performed, the base 6 is lowered by the elevating device 8.

Conveyance rollers 32 and 34 for conveying the support web W along the conveyance direction a are provided above the coating device 100 with the running surface T interposed therebetween. The conveyance roller 32 is disposed upstream of the coating section 2, and the conveyance roller 34 is disposed downstream of the coat-adjusting section 4.

As shown in FIG. 7, the coating section 2 comprises a first coating bar 22 disposed below the running surface T, which is the running path of the support web W, and is disposed perpendicular with respect to the conveyance direction a along the horizontal surface, a supporting member 24, which is a plate-shaped member with a first coating bar supporting groove 24A with a V-shaped cross-section formed on the top surface thereof, for supporting the first coating bar 22 from below with the first coating bar supporting groove 24A, and a weir member 26 provided parallel to the first coating bar 22 so as to face the first coating bar 22 and the supporting member 24 and disposed upstream of the supporting member 24 and the first coating bar 22 relative to the conveyance direction a.

As the first coating bar 22, any of the smooth bar, the bar with a groove and the wire bar mentioned previously can be used. The circumferential surface, which faces the support web W, of the first coating bar 22 is rotated in the same direction as the conveyance direction a, in other words, is rotated forwardly. The first coating bar 22 is preferably rotated at a circumferential speed that is at least 1/15 of, and no more than equal to, the conveyance speed of the support web W. In the case where the first coating bar 22 is rotated at the circumferential speed equal to the conveyance speed of the support web W, it can be driven by direct contact with the sand-blasted surface Sg of the support web, or via the coating layer formed on the sand-blasted surface Sg by coating the sand-blasted surface Sg with the plate-making layer forming liquid. In contrast, in the case where it is rotated at a circumferential speed lower than the conveyance speed, it is preferable to rotate the first coating bar 22 forcibly at a predetermined rotational frequency by a suitable driving means such as a motor. In this case, it is preferable for the driving means and the first coating bar 22 to be coupled by a suitable coupling means such as a clutch so that the coupling can be released as needed.

The relative positional relationship among the first coating bar 22, the supporting member 24 and the weir member 26 will be explained hereinafter.

The weir member 26 is a wall-shaped member provided vertically, and disposed with the interval d between the surface facing the first coating bar 22 and the outer circumferential surface of the first coating bar 22 is in a range of 3 to 30 mm.

A vertical surface 26A is formed on the surface of the upper rim part of the weir member 26 on the side facing the first coating bar 22. An inclined surface 26B descending towards the upstream side is formed in the weir member 26 on the side opposite to the above-mentioned surface.

At the time of coating the plate-making layer forming liquid, the circumferential speed of the first coating bar 22 is 1/15 or more, preferably in a range of 1/15 to 3/4, and particularly preferably in a range of 1/10 to 1/2 of the conveyance speed of the support web W.

As shown in FIG. 7, a coating liquid path 20 is provided between the supporting member 24 and the weir member 26 for ejecting the plate-making layer forming liquid toward the support web W to be passed above.

The coat-adjusting section 4 disposed below the running surface T of the support web W is provided horizontally along the direction substantially orthogonal to the conveyance direction a of the support web W. The coat-adjusting section 4 comprises a second coating bar 42, which is rotated such that the circumferential surface facing the support web W is moved in the same direction or in the opposite direction with respect to the conveyance direction a, a supporting member 44, which is a plate-shaped member including a second coating bar supporting groove 44A with a V-shaped cross-section formed in the top surface thereof, for supporting the second coating bar 42 from below with the second coating bar supporting groove 44A, an upstream weir member 46 disposed parallel to the second coating bar 42 so as to face the second coating bar 42 and the supporting member 44 and disposed upstream of the supporting member 44 and the second coating bar 42 with respect to the conveyance direction a, and a downstream weir member 48 disposed parallel to the second coating bar 42 so as to face the second coating bar 42 and the supporting member 44 and disposed on the side opposite to the upstream side weir plate 46 with respect to the supporting member 44.

As the second coating bar 42, similar to the case of the first coating bar 22, a smooth bar, a bar with a groove, a wire bar, or the like can be used.

The second coating bar 42 can be rotated forwardly or in the direction opposite to the supporting web W conveyance direction a (backward rotation). However, from a view point of preventing a coating defect, which is caused by the joint portion when the joint portion transits the coat-adjusting section 4, from occurring, the second coating bar 42 is preferably rotated forwardly.

The upper end portion of both the upstream side weir plate 46 and the downstream side weir plate 48 bend towards the second coating bar 2.

An upstream bead of the upstream side coating liquid path 50 for preventing drying of the second coating bar 42 by storing the coating liquid is provided among the upstream side weir plate 46, the second coating bar 42 and the supporting member 44. Similarly, a downstream bead of the downstream side coating liquid path 52 is provided among the downstream side weir plate 48, the second coating bar 42 and the supporting member 44. To both the upstream bead and the downstream bead, the plate-making layer forming liquid is supplied such that the liquid level of the plate-making layer forming liquid maintains at a predetermined constant height. To maintain the liquid level of the plate-making layer forming liquid at a constant height, the plate-making layer forming liquid may be overflowed from each top portion of the upstream side weir plate 46 and the downstream side weir plate 48.

In the bottom surface of the base 6 are disposed the following: a first liquid supplying pipe 6A for supplying the plate-making layer forming liquid to the coating liquid path 20, a second liquid supplying pipe 6B for supplying the plate-making layer forming liquid to the upstream side coating liquid path 50 and a third liquid supplying pipe 6C for supplying the plate-making layer forming liquid to the downstream side coating liquid path 52. Furthermore, in the bottom surface of the base 6 are disposed the following: a first liquid discharging pipe 6E for collecting the plate-making layer forming liquid, which was overflowed from the weir member 26 downward between the upstream side wall and the weir member 26 of the base 6 in the coating section 2, a second liquid discharging pipe 6D for collecting the plate-making layer forming liquid, which flowed downward between the weir member 26 and the upstream side weir plate 46, and a third liquid discharging pipe 6F for collecting the plate-making layer forming liquid, which was overflowed from the downstream side weir plate 48 downward between the downstream side wall and the downstream side weir plate 48 of the base 6.

The operation of the coating device 100 will be explained hereafter.

The support web W is conveyed in the arrow a direction by the conveyance rollers 32 and 34 with the sand-blasted surface Sg facing downward.

The plate-making layer forming liquid, which is supplied from the first liquid supplying pipe 6A to the coating liquid path 20, is taken up upwards by the first coating bar 22 at the top portion of the coating liquid path 20 so as to be adhered to the sand-blasted surface Sg of the support web W. Here, since the first coating bar 22 is rotated forwardly by the circumferential speed that is 1/15 or more of the conveyance speed of the support web W, the plate-making layer forming liquid is sufficiently taken up upwards by the first coating bar 22. Accordingly, even in the case where the support web W is running at a high speed, the plate-making layer forming liquid can be adhered evenly.

The plate-making layer forming liquid which adhered to the sand-blasted surface Sg of the support web W in the coating section 2, is then adjusted to a predetermined thickness by the second coating bar 42 in the coat-adjusting section 4.

In the coat-adjusting section 4, the liquid level height of the plate-making layer forming liquid in the upstream bead of the upstream side coating liquid path 50 and the downstream bead of the downstream side coating liquid path 52 can be maintained constantly by replenishing the plate-making layer forming liquid from the second liquid supplying pipe 6B and the third liquid supplying pipe 6C to the upstream side coating liquid path 50 and the downstream side coating liquid path 52 such that the plate-making layer forming liquid overflows to the upstream side beyond the upstream side weir plate 46 or the downstream side beyond the downstream side weir plate 48. Therefore, since the surface of the second coating bar 42 is always maintained in a wetted state, generation of a solid component and adhesion thereof to the sand-blasted surface Sg of the support web W can be prevented.

As mentioned above, in the coating device according to the coating device of the fourth embodiment, even in the case where the conveyance speed of the support web W is high, the plate-making layer forming liquid can be coated evenly and furthermore, inadvertent adhesion of liquid to the back side can be prevented. Therefore, the plate-making layer can be formed efficiently on the planographic printing plate precursor.

EXAMPLES IV

Examples 41 to 45, Comparative Examples 41 to 43

A support web W was obtained by sand-blasting one side surface of an aluminum web according to an ordinary method, and processing the sand-blasted surface by anode oxidization.

A photosensitive layer forming liquid, which was an example of the plate-making layer forming liquid was coated on the support web W using the coating device 100 shown in FIG. 7.

The coating conditions of the photosensitive layer coating liquid were as follows.

| | |
|---|---|
| a. Support web W thcikness: | 0.3 mm |
| b. Conveyance speed of the support web W: | 150 m/minute |
| c. Photosensitive layer forming liquid adhering amount: | 50 cc/minute (coating section 2)<br>15 cc/minute (coat-adjusting section 4) |
| d. Diameter of the bar: | 10 mm (for both the first coating bar 22 and the second coating bar 42) |
| e. Rotation speed (circumferential speed) of the first coating bar 22: | as shown in Table 1 |
| f. Rotation speed (circumferential speed) of the second coating bar 42: | 16 m/minute (forward rotation) |
| g. Viscosity of the photosensitive layer forming liqud: | 30 mPa · s |

The coating property showing whether or not the plate-making layer forming liquid can be coated stably on the sand-blasted surface Sg of the support web W and the coated surface quality showing the surface quality of the coated surface formed by coating the plate-making layer forming liquid on the sand-blasted surface Sg were evaluated in 4 grades of "◎", "○", "Δ", "X" by visual observation. Results are shown in Table 4.

TABLE 4

| | Direction of Rotation, Rotation Speed (Circumferential Speed) of Bar | | |
|---|---|---|---|
| | First Coating Bar | Second Coating Bar | Coating Property, Coated Surface Qquality |
| Comparative Example 41 | <+10 m/minute (<1/15) | +16 m/minute | X: Partial generation of uncoated part |
| Example 41 | +10 to 15 m/minute (1/15 to 1/10) | | ○ |

TABLE 4-continued

| | Direction of Rotation, Rotation Speed (Circumferential Speed) of Bar | | |
|---|---|---|---|
| | First Coating Bar | Second Coating Bar | Coating Property, Coated Surface Qquality |
| Example 42 | +15 to 75 m/minute (1/10 to 1/2) | | ◎ |
| Example 43 | +75 to 113 m/minute (1/2 to 3/4) | | ◎ |
| Example 44 | +113 to 150 m/minute (3/4 to 1) | | Δ: Local Generation of bead streaks (thinly coated portions in the longitudinal direction) |
| Example 45 | −150 m/minute (without drive) | | Δ: Local Generation of bead streaks (thinly coated portions in the longitudinal direction) |
| Comparative Example 42 | +150 m/minute (without drive) | None | X: Generation of rippled streaks and Coating liquid splashes |
| Comparative Example 43 | −16 to +16 m/minute | None | X: the plate-making layer forming liquid not adhering due to entrained air |

In the column of the "bar rotation direction, rotation speed" in Table 4, "+" denotes forward rotation of the first coating bar or the second coating bar, and "−" denotes backward rotation of the first coating bar or the second coating bar. Moreover, in the column of the "first coating bar" in the column, the numerals in parentheses show the ratio of the circumferential speed of the first coating bar with respect to the conveyance speed of the support web W.

As shown in Table 4, in the Comparative Example 41, in which the circumferential speed of the first coating bar is less than 1/15 of the conveyance speed of the support web W, an uncoated part is generated in the sand-blasted surface Sg so that the plate-making layer forming liquid cannot be coated stably.

In contrast, in Examples 41 to 44, in which the circumferential speed of the first coating bar is at least 1/15 of, to equal to the conveyance speed of the support web W, it was learned that the plate-making layer forming liquid can be coated substantially stably although bead streaks, which are thinly coated portions along the longitudinal direction, were generated in some cases.

According to the embodiment of the invention, a coating device and a coating method capable of evenly coating the coating liquid on a band-shaped member running at a high speed can be provided.

Fifth Embodiment

Again, with reference to FIG. 7, a fifth embodiment of the invention will be explained.

The coating device 100 according to the fifth embodiment can use without changes the coating device that was used in the fourth embodiment for coating the support web W, which is a belt-shaped thin aluminum plate, one side of which is sand-blasted, with the plate making layer forming liquid, which is one example of the coated liquid in the present invention. Therefore, those skilled in the art would understand that the description for the elements installed in the coating device 100 provided in the fourth embodiment also can be disclosed in the fifth embodiment.

Figure 8:
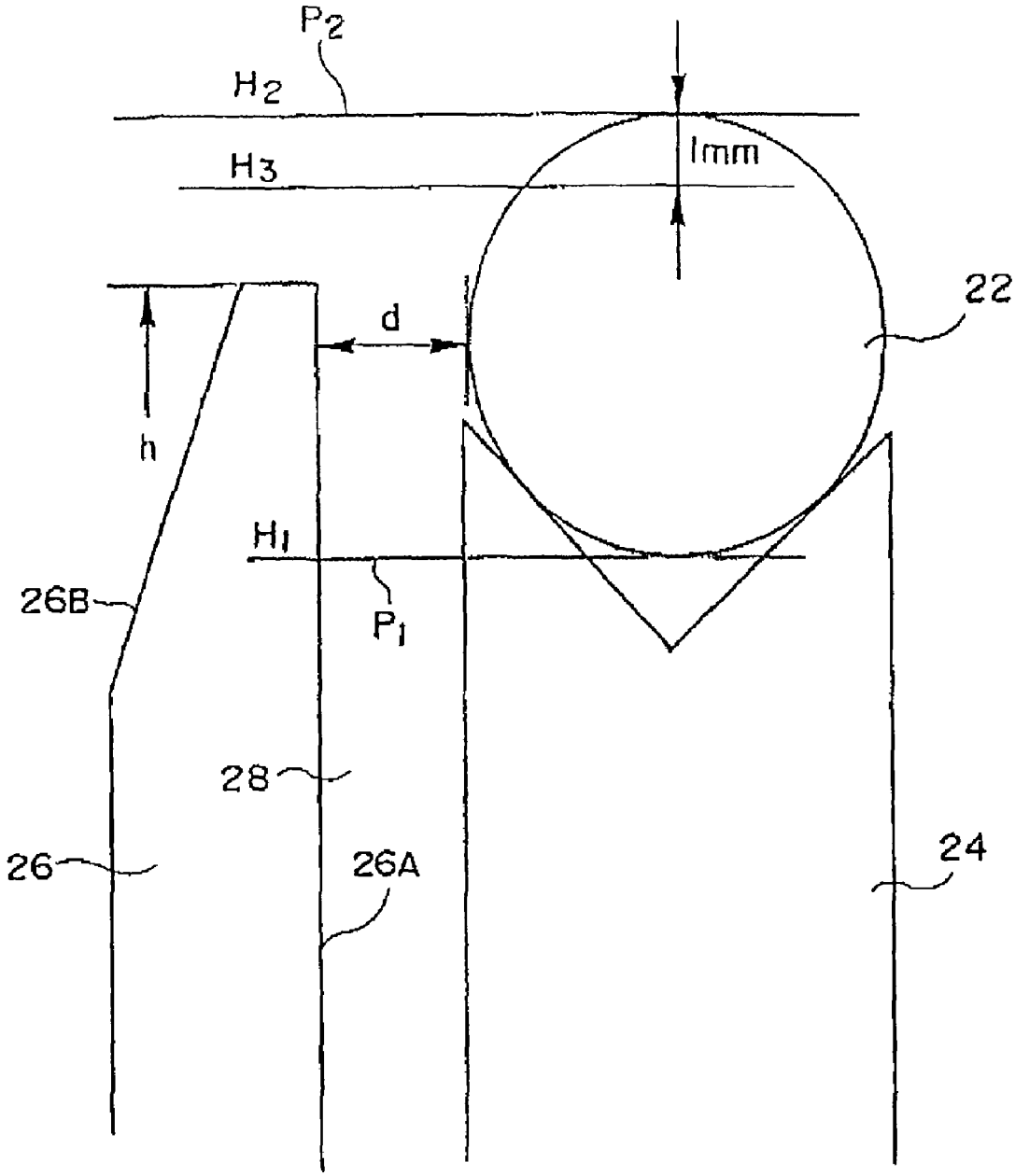
FIG. 8 is an enlarged diagram showing the relative relationship of the height of a first coating bar, a supporting base, and a weir member in a coating section that constitutes the coating device shown in FIG. 7.

As shown in FIG. 8, in the coating device 100 according to the fifth embodiment, the height h of the top surface of the weir member 26 relative to the bottom surface of the base 6 is higher than the height H1 of the lowermost point of the surface of the first coating bar 22 relative to the bottom surface of the base 6 and lower than the height H3, which is lower by 1 mm than the height H2 of the uppermost point of the surface of the first coating bar 22 relative to the bottom surface of the base 6. As shown in FIG. 8, the height H1 of the lowermost point of the surface of the first coating bar 22 can be referred to as the height of the horizontal surface P1 that contacts the surface of the first coating bar 22 from below in other words. Moreover, the height H2 of the uppermost point of the surface of the first coating bar 22 can be referred to as the height of the horizontal surface P2 that contacts the first coating bar 22 from above in other words.

A vertical surface 26A is formed in the surface on the side facing the first coating bar 22 at the upper end portion of the weir member 26. In contrast, an inclined surface 26B inclined to the upstream side toward downward is formed at the upper end portion on the side opposite to the above-mentioned side in the weir member 26.

As shown in FIGS. 7 and 8, a coating liquid path 28 for ejecting the plate-making layer forming liquid toward the support web W, which is passing thereabove, is provided between the supporting member 24 and the weir member 26.

The rotation direction of the second coating bar 42 of the coat-adjusting section 4 may be the same direction as the conveyance direction of the support web W (forward rotation), or the opposite direction (backward rotation). Moreover, the circumferential speed can be set according to the desired coating thickness of the plate-making layer forming liquid, however, in the case where the rotation direction of the second coating bar 42 is in the same direction as the conveyance direction of the support web W, the circumferential speed of the second coating bar 42 is preferably lower than the circumferential speed of the first coating bar 22.

The operation of the coating device 100 will be explained hereafter.

The support web W is conveyed in the arrow a direction by the conveyance rollers 32 and 34 with the sand-blasted surface Sg facing down.

The plate-making layer forming liquid supplied from the first liquid supplying pipe 6A to the coating liquid path 20 is taken up by the coating roller 22 so as to be adhered to the sand-blasted surface Sg of the support web W at the top area of the coating liquid path 20. Here, the height of the weir member 26 is higher than the lowermost point of the surface of the first coating bar 22 and lower by 1 mm or more than the uppermost point of the surface of the first coating bar 22.

Figure 9:
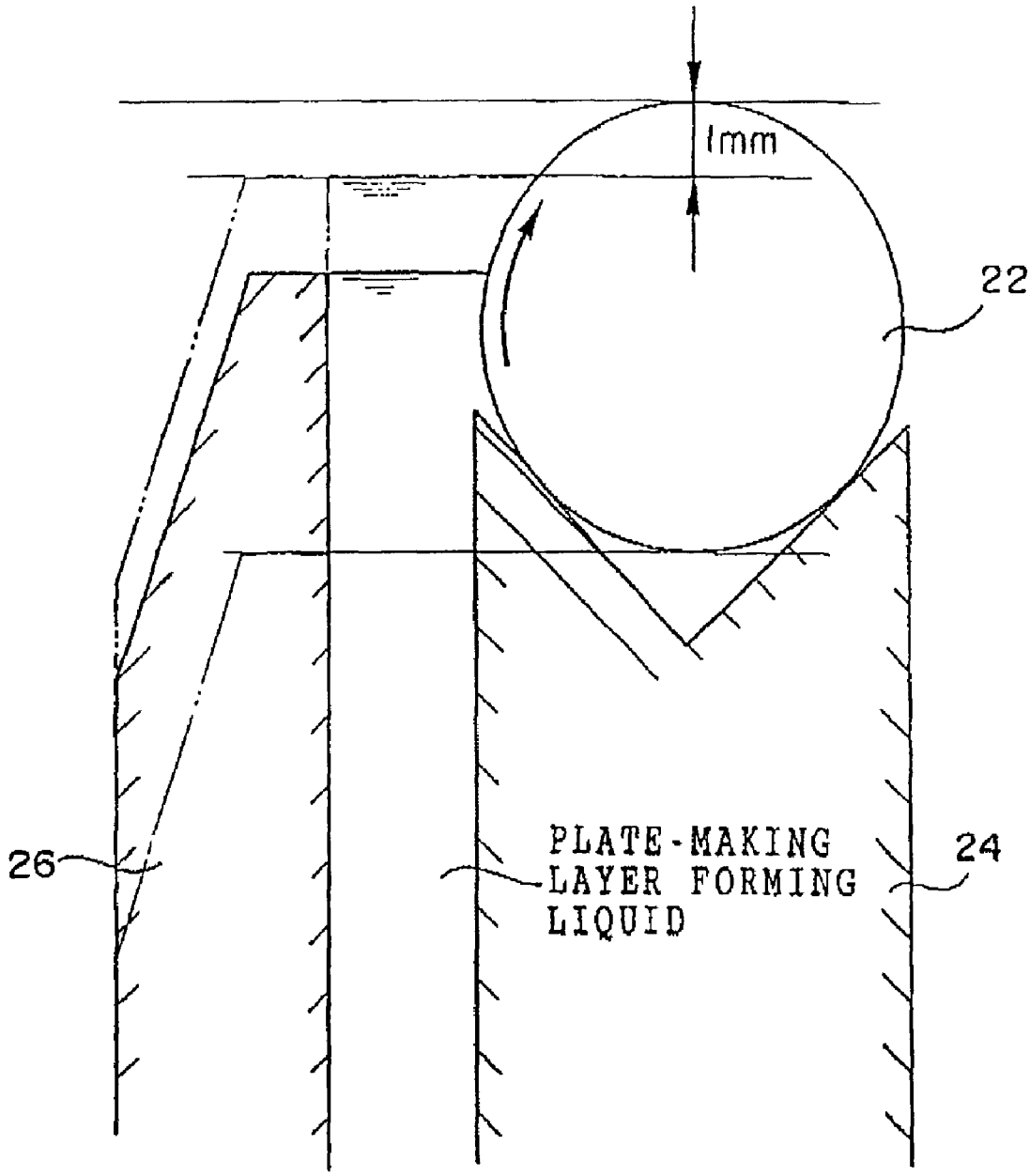
FIG. 9 is an enlarged diagram showing the relative positional relationship between the first coating bar, the weir member, and the liquid level of a plate-making layer forming liquid in the coating section that constitutes the coating device shown in FIG. 7.

As shown in FIG. 9, since the liquid level height of the plate-making layer forming liquid in the coating liquid path 20 is the same as or slightly higher than the height of the weir member 26, the height of the liquid level is higher then the lowermost point of the first coating bar 22 and lower than the uppermost point of the first coating bar 22. Thus, a part of the surface of the first coating bar 22 is always covered with the plate-making layer forming liquid at the time of coating the plate-making layer forming liquid. Therefore, since the plate-making layer forming liquid can be taken up sufficiently upward by the first coating bar 22, the plate-making layer forming liquid can be adhered evenly even in the case where the conveyance speed of the support web W is increased.

In contrast, since the first coating bar 22 is not completely soaked in the plate-making layer forming liquid, generation of movement of the plate-making layer forming liquid to the back side of the support web W so as to be adhered thereon due to the excessive supply of the plate-making layer forming liquid can be prevented.

-continued

| | |
|---|---|
| adhering amount: | (coating section 2) 15 cc/minute (coat-adjusting section 4) |
| d. Diameter of the bar: | 10 mm (both the first coating bar 22 and the second coating bar 42) |
| e. Rotation speed (circumferential speed) of the first coating bar 22: | 130 m/minute (forward rotation) |
| f. Rotation speed (circumferential speed) of the second coating bar 42: | 16 m/minute (forward rotation) |
| g. Viscosity of the photosensitive layer forming liquid: | 20 mPa · s |
| h. Coating amount of the photosensitive layer forming liquid after measurement by the second coating bar 42: | Results are shown in Table 5. |

TABLE 5

| | Height of the Weir Member 26 | Distance Between the Weir Member 26 and the First Coating Bar 22 (mm) | Coating Property of the Plate-Making Layer Forming Liquid in the Coated Surface of the Support Web W and the Surface Quality of the Coated Surface |
|---|---|---|---|
| Comparative Example 51 | Lower than the lowermost point of the first coating bar 22 | 0.5 to 3 | X: Partial generation of the uncoated part |
| Comparative Example 52 | | 3 to 30 | X: Partial generation of the uncoated part |
| Example 53 | From the lowermost point, to 1 mm lower than the uppermost point, of the first coating bar 22 | 0.5 to 3 | ○: Coated on the entire surface |
| Example 54 | | 3 to 30 | ◎: Coated evenly on the entire surface |
| Comparative Example 55 | Higher than 1 mm lower than the uppermost point of the first coating bar 22 | 0.5 to 3 | X: Adhesion of liquid to the back side generated |
| Comparative Example 56 | | 3 to 30 | X: Adhesion of liquid to the back side generated |

As mentioned above, according to the coating device of the fifth embodiment, the plate-making layer forming liquid can be coated evenly even in the case where the conveyance speed of the support web W is high, and furthermore, inadvertent adhesion of liquid to the back side can be prevented, the plate-making layer can be formed efficiently on the planographic printing plate precursor.

EXAMPLES V

Examples 51, 52, Comparative Examples 51 to 54

A support web W was obtained by sand-blasting one side of a surface of an aluminum web according to an conventional method, and processing the sand-blasted surface by anode oxidization.

A photosensitive layer forming liquid which is one example of the plate-making layer forming liquid, was coated on the support web W using the coating device 100 shown in FIG. 7.

The coating conditions of the photosensitive layer coating liquid were as follows.

| | |
|---|---|
| a. Support web W thickness: | 0.3 mm |
| b. Conveyance speed of the support web W: | 150 m/minute |
| c. Photosensitive layer forming liquid | 50 cc/minute |

As shown in FIG. 5, in the ease where the weir member 26 in the coating section 2 is higher than the lowermost point of the first coating bar 22, and lower than the uppermost point of the first coating bar 22 by 1 mm or more, the photosensitive layer forming liquid can be coated even though the conveyance speed of the support web W is as high as 150 m/minute.

In contrast, in the case where the weir member 26 was lower than the lowermost point of the first coating bar 22, an uncoated part was generated, and in the case where the weir member 26 was higher than the point that was lower than the uppermost point of the first coating bar 22 by 1 mm or more, adhesion of liquid to the back side was generated.

According to the above-mentioned embodiment of the invention, a coating device and a coating method capable of obtaining an evenly coated surface can be provided even in the case where the substrate conveyance speed is increased.

Sixth Embodiment

Figure 10:
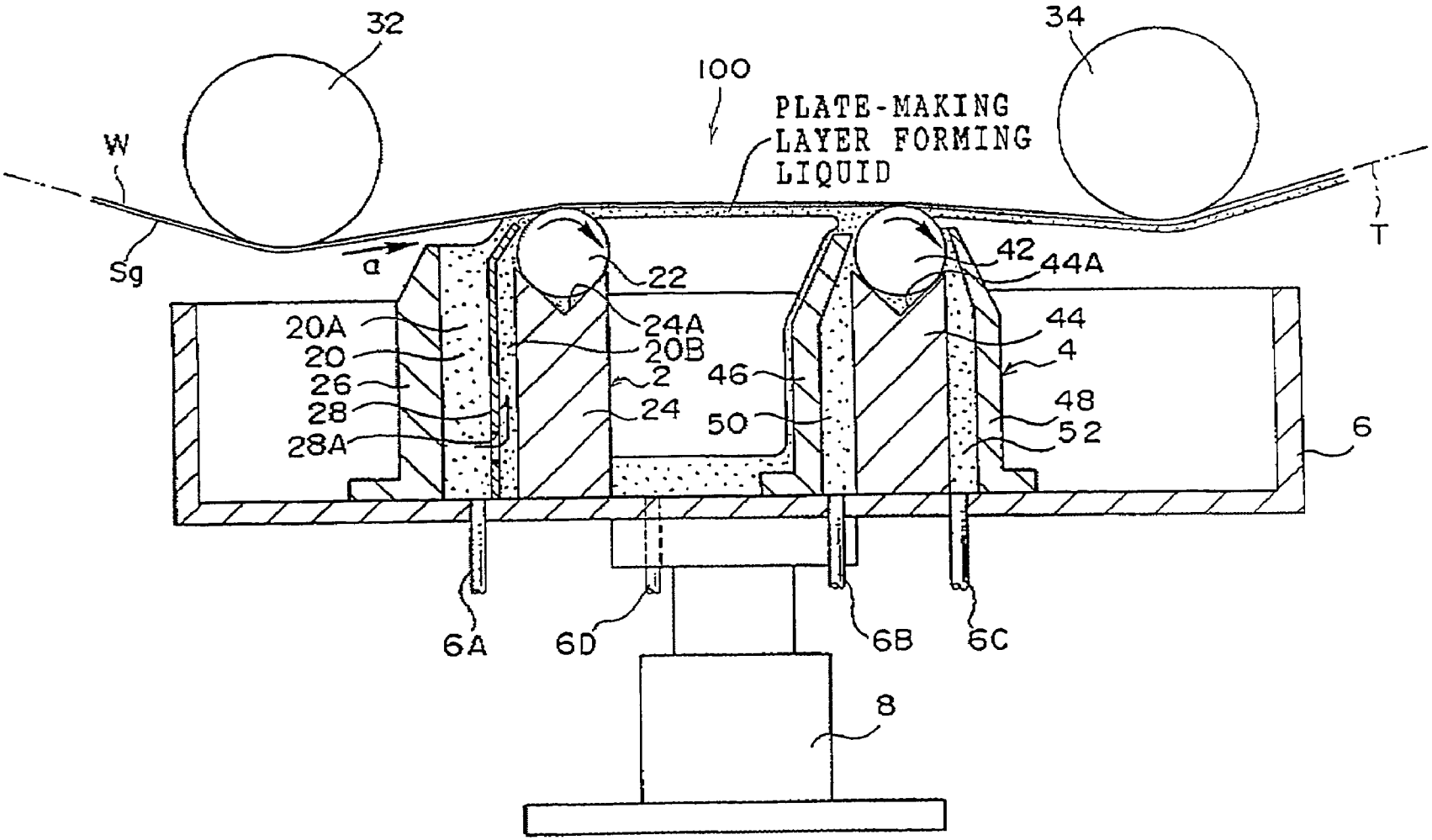
FIG. 10 is a schematic diagram showing the schematic configuration of a coating device according to a sixth embodiment of the invention.

FIG. 10 shows the schematic configuration of an embodiment of a coating device according to a sixth embodiment of the invention.

The coating device 100 according to the sixth embodiment can use without changes the coating device that was used in the fourth embodiment for coating the support web W, which is a belt-shaped thin aluminum plate, one side of which is sand-blasted, with the plate making layer forming liquid, which is one example of the coated liquid in the present invention.

As shown in FIG. 10, the coating device 100 according to the sixth embodiment has a common configuration with the fourth and fifth embodiments in many aspects. Therefore, those skilled in the art would understand that the description provided for the fourth and fifth embodiments can be adopted for the configuration that is common to those of the fourth and fifth embodiments.

As shown in FIG. 10, the coating section 2 comprises a first coating bar 22 disposed below the running surface T, which is the running path of the support web W, vertically with respect to the conveyance direction a, a supporting member 24 as a plate-shaped member having a first coating bar supporting groove 24A with a V-shaped cross-section formed on the top surface, for supporting the first coating bar 22 by the first coating bar supporting groove 24A from below, and a weir member 26 extending in the vertical direction, provided parallel to the first coating bar 22 so as to face the first coating bar 22 and the supporting member 24 upstream of the supporting member 24 and the first coating bar 22 in the conveyance direction a. A coating liquid path 20 for ejecting the plate-making layer forming liquid toward the support web W passing by above is provided between the supporting member 24 and the weir member 26, with a rectifying plate 28 provided in the coating liquid path 20, extending in the vertical direction. The rectifying plate 28 corresponds to the rectifying member in the coating device according to the invention, which is bent toward the first coating bar 22 at the upper end portion. It is preferable that the width of the rectifying plate 28 be equal to that of the supporting member 24 and the weir member 26.

As the first coating bar 22, any of a smooth bar, a bar with a groove and a wire bar can be used. The first coating bar 22 is rotated in the same direction as the conveyance direction a. The first coating bar 22 can be driven at a predetermined rotational frequency by an optional driving means directly contacting the sand-blasted surface Sg of the support web, or it can be driven via the coating layer formed by coating the plate-making layer forming liquid. It is preferable that the first coating bar 22 be rotated at a circumferential speed of at least 1/15 of, and no more than equal to, the support web W conveyance speed.

Figure 11:
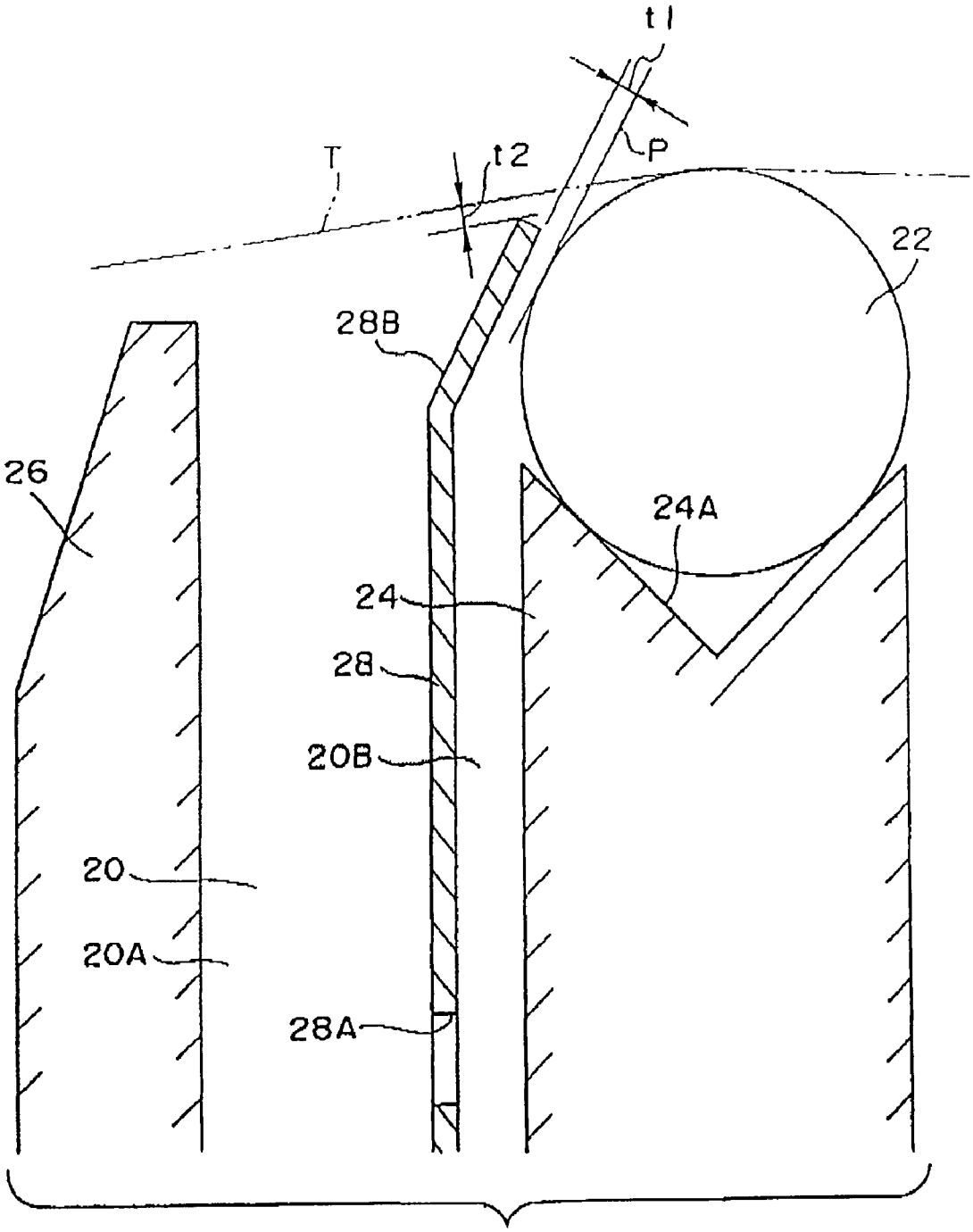
FIG. 11 is an enlarged cross-sectional view showing the relative positional relationship between a rectifying plate 28, a first coating bar 22, a supporting member 24, and a weir member 26 in a coating section 2.
Figure 12:
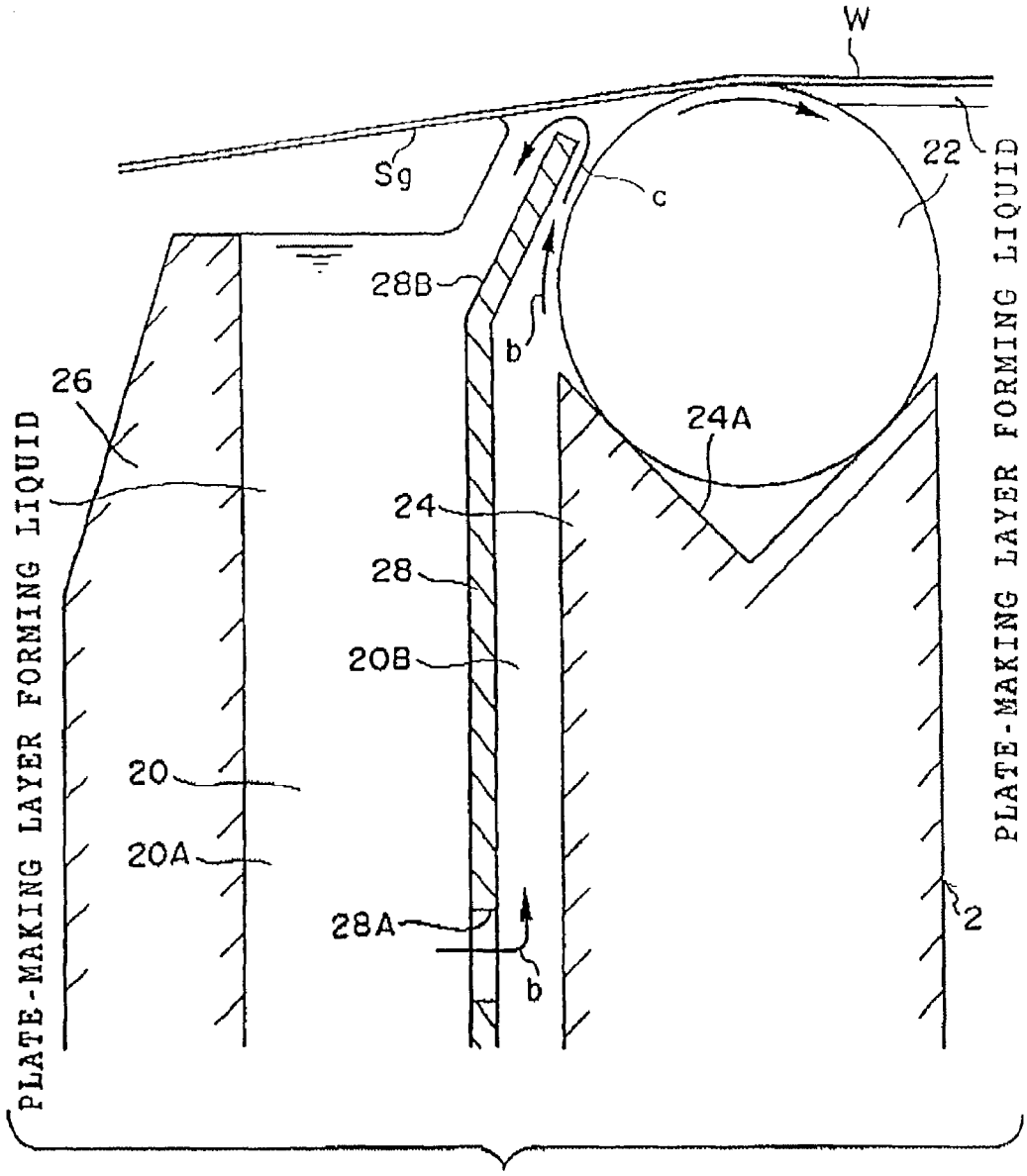
FIG. 12 is an enlarged cross-sectional view showing a plate-making layer forming liquid flow in the vicinity of the rectifying plate 28 in the coating section 2 shown in FIG. 11.

FIG. 11 shows the relative positional relationship between the rectifying plate 28, the first coating bar 22, the supporting member 24 and the weir member 26 in the coating section 2, and FIG. 12 shows the flow of the plate-making layer forming liquid in the vicinity of the rectifying plate 28.

As shown in FIG. 11, the rectifying plate 28 is disposed in the vicinity of the supporting member 24 in the coating liquid path 20. Then, the coating liquid path 20 is separated by the rectifying plate 28 into the upstream side coating liquid path 20A and the downstream side coating liquid path 20B along the conveyance direction a of the support web W.

A coating liquid communication hole 28A for communicating with the upstream side coating liquid path 20A and the downstream side coating liquid path 20B is formed in the lower end part of the rectifying plate 28, and a bent portion 28B that is bent toward the first coating bar 22 is formed in the upper end portion of the rectifying plate 28. The bent portion 28B is formed parallel to the tangential plane P of the first coating bar 22 at a part thereof facing the bent portion 28B. The distance t1 between the bent portion 28B and the tangential plane P is preferably 1 mm or less, and particularly preferably in a range of 0.1 to 1 mm. Moreover, the distance t2 between the tip of the bent portion 28B and the running surface T is preferably 3 mm or less, and particularly preferably in a range of 0.05 to 3 mm As shown in FIG. 10, the plate-making layer forming liquid is supplied to the upstream side coating liquid path 20A. In contrast, as shown in FIG. 12, the first coating bar 22 is rotated in the same direction as the conveyance direction a of the support web W (forward rotation) so that the surface of the first coating bar 22 is moved from below to above in the vicinity of the rectifying member 28. Therefore, as shown by the arrow b in FIG. 12, in the downstream side coating liquid path 20B, the plate-making layer forming liquid flows from below to above. Therefore, the plate-making layer forming liquid in the upstream side coating liquid path 20A is moved to the downstream side coating liquid path 208 through the coating liquid communication hole 28A.

The plate-making layer forming liquid raised in the downstream side coating liquid path 20B is adhered to the sand-blasted surface Sg of the support web W. The plate-making layer forming liquid not adhered to the sand-blasted surface Sg is moved from the downstream side to the upstream side around the tip of the bent portion 28B so as to return to the upstream side coating liquid path 20A as shown by the arrow c in FIG. 12.

Thus, the flow moving from the downstream side coating liquid path 20B to the upstream side coating liquid path 20A is formed around the tip of the bent portion 28B.

Figure 13:
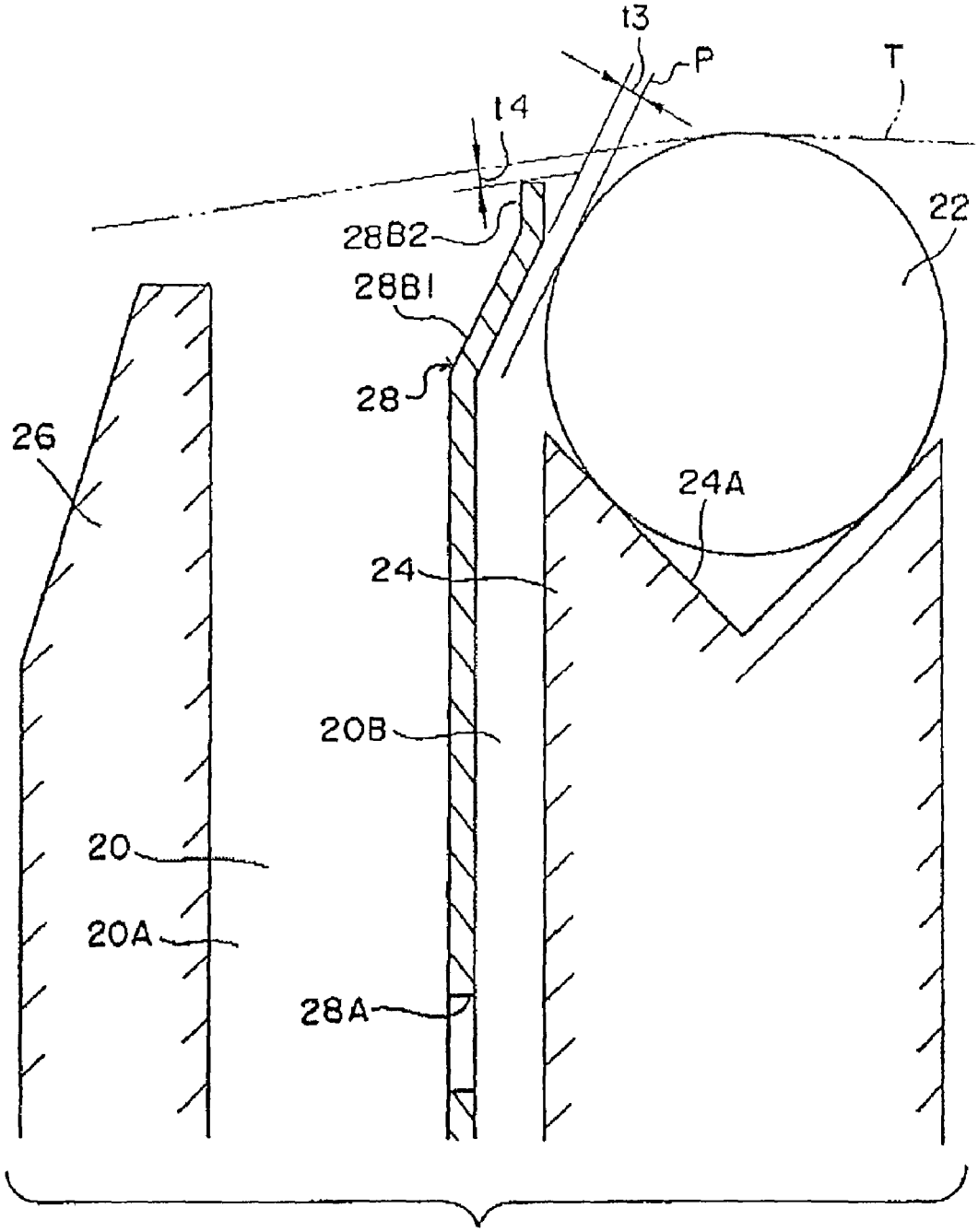
FIG. 13 is an enlarged cross-sectional view showing an example of the coating section 2 having a rectifying plate 28 of a different shape than in the coating section 2 shown in FIG. 11.

FIG. 13 shows an embodiment of the coating section 2 having a rectifying plate 28 with a different shape.

The coating section 2 shown in FIG. 13 comprises a rectifying member 28 having a bent portion 2813 in the vertical direction at the tip portion, and thus it is bent in the direction away from the first coating bar 22. Therefore, the bent portion 28B has a first bent portion 28B1 parallel to the tangential plane P, and a second bent portion 28B2 adjacent to the end of the first bent portion 28B1, extending in the vertical direction.

The distance t3 between the first bent portion 28B1 and the tangential plane P is preferably 1 mm or less, particularly preferably in a range of 0.1 to 1 mm. In contrast, the distance t4 between the tip of the second bent portion 28B2 and the conveyance surface T is preferably 3 mm or less, particularly preferably in a range of 0.05 to 3 mm.

Since in the coating section 2 shown in FIG. 13 the tip of the rectifying member 28 is formed in the vertical direction, the distance t4 can be made further shorter than the distance t2 shown in FIG. 11.

Moreover, since the flow of the plate-making layer forming liquid to move around the tip portion of the rectifying member 28 can be made smoothly, a plate-making layer with even fewer defects can be obtained compared with the case of the coating device 100 having the coating section 2 shown in FIGS. 11 and 12.

The circumferential speed of the second coating bar 42 can be set according to the desired coating thickness of the plate-making layer forming liquid. However, in the case where the rotation direction of the second coating bar 42 is in the same direction as the conveyance direction of the support web W, the circumferential speed is preferably lower than the circumferential speed of the first coating bar 22.

As shown in FIG. 10, in the bottom surface of the base 6, a first liquid supplying pipe 6A for supplying the plate-making layer forming liquid to the upstream side coating liquid path 20A, a second liquid supplying pipe 6B for supplying the plate-making layer forming liquid to the upstream side coating liquid path 50 and a third liquid supplying pipe 6C for supplying the plate-making layer forming liquid to the downstream side coating liquid path 52 are provided. Furthermore, in the bottom surface of the base 6, a liquid discharging pipe 6D for collecting the plate-making layer forming liquid that flowed down between the supporting member 24 in the coating section 2 and the upstream side weir plate 46 in the coat-adjusting section 4 is provided.

The operation of the coating device 100 will be explained hereafter.

The support web W is conveyed in the arrow a direction by the conveyance rollers 32 and 34 with the sand-blasted surface Sg facing down.

As mentioned above, the plate-making layer forming liquid supplied from the first liquid supplying pipe 6A to the upstream side coating liquid path 20A in the coating section 2 passes through the coating liquid communication hole 28A so as to flow into the downstream side coating liquid path 20B and rises in the downstream side coating liquid path 20B. Then, while forming a circulation flow c that moves around the tip of the bent portion 28B toward the upstream side coating liquid path 20A in the vicinity of the bent portion 28B of the rectifying member 28, a part of the circulation flow c is adhered on the sand-blasted surface Sg of the support web W.

In the coat-adjusting section 4, in the case where the adhering amount by the coating section 2 is insufficient, the plate-making layer coating liquid is further coated by the second coating bar 42, and in the case where the adhering amount is excessive, the coated liquid is scraped off by the second coating bar 42 so that the plate-making layer forming liquid adhered on the sand-blasted surface Sg in the coating section 2 is adjusted to a predetermined coating thickness According to the coating device of the sixth embodiment, as mentioned above, since the circulation flow c is formed from the downstream side to the upstream side around the vicinity of the tip portion of the rectifying plate 28, the fluctuation of the amount of coating liquid adhered on the band-shaped substrate can be restrained.

Therefore, since the coating failures such as the bead streaks and the uncoated part do not occur even in the case where the conveyance speed of the support web W is high, generation of a defected product can be prevented in the plate-making layer forming process for the planographic printing plate precursor.

EXAMPLES VI

Examples 61 to 68, Comparative Example 61

A support web W was obtained by sand-blasting one side of a surface of an aluminum web according to an conventional method, and processing the sand-blasted surface by anode oxidization.

A photosensitive layer forming liquid as an embodiment of the plate-making layer forming liquid was coated on the support web W using the coating device 100 shown in FIG. 10.

The coating conditions of the photosensitive layer coating liquid were as follows.

| | |
|---|---|
| a. Support web W thickness: | 0.3 mm |
| b. Conveyance speed of the support web W: | 150 m/minute |
| c. Photosensitive layer forming liquid adhering amount: | 50 cc/minute (coating section 2)<br>15 cc/minute (coat-adjusting section 4) |
| d. Diameter of the bar: | 10 mm (both the first coating bar 22 and the second coating bar 42) |
| e. Rotation speed (circumferential speed) of the first coating bar 22: | 130 m/minute (forward rotation) |
| f. Rotation speed (circumferential speed) of the second coating bar 42: | 16 m/minute (forward rotation) |
| g. Viscosity of the photosensitive layer forming liquid: | 2 to 50 mPa · s |
| h. Coating amount of the photosensitive layer forming liquid after measurement by the second coating bar 42: | Results are shown in Table 6. |

TABLE 6

| | Distance Between the Rectifying Plate 28 and the Coating Bar 22 and the Running Surface T | | |
|---|---|---|---|
| | Distance t1 Between the Rectifying Plate 28 and the Coating Bar 22 | Distance t2 between the Rectifying Plate 28 and the Running Surface T | Coating Property, Coated Surface Quality |
| Example 61 | 0.05 to 0.1 mm | 0.05 to 0.1 mm | ○: However, when the viscosity of the photosensitive layer forming liquid is 30 mPa · s or more, an uncoated part was generated partially. |
| Example 62 | | 0.1 to 3 mm | ○: However, when the viscosity of the photosensitive layer forming liquid is 30 mPa · s or more, an uncoated part was generated partially. |
| Example 63 | | Over 3 mm | Δ: Bead streaks (thinly coating of about a 5 to 30 mm length) were generated in parts. |
| Example 64 | 0.1 to 1 mm | 0.05 to 0.1 mm | ○: However, when the viscosity of the photosensitive layer forming liquid is 30 mPa · s or more, an uncoated part was generated partially. |
| Example 65 | | 0.1 to 3 mm | ◎: The entire surface was coated evenly. |

TABLE 6-continued

| | Distance Between the Rectifying Plate 28 and the Coating Bar 22 and the Running Surface T | | |
|---|---|---|---|
| | Distance t1 Between the Rectifying Plate 28 and the Coating Bar 22 | Distance t2 between the Rectifying Plate 28 and the Running Surface T | Coating Property, Coated Surface Quality |
| Example 66 | | Over 3 mm | Δ: Bead streaks (thinly coating of about a 5 to 30 mm length) were generated in parts. |
| Comparative Example 61 | Over 1 mm | 0.05 to 0.1 mm | X: Bead streaks were generated in parts. In the case where the viscosity of the photosensitive layer forming liquid is 30 mPa · s or more, an uncoated part was generated partially. |
| Example 67 | | 0.1 to 3 mm | Δ: Bead streaks were generated in parts. |
| Example 68 | | Over 3 mm | Δ: Bead streaks were generated in parts. |

As shown in Table 6, in the above-mentioned conditions, in the case where the distance t1 and the distance t2 are each 0.1 to 1 mm and 0.1 to 3 mm, respectively, even though the conveyance speed of the support web W was as high as 150 m/minute, the photosensitive layer forming liquid could be coated evenly.

In contrast, in the case where at least one of the distances t1 and t2 is outside the above-mentioned range, the uncoated parts or the bead streaks might be generated.

However, the preferable range of the above-mentioned distances t1 and t2 are not limited to the above-mentioned range, and it is thought that they can fluctuate according to the change of the above-mentioned conditions a to h.

According to the above-mentioned embodiment of the invention, a coating device and a coating method capable of obtaining an evenly coated surface can be provided even in the case where the substrate conveyance speed is high.

Seventh Embodiment

Figure 14:
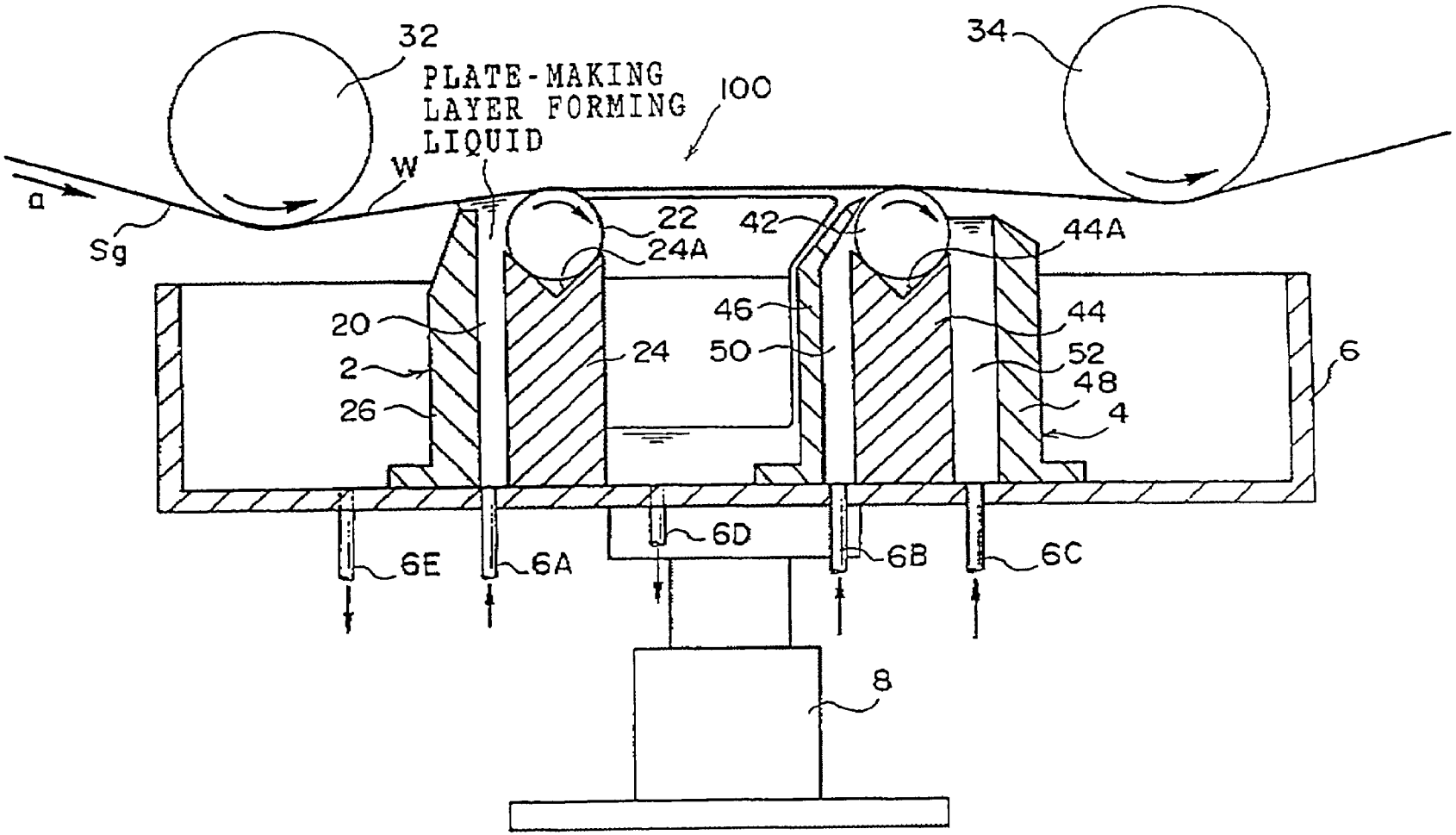
FIG. 14 is a schematic diagram showing the schematic configuration of a coating device according to a seventh embodiment of the invention.

FIG. 14 shows the schematic configuration of a coating device according to a seventh embodiment of the invention.

The coating device 100 according to the seventh embodiment is also a coating device that was used in the fourth embodiment for coating the support web W, which is a thin belt-shaped aluminum plate, one side of which is sand-blasted, with the plate making layer forming liquid, which is one example of the coated liquid in the present invention.

As shown in FIG. 14, the coating device 100 according to the seventh embodiment has many aspects in common configuration with the coating device according to the fourth and fifth embodiments shown in FIG. 7 and the coating device according to the sixth embodiment shown in FIG. 10. The same reference numerals are used for identical components to avoid redundant explanation for the configuration or the operation. However, a person skilled in the art would understand that the description provided for the embodiments can be adopted as needed for the description of this embodiment.

Figure 15:
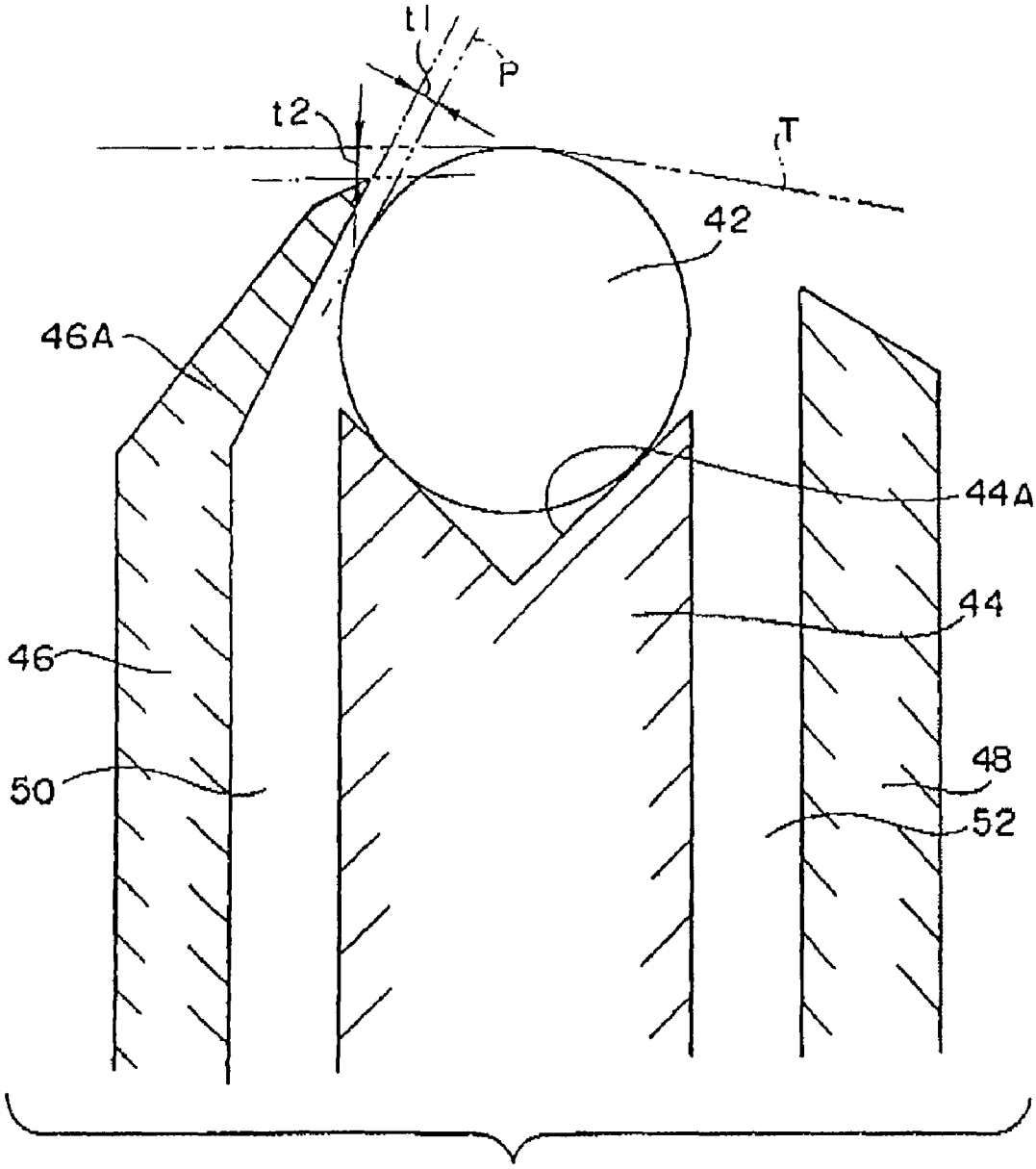
FIG. 15 is an enlarged diagram showing the mutual positional relationship between an upstream block, a bar, and a downstream block in an coat-adjusting section of the coating device shown in FIG. 14.

The relative positional relationship among the coating bar 42, the supporting member 44, the upstream side block 46 and the downstream side block 48 is shown in FIG. 15.

As shown in FIGS. 14 and 15, a upstream side coating liquid path 50 for forming the bead of the plate-making layer forming liquid between the upstream side block 46 and the coating bar 42 and the support web W by ejecting the coating liquid substantially upward is provided among the upstream side block 46, the coating bar 42, and the supporting member 44. A downstream bead of the downstream side coating liquid path 52 for preventing drying of the coating bar 42 while storing the coating liquid is provided among the downstream side block 48, the coating bar 42, and the supporting member 44.

As the coating bar 42, as in the case of the coating bar 22, a smooth bar, a bar with a groove, a wire bar, or the like can be used.

As shown in FIGS. 14 and 15, the coating bar 42 may be a forwardly rotating bar to be rotated forwardly with respect to the conveyance direction a of the support web W or a backwardly rotating bar to be rotated backwards with respect to the conveyance direction a. However, for forming a stable bead, the forwardly rotating bar is preferable.

Moreover, the circumferential speed can be set according to a desired coating thickness of the plate-making layer forming liquid, in the case where the coating bar 42 is the forward rotation bar, the circumferential speed is preferably lower than the circumferential speed of the coating bar 22.

As shown in FIGS. 14 and 15, the upstream side block 46 is a plate-shaped member elongated in the vertical direction toward the running surface T of the support web W, with a bent portion formed at the upper end 46A that bends toward the coating bar 42. The surface in the bent portion 46A facing the coating bar 42 is formed parallel to a tangential plane P that contacts a part of the coating bar 42 facing the tip of the bent portion 46A.

The shortest distance from a surface of the bent portion 46A on the side thereof that faces the coating bar 42 to the outer circumferential surface of the coating bar 42, in other words, the distance t1 from the surface of the bent portion 46A to the tangential plane p of the coating bar 42 is preferably 3 mm or less, more preferably in a range of 0.05 to 3 mm, and particularly preferably in a range of 0.1 to 3 mm.

The distance t2 between the upper end of the upstream side block 46 and the running surface T is preferably 3 mm or less, particularly preferably in a range of 0.1 to 3 mm.

Figure 16:
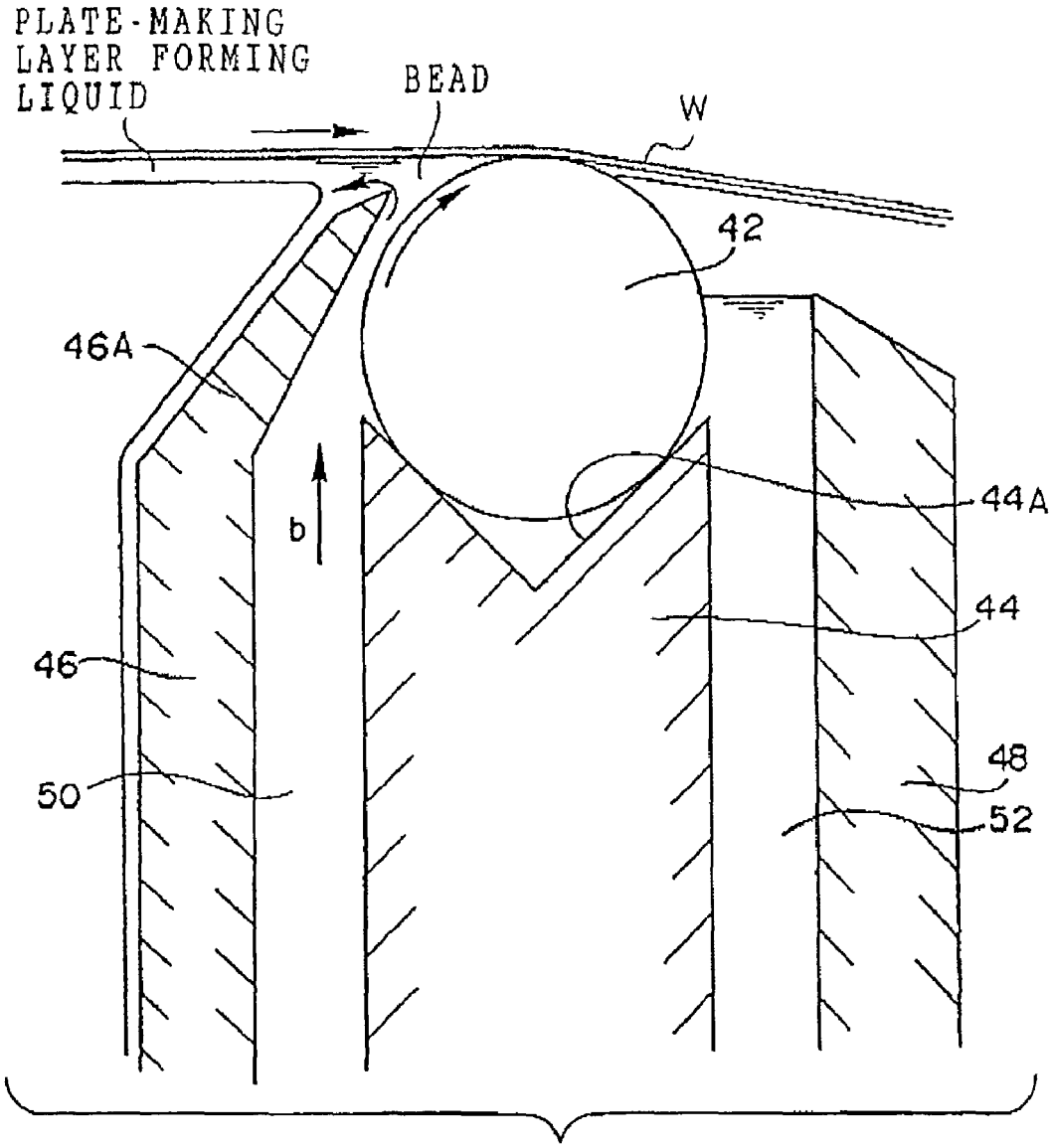
FIG. 16 is an enlarged diagram showing a plate-making layer forming liquid flow in the coat-adjusting section shown in FIG. 15.

FIG. 16 shows the flow of the plate-making layer forming liquid in the coat-adjusting section 4, which comprises the upstream side block 46 shown in FIG. 15.

As shown in FIG. 16, the plate-making layer forming liquid supplied to the upstream side coating liquid path 50 rises in the upstream side coating liquid path 50 and flows around the upper end of the upstream side block 46, from the downstream side to the upstream side thereof, and then flows back down along the upstream side surface of the upstream side block 46. Thus, as shown in FIG. 16, a steady flow b can be formed in the vicinity of the upper end portion of the upstream side block 46.

Figure 17:
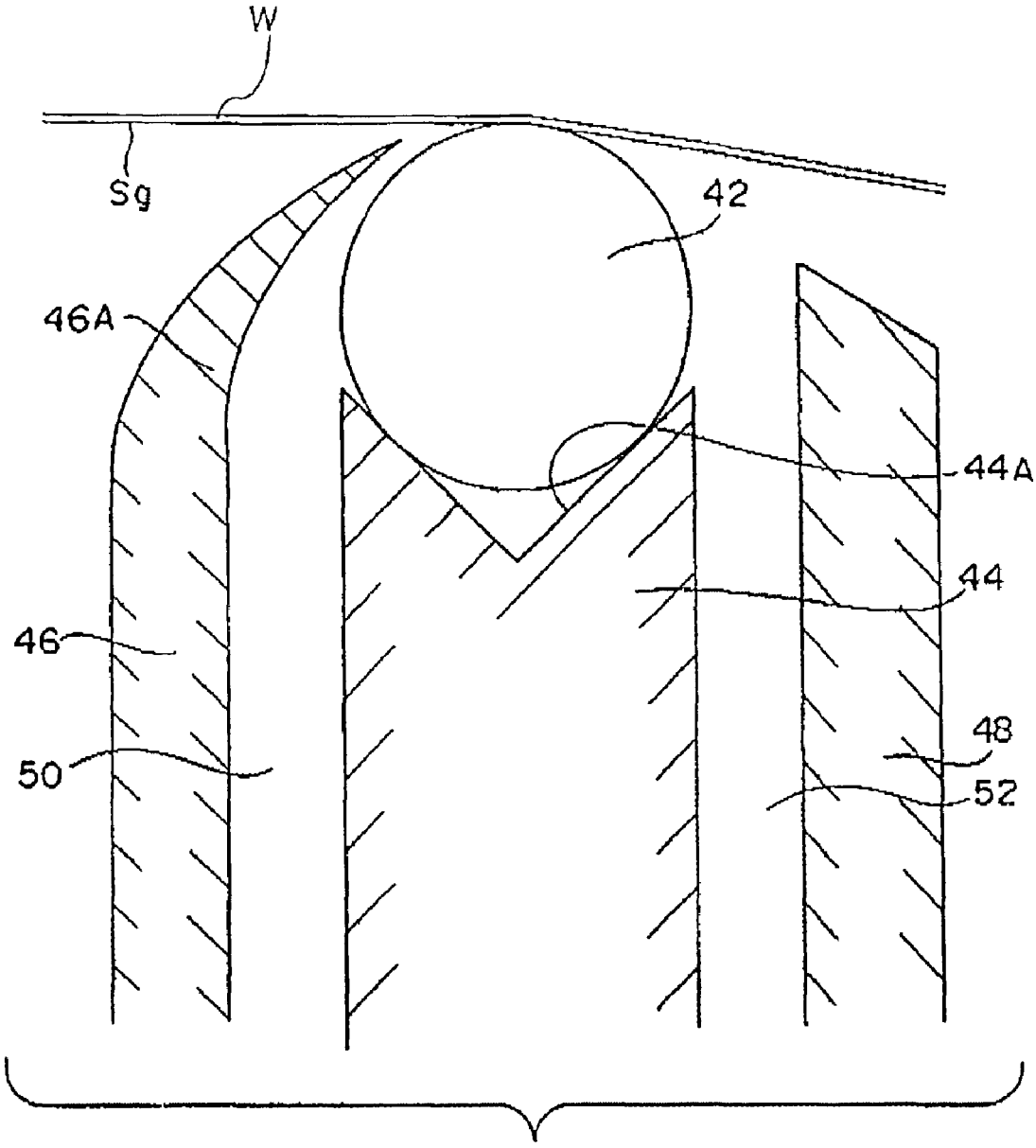
FIG. 17 is an enlarged diagram showing an example comprising an upstream block of a different shape than in the coat-adjusting section shown in FIG. 14.

FIG. 17 shows another embodiment of the upstream side block 46.

The upstream side block 46 shown in FIG. 17 is the same as the upstream side block 46 shown in FIG. 15 in that it is a plate-shaped member elongated in the vertical direction toward the running surface T, however, it differs from the upstream side block 46 shown in FIG. 15 in that an upper portion is formed in a curved shape, which curves convexly as it approaches the tip portion to approach the coating bar 42.

Moreover, the upstream side block 46 is formed so that the thickness decreases towards the upper end thereof like a wedge.

The upstream side block 46 shown in FIG. 17 has both the upstream side and downstream side surfaces formed in a curved shape. Therefore, formation of a stagnated part where the plate-making layer forming liquid flow stagnates in the vicinity of the upstream side block 46 can be further prevented as compared to the upstream side block 46 shown in FIGS. 15 and 16 so that the plate-making layer forming liquid can flow more smoothly in the vicinity of the upstream side block 46. Therefore, the steady flow b can be formed further stably.

Moreover, as shown in FIGS. 14 and 15, the downstream side block 48 is also a plate-shaped member elongated in the vertical direction toward the running surface T of the support web W, but it is lower than the upstream side block 46 in height. However, since the coating bar 42 can be rotated with at least a part of the outer circumferential surface soaked in the plate-making layer forming liquid stored in the downstream bead of the downstream side coating liquid path 52, when the upper end of the downstream side block 48 is higher than the lowermost point of the outer circumferential surface of the coating bar 42, it is particularly preferable in terms of preventing the drying of the outer circumferential surface of the coating bar 42.

As shown in FIGS. 14 and 15, the upper end surface of the downstream side block 48 is formed as an inclined surface sloping down towards the downstream side, however, it may be formed as a horizontal surface as well.

In the bottom surface of the base 6 are provided the following: a first liquid supplying pipe 6A for supplying the plate-making layer forming liquid to the coating liquid path 20, a second liquid supplying pipe 6B for supplying the plate-making layer forming liquid to the upstream side coating liquid path 50 and a third liquid supplying pipe 6C for supplying the plate-making layer forming liquid to the downstream side coating liquid path 52. Furthermore, in the bottom surface of the base 6 are disposed the following: a first liquid discharging pipe 6E for collecting the plate-making layer forming liquid, which was overflowed from the weir member 26 downward between the upstream side wall and the weir member 26 of the base 6 in the coating section 2, and a second liquid discharging pipe 6D for collecting the plate-making layer forming liquid, which flows downward between the supporting member 24 and the upstream side block 46.

The operation of the coating device 100 will be explained hereinafter.

The support web W is conveyed in the arrow a direction by the conveyance rollers 32 and 34 with the sand-blasted surface Sg facing down.

The plate-making layer forming liquid, which is supplied from the first liquid supplying pipe 6A to the coating liquid path 20 is taken up upwards by the coating roller 22 upward at the top portion of the coating liquid path 20 so as to be adhered to the sand-blasted surface Sg of the support web W.

The plate-making layer forming liquid, which adhered to the sand-blasted surface Sg of the support web W, is then adjusted into a predetermined thickness range as mentioned below in the coat-adjusting section 4.

In the coat-adjusting section 4, the plate-making layer forming liquid is supplied from the second liquid supplying pipe 6B and the third liquid supplying pipe 6C to the upstream side coating liquid path 50 and the downstream side coating liquid path 52.

The plate-making layer forming liquid is supplied in the upstream side coating liquid path 50 so as to overflow from the upper end of the upstream side weir plate 46 to the upstream side, and to maintain a predetermined liquid level in height in the downstream side coating liquid supplying path 52.

As shown in FIG. 16, the plate-making layer forming liquid supplied from the second liquid supplying pipe 6B forms a steady flow b at the upper end portion of the upstream side weir plate 46 so that a bead is formed between the support web W, the upstream side block 46 and the coating bar 42 by the steady flow b.

Accordingly, even in the case where the fluctuation is generated in the adhering amount of the plate-making layer forming liquid to be adhered to the sand-blasted surface Sg of the support web W in the coating section 2, since the fluctuation is absorbed by the bead, the pressure fluctuation along the width direction in the coating bar 42 are not generated. Therefore, by scraping off the plate-making layer forming liquid with the coating bar 42 in the case where the adhering amount of the plate-making layer forming liquid is excessive, and coating more of the plate-making layer forming liquid in the case where the adhering amount of the plate-making layer forming liquid is insufficient, the plate-making layer forming liquid adhered to the sand-blasted surface Sg of the support web W in the coating section 2 can be evened in an even thickness, in other words, it can be adjusted.

Therefore, even in the case where the fluctuation is generated in the adhering amount of the plate-making layer forming liquid in the coating section 2 for some reason, particularly in the case where the substrate conveyance speed is increased, an evenly coated surface can finally be obtained.

EXAMPLES VII

Examples 71, 72, Comparative Examples 71 to 74

A support web W was obtained by sandblasting one side of a surface of an aluminum web according to an conventional method, and processing the sand-blasted surface by anode oxidization.

A photosensitive layer forming liquid, which is an example of the plate-making layer forming liquid, was coated on the support web W using the coating device 100 shown in FIG. 14.

The coating conditions of the photosensitive layer coating liquid were as follows.

| | |
|---|---|
| a. Support web W thickness: | 0.3 mm |
| b. Conveyance speed of the support web W: | 150 m/minute |
| c. Photosensitive layer forming liquid adhering amount: | 50 cc/minute (coating section 2) 15 cc/minute (coat-adjusting section 4) |
| d. Diameter of the bar: | 10 mm (for both the coating bar 22 and the coating bar 42) |
| e. Rotation speed (circumferential speed) of the coating bar 22: | 130 m/minute (forward rotation) |
| f. Rotation speed (circumferential speed) of the coating bar 42: | 16 m/minute (forward rotation) |
| g. Viscosity of the photosensitive layer forming liquid: | 5 to 50 mPa · s |
| Results are shown in Table 7 | |

TABLE 7

| | Distance t1 Between the Upstream Side Block 46 and the Coating Bar 42 | Distance t2 Between the Upstream Side Block 46 and the Running Surface T | Coating Property, Coated Surface Quality |
|---|---|---|---|
| Example 71 | 0.05 to 3 mm | Less than 0.2 mm | ○: However, stripe-like dots were generated on the coated surface due to fluttering of the support web W. |
| Example 72 | | 0.2 to 3 mm | ◎: The entire surface was coated evenly. |
| Comparative Example 71 | | Over 3 mm | X: Bead streaks (thinly coated portion about 5 to 30 mm in length) were generated in portions. |
| Comparative Example 72 | Over 3 mm | Less than 0.2 mm | X: Bead streaks (thinly coated portion about 5 to 30 mm in length) were generated in portions. |
| Comparative Example 73 | | 0.2 to 3 mm | |
| Comparative Example 74 | | Over 3 mm | |

As shown in Table 7, in the case where the shortest distance t1 from the surface of the upstream side block 46 on the side facing the coating bar 42 to the outer circumferential surface of the coating bar 42 and the distance t2 from the upper end of the upstream side block 46 to the running surface T of the support web W were 3 mm or less in the coat-adjusting section 4, the photosensitive layer forming liquid could be coated evenly, even though the conveyance speed of the support web W was as high as 150 m/minute.

In contrast, in the case where at least one of the distance t1 and the distance t2 exceeded 3 mm, bead streaks were generated when the height of the weir member 26 was lower than the height of the lowermost point of the coating bar 22.

However, since the preferable range of the above-mentioned distances t1 and t2 is considered to fluctuate from the range shown in Table 7 according to the above-mentioned conditions a to g, there is a possibility of obtaining an evenly coated surface even in the case where the distance t1 and the distance t2 exceed 3 mm according to conditions a to g.

According to the above-mentioned embodiment of the invention, a coating device and a coating method that are capable of obtaining an evenly coated surface even in the case where the substrate conveyance speed is high can be provided.

Eighth Embodiment

Figure 18:
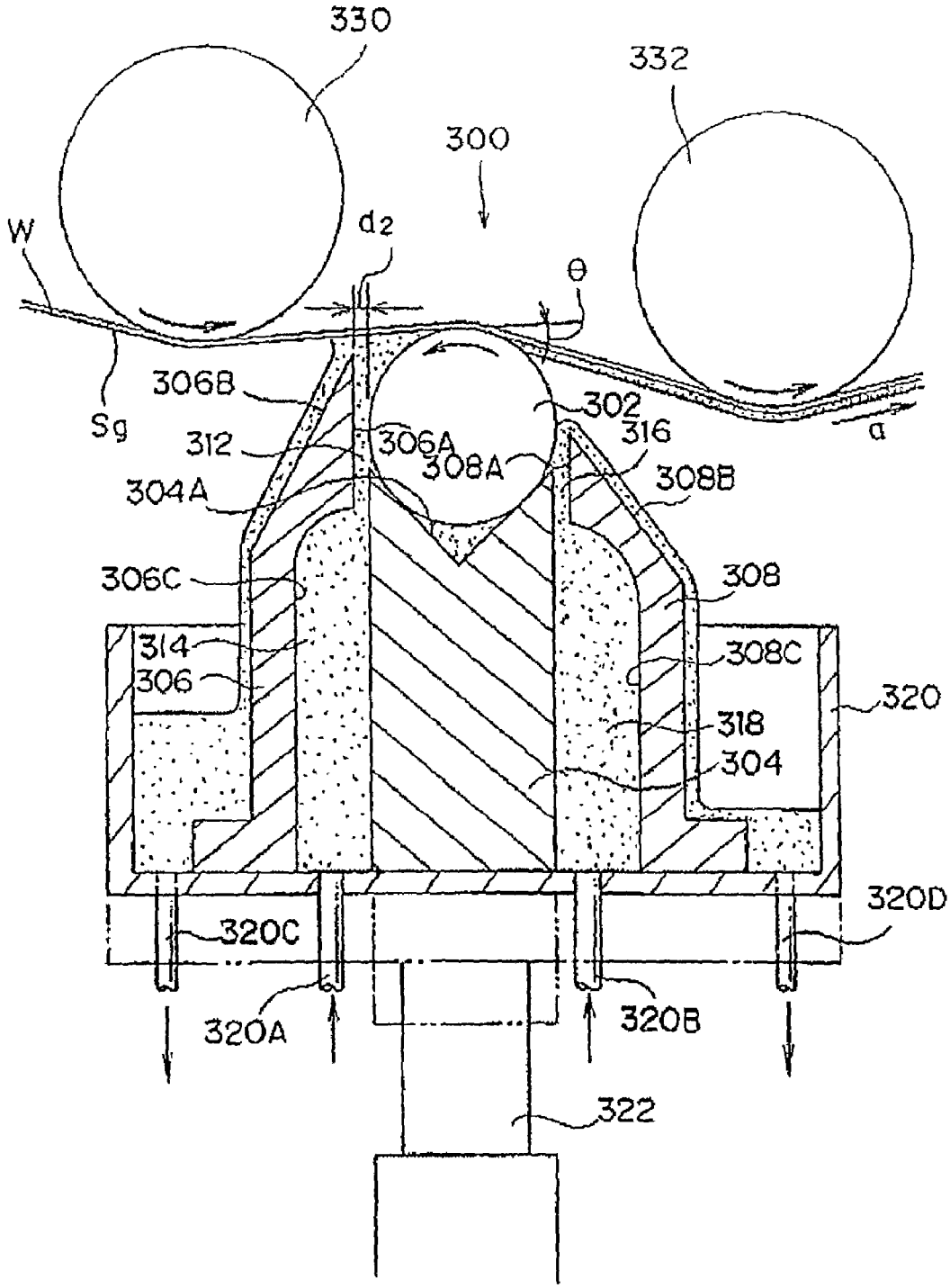
FIG. 18 is a schematic diagram showing the configuration of a coating device according to an eighth embodiment of the invention.

FIG. 18 shows the schematic configuration of another embodiment of a coating device of the invention.

A coating device 300 according to an eighth embodiment of the invention is a coating device for coating a plate-making layer forming liquid, as an embodiment of the coating liquid of the invention, on a support web W, as an embodiment of a band-shaped member of the inventions with the sand-blasted surface Sg thereof facing down, running continuously along the arrow a in FIG. 18.

As shown in FIG. 18, the coating device 300 comprises a bar 302 disposed perpendicular with respect to the conveyance direction a of the support web W, a supporting base 304, which is a plate-shaped member for supporting the bar from below and having a v-shaped bar supporting groove 4A on a top surface thereof for supporting the bar 302, a primary side weir member 306, and a secondary side weir member 308. The primary side weir member 306 is disposed upstream of the bar 302 and the supporting base 304 relative to the conveyance direction a, parallel to the bar 302, and facing the bar 302 and the supporting base 304. The secondary side weir member is disposed downstream of the bar 302 and the supporting base 304 relative to the conveyance direction a, parallel to the bar 302, and facing the bar 302 and the supporting base 304.

As the bar 302, any of a smooth bar, a bar with a groove and a wire bar can be used. As shown in FIG. 18, the bar 302 may be driven in the direction opposite to the conveyance direction a of the support web W, and may be stopped. Moreover, it may be driven in the same direction as the conveyance direction a of the support web W, or more specifically it may be slaved to the support web W and rotated.

The primary side weir member 306 has a substantially L-shaped cross-sectional shape, with the upper end portion bending towards the bar 302, A vertical surface 306A, which faces the bar 302, is formed on the surface of the upper end portion of the primary side weir member 306 on the side facing the bar 302, and an inclined surface 306B that slops to the downstream side relative to the conveyance direction a is formed on the side opposite to the vertical surface 306A. A curved surface, which curves towards the downstream side, is formed below the vertical surface 306A, and a second vertical surface 306C is formed below the curved surface continuously with the curved surface.

An upstream side slit 312 is formed between the bar 302 and the vertical surface 306A. The width of the upstream side slit 312 along the conveyance direction a, in other words, the thickness d2, can also be referred to as the distance from the bar 302 to the vertical surface 306A of the primary side weir member 306. The thickness d2 of the upstream side slit 312 is preferably in a range of 2 mm or less, more preferably 1 mm or less, and most preferably in a range of 0.05 to 1 mm.

A coating liquid storage chamber 314 is formed to communicate with the upstream side slit 312 below the upstream side slit 312, that is, between the supporting base 304 and the primary side weir member 306.

The secondary side weir member 308, which has a substantially inverted L-shaped cross-sectional shape and bends toward the bar 302 at the upper end portion, is provided at a position facing the primary side weir member 306 with the supporting base 304 interposed therebetween. The height of the secondary side weir member 308 is lower than the height of the primary side weir member 306.

A vertical surface 308A, which is a vertical surface facing the bar 302, is formed on the surface of the upper end portion of the secondary side weir member 308 on the side facing the bar 302, and an inclined surface 308B slopes to the upstream side relative to the conveyance direction a is formed on the side opposite to the vertical surface 308A. A curved surface that curves toward the downstream side is formed below the vertical surface 308A. A second vertical surface 308C is formed below the curved surface continuously with the curved surface.

A downstream side slit 16 is formed between the bar 302 and the vertical surface 308A.

A coating liquid storage chamber 318 is formed to communicate with the downstream side slit 316 below the downstream side slit 316, that is, between the supporting base 304 and the secondary side weir member 308.

The primary side weir member 306, the supporting base 304 and the secondary side weir member 308 are fixed on a shallow box-shape base 320 by a fixing means (not shown) such as a bolt, with an upper surface of the box-shape base being open.

An elevating device 322 is provided on the lower surface of the base 320 for supporting the base 320 at an elevated position as shown by the solid line in FIG. 18 at the time of coating the plate-making layer forming liquid. The bar 302 is contacted with the support web W at the elevated position. In contrast, when the coating operation of the plate-making layer forming liquid is not being performed, the base 320 is lowered by the elevating device 322 from the position shown by the solid line in FIG. 18 so as to be maintained at a lowered position as shown by the double dotted chain line in FIG. 18. At the lowered position, the bar 302 is spaced apart from the support web W.

According to the elevating device 322, the elevation height from the lowered position of the base 320 can be adjusted at the elevated position. Thus, the wrap angle θ, which is the angle the support web W is wound around the bar 302, can be set. That is, in the elevating device 322, by raising the elevation height of the base 320 from the lowered position, the wrap angle θ is made larger. In contrast, by reducing the elevation height of the base 320 from the lowered position, the wrap angle θ can be made smaller.

Below the coating liquid storage chamber 314 and the coating liquid storage chamber 318 on the bottom surface of the base 320, a first liquid supplying pipe 320A for supplying the plate-making layer forming liquid to the coating liquid storage chamber 314 and a second liquid supplying pipe 320B for supplying the plate-making layer forming liquid to the coating liquid storage chamber 318 are respectively provided. Furthermore, in the base 320, a first liquid discharging pipe 320C is provided for discharging the plate-making layer forming liquid that flowed down into the space between the upstream side wall in the base 320 and the primary side weir member 306, and a second liquid discharging pipe 320D for discharging the plate-making layer forming liquid that flowed down between the secondary side weir member 308 and the downstream side wall in the base 320 are provided.

Above the running surface T, which is the running path of the support web W, a pressing roller 330 for pressing the support web W downward, and a conveyance roller 332 for conveying the support web W along the conveyance direction a are respectively provided on the upstream side and the downstream side of the bar 302.

The operation of the coating device 100 will be explained hereafter.

At the time of coating, the plate-making layer forming liquid is supplied from the first liquid supplying pipe 320A to the coating liquid storage chamber 314 so as to overflow upward from the upstream side slit 312 and flow downward on the inclined surface 306B of the primary side weir member 306 toward the base 320.

While the support web W is held with the sand-blasted surface Sg thereof facing down and conveyed by the pressing roller 330 and the conveyance roller 332 in the conveyance direction a, the base 320 is elevated by elevating the elevating device 322. When the base 320 is elevated so that the sand-blasted surface Sg of the support web W is contacted with the coating liquid flow flowing down from the upstream side slit 312 across the top portion of the primary side weir member 306 along the inclined surface 306B, the plate-making layer forming liquid that was overflowed from the upstream side slit 312 is adhered to the sand-blasted surface Sg of the support web W.

The plate-making layer forming liquid adhered on the sand-blasted surface Sg is measured to a predetermined thickness by the scraping and coating operations of the bar 302. The coating thickness of the plate-making layer forming liquid can be adjusted by changing the ejection amount of the plate-making layer forming liquid from the upstream side slit 312, and the rotation direction and the rotation speed of the bar 302.

Here, since the upstream side slit 312 has a width of 2 mm or less, the plate-making layer forming liquid is ejected continuously from the upstream side slit 312 along the width direction of the support web W. Then, the bar 302 is rotated from the downstream side to the upstream side in the vicinity of the upstream side slit 312. Therefore, within the plate-making layer forming liquid ejected from the upstream side slit 312 and adhered to the sand-blasted surface of the support web W, the part thereof that is scraped off by the bar 302 toward the primary side weir member 306 moves beyond the top portion of the primary side weir member 306 and flows downward along the inclined surface 306B toward the base 320C.

Therefore, since an even and continuous flow of the plate-making layer forming liquid can be formed beyond the top portion of the primary side weir member 306, the plate-making layer forming liquid drying and forming a solid components at the top portion of the primary side weir member 306 can be prevented. The plate-making layer forming liquid, which flows down into a space between the upstream side wall in the base 320 and the primary side weir member 306 is collected through the first liquid discharging pipe 320C.

The plate-making layer forming liquid is adhered on the surface of the bar 302, conveyed toward the supporting base 304 according to the rotation of the bar 302, passes through the gap between the bar 302 and the supporting base 304 and reaches the downstream side of the bar 302. Accordingly, since the plate-making layer forming liquid forms a thin film on the downstream side surface of the bar 302, unless the coating liquid, or the like is supplied to the downstream side of the bar 302, the solid component can easily be formed by evaporation of the solvent from the plate-making layer forming liquid.

However, the downstream side surface of the bar 302 can be maintained in a constantly wet state by overflowing upwardly the plate-making layer forming liquid, which was supplied from the second liquid supplying pipe 320B to the coating liquid storage chamber 314 from the downstream side slit 316, and adhering the liquid to the downstream side surface of the bar 302. Thus, the drying of the plate-making layer forming liquid can be prevented on the downstream side surface of the bar 302.

As mentioned above, according to the coating device 300 of the eighth embodiment, drying of the plate-making layer forming liquid can be prevented on the downstream side surface of the bar 302 by maintaining the downstream side surface of the bar 302 in a constantly wet state, and thereby, the formation of the solid component by evaporation of the plate-making layer forming liquid can be prevented downstream of the bar 302.

Accordingly, in the coating device 300 according to the eighth embodiment, since the solid component cannot be formed by evaporation of the plate-making layer forming liquid on the top portion of the primary side weir member 306 and on the downstream side surface of the bar 302, generation of the coated surface quality failures derived from the solid components, such as coating streaks, adhesion of the solid component to the sand-blasted surface Sg of the support web W and thick coating can be effectively prevented.

Moreover, since the plate-making layer forming liquid itself is used as the drying preventing liquid of the invention, even in the case of circulating and reusing the plate-making layer forming liquid collected from the first liquid discharging pipe 320C and the second liquid discharging pipe 320D in a continuous operation, the plate-making layer forming liquid composition changes little over time.

Furthermore, since the coating liquid storage chamber 314 is formed below the upstream side slit 312, even in the case where the supplied amount of the plate-making layer forming liquid fluctuates, the plate-making layer forming liquid can be overflowed by a stable ejection amount from the upstream side slit 312.

Ninth Embodiment

Figure 19:
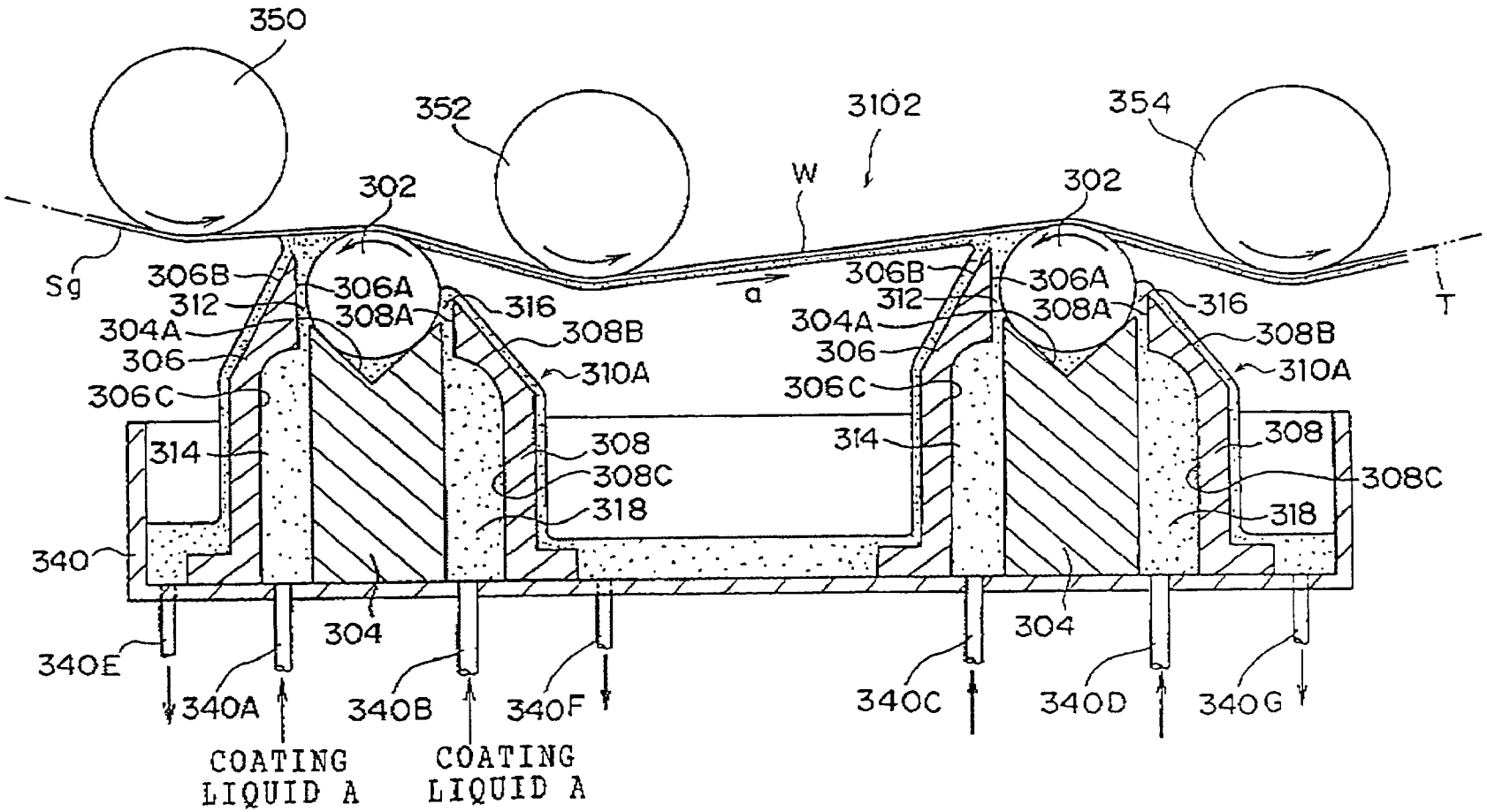
FIG. 19 is a schematic diagram showing the configuration of a coating device according to a ninth embodiment of the invention.
Figure 20:
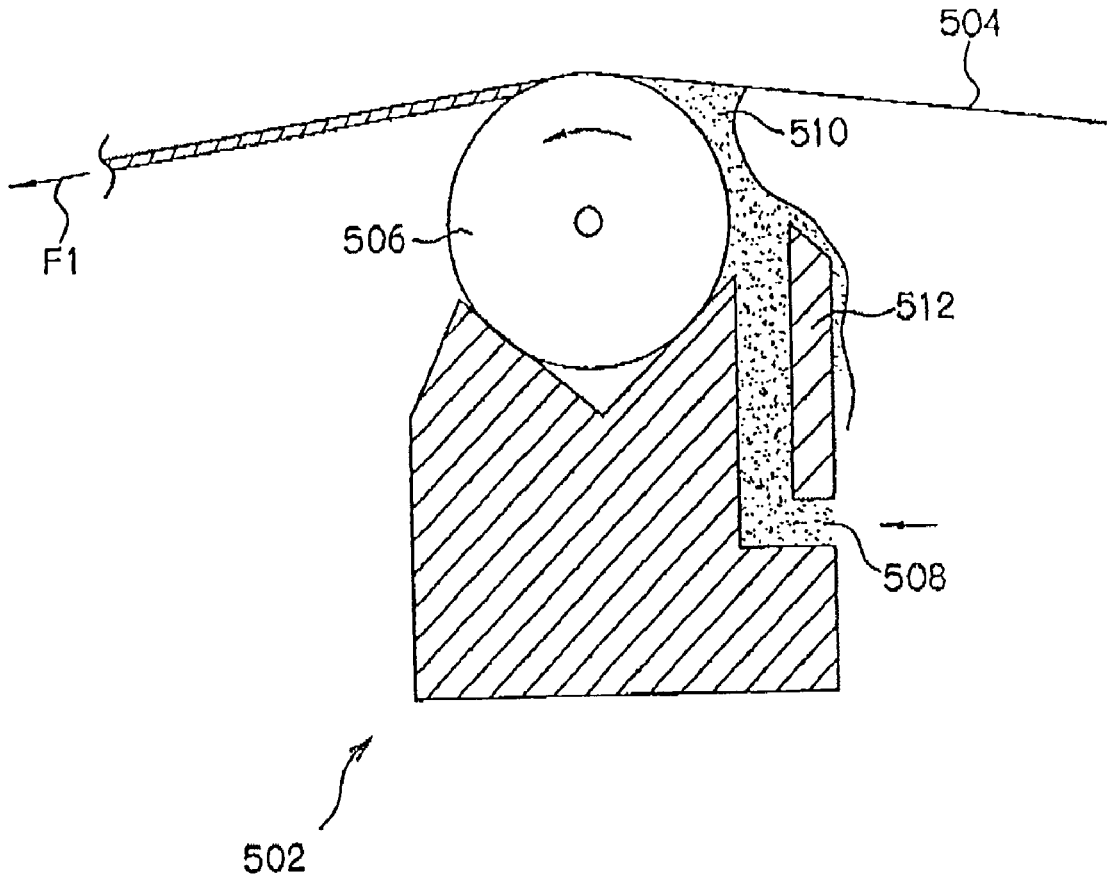
FIG. 20 is a cross-sectional view showing the schematic configuration of a conventional bar coating device.

FIG. 19 shows the schematic configuration of another embodiment of a coating device of the invention. In FIG. 19, the same numerals as FIG. 18 represent identical elements as those in FIG. 18.

As shown in FIG. 19, a coating device 310A according to the ninth embodiment comprises an upstream side coating section 310A disposed upstream relative to the conveyance direction a of the support web W, and a downstream side coating section 310B disposed downstream relative to the conveyance direction a.

Both the upstream side coating section 310A and the downstream side coating section 310B have the same configuration and operation as those of the coating device 300 according to the eighth embodiment. Therefore, adhesion of the coating liquid on the top portion of the primary side weir member 306, and generation of various kinds of the coated surface quality failures by generation of the solid component by drying of the downstream side of the bar 302 can be prevented.

The coating liquid A to be coated at the upstream side coating section 310A and the coating liquid B to be coated at the downstream side coating section 310B may be the same coating liquid, for example, the plate-making layer forming liquid, or different coating liquids. Therefore, a laser exposure type plate-making layer can be formed, for example, by coating a heat-sensitive layer forming liquid as the coating liquid A at the upstream side coating section 310A and coating a photo-thermal type conversion layer forming liquid as the coating liquid B at the downstream side coating section 310B. Moreover, a photosensitive layer can be formed by coating a photosensitive layer forming liquid as the coating liquid A at the upstream side coating section 310A, and an anti-oxidation layer can be formed by coating an anti-oxidation layer forming liquid as the coating liquid B at the downstream side coating liquid 310B The upstream side coating section 310A and the downstream side coating section 310B are fixed on a box-shaped base 340, an upper surface of which is open.

In the bottom surface of the base 340, a first liquid supplying pipe 340A for supplying the coating liquid A to the coating liquid storage chamber 314 of the upstream side coating section 310A, and a second liquid supplying pipe 340B for supplying the coating liquid A to the coating liquid storage chamber 318 of the upstream side coating section 310A are provided below the upstream side coating section 310A, respectively. Then, a third liquid supplying pipe 340C for supplying the coating liquid B to the coating liquid storage chamber 314 of the downstream side coating section 310B, and a fourth liquid supplying pipe 340D for supplying the coating liquid B to the coating liquid storage chamber 318 of the downstream side coating section 310B are provided below the downstream side coating section 310B, respectively.

Furthermore, in the bottom surface of the base 340, are provided the following: a first liquid discharging pipe path 340E for collecting and discharging to the outside the coating liquid that flows down between the upstream side wall and the primary side weir member; a second liquid discharging pipe 340F for collecting and discharging to the outside the coating liquid that flows down between the upstream side coating section 310A in the base 340 and the downstream side coating section 310B; and a third liquid discharging pipe 340G for collecting and discharging to the outside the coating liquid that flows dawn between the downstream side wall in the base 340 and the primary side weir members. However, in the case where the coating liquid A and the coating liquid B are different, it is preferable to prevent mixture of the collected coating liquid A and coating liquid B by separating the part between the upstream side coating section 310A in the base 340 and the downstream side coating section 310B by a weir, or the like and providing a liquid discharging pipe for each section.

Pressing conveyance rollers 350, 352, 354 are provided, for pressing the support web W toward the bars 302 at the upstream side coating section 310A and the downstream side coating section 310B and conveying the same along the conveyance direction, are disposed on the side of the support web W opposite to the upstream side coating section 310A and the downstream side coating section 310B, with the running surface T, which is the running path of the support web W, disposed therebetween. The pressing conveyance roller 350 is provided upstream of the upstream side coating section 310A, the pressing conveyance roller 352 is provided downstream of the upstream side coating section 310A and upstream of the downstream side coating section 310B, and the pressing conveyance roller 354 is provided downstream of the downstream side coating section 310B.

The operation of the coating device 3102 will be explained hereafter.

When the support web W passes above the upstream side coating section 310A, the coating liquid A is coated on the sand-blasted surface Sg, and when it passes above the downstream side coating section 310B, the coating liquid B is coated further on the coating liquid A.

Therefore, in the case where the coating liquid A and the coating liquid B are the same coating liquid, for example, the plate-making layer forming liquid, then even in the case where an uncoated part, at which the coating liquid A is not coated, is generated on the sand-blasted surface Sg at the upstream side coating section 310A, the uncoated part can be eliminated by re-coating with the coating liquid B that is the same as the coating liquid A at the downstream side coating section 310B.

Moreover, in the case where the coating liquid A and the coating liquid B are different coating liquids, a coating layer with a multi-layer structure can be obtained by passing the support web W above the upstream side coating section 310A and the downstream side coating section 310B.

According to the coating device 302 of the ninth embodiment, in addition to the characteristics of the coating device of the eighth embodiment, characteristics of preventing the generation of an uncoated part in the case where the coating liquid A and the coating liquid B are the same, and being able to provide the multi-layer structure plate-making layer using one coating device in the case where the coating liquid A and the coating liquid B are different.

EXAMPLES VIII

Examples 81 to 84, Comparative Example 81

A support web W was obtained by sand-blasting one side of a surface of an aluminum web according to an conventional method, and processing the sand-blasted surface by anode oxidization.

A photosensitive layer forming liquid, which is one example of the plate-making layer forming liquid, was coated on the support web W using the coating device 300 shown in FIG. 18.

The coating conditions of the photosensitive layer coating liquid were as follows.

| | |
|---|---|
| a. Support web W thickness: | 0.3 mm |
| b. Conveyance speed of the support web W: | 100 m/minute |
| c. Diameter of the bar 302: | 10 mm |
| d. Rotational frequency of the bar 302: | −50 rpm (backward rotation) |
| e. Width of the upstream side slit: | as shown in Table 8 |
| f. Viscosity of the photosensitive layer forming liquid: | 20 mPa · s |
| g. Liquid feeding amount of the photosensitive layer forming liquid: | 2.0 litter/minute |
| h. Coating amount of the photosensitive layer forming liquid after measurement by the bar 302: | 20 cc/$m^2$ |
| i. Diameter of the pressing roller 30: | 50 mm |
| j. Center distance between the pressing roller 30 and the bar 302: | 30 mm |

Results are shown in Table 8.

TABLE 8

| | Interval of the Upstream Side Slit (mm) | Existence of Dry Adhesion of the Coating Liquid to the Primary Side Weir Member | Coating Property, Coated Surface Quality |
|---|---|---|---|
| Comparative Example 81 | 3.0 | X: Generation of drying of the coating liquid | X: Generation of coating streaks and adhesion of solid component to the support web |
| Example 81 | 2.0 | Δ: Substantially no drying of the coating liquid | Δ: Slight generation of coating streaks |
| Example 82 | 1.0 | ○: No drying of the coating liquid | ○: No coated surface quality failure |
| Example 83 | 0.5 | ○: No drying of the coating liquid | ○: No coated surface quality failure |
| Example 84 | 0.1 | ○: No drying of the coating liquid | ○: No coated surface quality failure |

As shown in Table 8, in the case where the photosensitive layer forming liquid was coated by the above-mentioned coating conditions, and in the case where the thickness of the upstream side slit 312 was 2 mm or less, since the photosensitive layer forming liquid was overflowed evenly in the width direction beyond the primary side weir member 306 continuously, generation of the solid component by solidification of the photosensitive layer forming liquid on the top portion of the primary side weir member 306 or generation of the coated surface quality failure derived from the solid component were not observed.

According to the above-mentioned embodiment of the invention, a coating device and a coating method can be provided without generating a trouble in the coated surface quality.

What is claimed is:

1. A coating method for coating a liquid agent on a band-shaped substrate, the coating method comprising the steps of:

running the substrate in a predetermined direction;

coating a liquid agent on at least one surface of the running substrate using a first bar, disposed substantially parallel to the substrate, a weir member disposed upstream of the first coating bar in the substrate conveyance direction and facing the first coating bar, for forming a bead of the liquid agent between the first coating bar and the substrate, and a rectifying member, disposed between the weir member and the first coating bar for forming a liquid agent flow to be raised along the surface of the first coating bar, wherein the rectifying member is a plate-shaped member having a tip portion and a bent portion that is bent toward the first coating bar is formed at the tip portion; and coat-adjusting the amount of the coated liquid agent to a predetermined thickness.

2. The coating method according to claim 1, wherein the coat-adjusting step is performed using a second bar disposed substantially parallel to the running substrate surface.

3. The coating method according to claim 2, wherein the conveyance time of the substrate between the coating step and the coat-adjusting step is 0.25 seconds or less.

4. The coating method according to claim 3, wherein at least one of the first bar and the second bar is rotated at a circumferential speed different from the substrate conveyance speed.

5. The coating method according to claim 3, wherein the liquid agent contains an organic solvent.

6. The coating method according to claim 3, wherein an ambient temperature between the first and second coating bars is maintained at 30° C. or lower.

7. The coating method according to claim 2, wherein a coating amount ratio of the coating amount of the liquid agent coated on the substrate immediately after the coating step to the coating amount of the liquid agent after the coat-adjusting step is 0.8 to 4.0.

8. The coating method according to claim 7, wherein at least one of the first bar and the second bar is rotated at a circumferential speed different from the substrate conveyance speed.

9. The coating method according to claim 1, wherein the first bar is rotated such that a circumferential surface on the side facing the substrate moves in the same direction as the substrate conveyance direction at a circumferential speed of at least 1/15 of, and no more than equal to, the substrate conveyance speed.

10. A coating method according to claim 1, wherein a height of the top surface of the weir member is at least as high as a height of the lowermost point of the surface of the first bar, and lower than an uppermost point of the surface of the first bar by 1 mm or more, so that the liquid agent is coated on the substrate surface from the bead.

11. The coating method according to claim 1, wherein the coat-adjusting step includes a sub-step of adjusting the liquid agent on the substrate surface by evening the liquid agent using a second bar, which is disposed substantially parallel to the substrate surface, wherein the coating liquid is evened to a predetermined thickness by forming a bead of the coating liquid between the second bar and the substrate by an upstream side block disposed upstream of the second bar in the substrate conveyance direction and facing the second bar.

12. A liquid agent coating method for a band-shaped substrate running in a predetermined direction, the method including a step of adjusting a liquid agent coated on the surface of the substrate to a certain thickness using a first bar, disposed substantially parallel to the substrate, the method comprising:

a step of forming a bead of a coating liquid agent between the first bar and the substrate; and a step of coating the liquid agent on the substrate to be adjusted, using a second bar, disposed substantially parallel to the substrate, a weir member, disposed upstream of the second coating bar in the substrate conveyance direction and facing the second coating bar, for forming a bead of the liquid agent between the second coating bar and the substrate, and a rectifying member, disposed between the weir member and the second coating bar for forming a liquid agent flow to be raised along the surface of the second coating bar, wherein the rectifying member is a plate-shaped member having a tip portion and a bent portion that is bent toward the second bar is formed at the tip portion.

13. A coating device for coating a liquid agent on a band-shaped substrate running in a predetermined direction, the coating device comprising:

a coating station for coating a liquid agent on at least one surface of the substrate, the coating station comprising a first coating bar, disposed substantially parallel to the substrate, a weir member disposed upstream of the first coating bar in the substrate conveyance direction and facing the first coating bar, for forming a bead of the liquid agent between the first coating bar and the substrate, and a rectifying member, for forming a liquid agent flow to be raised along the surface of the first coating bar, disposed between the weir member and the first coating bar, wherein the rectifying member is a plate-shaped member having a tip portion and a bent portion that is bent toward the first coating bar is formed at the tip portion, and a coat-adjusting station disposed downstream of the coating station in the substrate conveyance direction, for adjusting the liquid agent amount to a predetermined thickness.

14. The coating device according to claim 13, wherein the coat-adjusting station is for adjusting the amount of the coated liquid agent before the liquid agent coated on the substrate in the coating station dries.

15. The coating device according to claim 13, wherein the coat-adjusting station comprises a bar-shaped member having a smoothly formed surface, that is disposed parallel to the surface of the substrate.

16. The coating device according to claim 15, wherein the bar-shaped member is rotated at a rotational frequency of no more than 500 rpm.

17. The coating device according to claim 13, wherein the coat-adjusting station comprises a bar-shaped member with a groove formed on the surface in the circumferential direction, said bar-shaped member being disposed parallel to the surface of the substrate.

18. The coating device according to claim 17, wherein the bar-shaped member is rotated at a rotational frequency of no more than 500 rpm.

19. The coating device according to claim 13, wherein the coating station comprises:

liquid supplying means, disposed upstream of the first coating bar in the predetermined direction, for supplying the liquid agent between the first coating bar and the substrate and wherein the first coating bar is in contact with the substrate and rotates with the contacted circumferential surface of the first coating bar moving in the same direction as the substrate conveyance direction.

20. The coating device according to claim 13, wherein the coating station coats the liquid agent on the substrate in a state of being separated from the substrate surface.

21. The coating device according to claim 20, wherein the coating station comprises:

a liquid supplying means for supplying the liquid agent between the first coating bar and the substrate upstream of the first coating bar in the predetermined conveyance direction, and wherein the first coating bar has a smooth surface and is disposed parallel to the running surface of the substrate.

22. A coating device according to claim 13, wherein the coat-adjusting station includes a second coating bar disposed downstream of the first coating bar in the substrate conveyance direction, for adjusting the coating amount of the liquid agent by evening the liquid agent to a predetermined thickness.

23. The coating device according to claim 22, wherein the first coating bar and the second coating bar are disposed such that the time interval for the substrate to move from a coating position where the liquid agent is coated by the first coating bar, to an adjusting position where the liquid agent is adjusted by the second coating bar, is 0.25 seconds or less.

24. The coating device according to claim 23, further comprising a rotation driving mechanism for rotating at least one of the first coating bar and the second coating bar at a circumferential speed different from a speed at which the substrate runs.

25. The coating device according to claim 22, wherein a coating amount ratio of the coating amount of the liquid agent coated on the substrate after the substrate has passed the first coating bar with respect to the coating amount of the liquid agent coated on the substrate after the substrate has passed the second coating bar is 0.8 to 4.0.

26. The coating device according to claim 25, further comprising a rotation driving mechanism for rotating at least one of the first coating bar and the second coating bar at a circumferential speed different from a speed at which the substrate runs.

27. The coating device according to claim 13, wherein the first coating bar has a circumferential surface and is disposed substantially parallel to the substrate surface for coating the liquid agent on the substrate surface, said coating bar rotates so that a side of the circumferential surface of the coating bar faces the substrate and moves in the same direction as the substrate conveyance direction at a circumferential speed of at least 1/15 of, and no more than equal to, a substrate conveyance speed.

28. The coating device according to claim 27, wherein the circumferential speed of the first coating bar is 1/15 to 3/4 of the substrate conveyance speed.

29. The coating device according to claim 27, wherein the circumferential speed of the first coating bar is 1/10 to 1/2 of the substrate conveyance speed.

30. The coating device according to claim 27, wherein the coat-adjusting station is for adjusting the liquid agent to a predetermined thickness before the liquid agent adhered to the substrate by the coating station dries.

31. The coating device according to claim 27, wherein the coat-adjusting station comprises a second coating bar for adjusting the liquid agent amount by evening the liquid agent coated on the substrate surface to a predetermined thickness.

32. The coating device according to claim 31, wherein the second coating bar includes a circumferential surface and is disposed parallel to the coated surface of the substrate, with a side of the circumferential surface that faces the substrate moving in the same direction as the substrate conveyance direction.

33. The coating device according to claim 27, wherein the substrate is a support web for forming a substrate of a planographic printing plate precursor.

34. The coating device according to claim 27, wherein the liquid agent used for coating is a plate-making layer forming liquid for forming a plate-making layer of a planographic printing plate precursor.

35. The coating device according to claim 13, wherein the first coating bar has a circumferential surface, disposed substantially parallel to the substrate surface, the first coating bar for coating the liquid agent on the substrate surface and rotating with the side of the circumferential surface thereof that faces the substrate moving in the same direction as the substrate conveyance direction; and the weir member has a height, with a height of the weir member top surface being the same as or higher than a lowermost point of the circumferential surface of the first coating bar, and lower than an uppermost point of the circumferential surface of the first coating bar by 1 mm or more.

36. The coating device according to claim 35, wherein the first coating bar is rotated with the side of the circumferential surface thereof that faces the substrate moved in the same direction as the conveyance direction of the substrate at a circumferential speed of at least 1/15 of, and no more than equal to, a substrate conveyance speed.

37. The coating device according to claim 35, wherein the coat-adjusting station comprises a second coating bar for adjusting the liquid agent amount by evening the liquid agent coated on the substrate surface to a predetermined thickness.

38. The coating device according to claim 37, wherein the second coating bar has a circumferential surface and is disposed parallel to the surface of the substrate to be coated, with a side of the circumferential surface that faces the substrate moving in the direction opposite to the conveyance direction of the substrate.

39. The coating device according to claim 37, wherein the second coating bar has a circumferential surface and is disposed parallel to the coated surface of the substrate, with a side of the circumferential surface that faces the substrate moving in the same direction as the substrate conveyance direction.

40. The coating device according to claim 35, wherein the substrate conveyance speed is 100 m/minute or more.

41. The coating device according to claim 35, wherein the substrate is a supporting member for a planographic printing plate precursor.

42. The coating device according to claim 41, wherein the liquid agent used for coating is a plate-making layer forming liquid for forming a plate-making layer of a planographic printing plate precursor.

43. The coating device according to claim 13, wherein the coat-adjusting station comprises: a second coating bar disposed substantially parallel to the substrate surface, for evening and adjusting the liquid agent coated on the substrate to a predetermined thickness; and a block disposed upstream of the bar in the substrate conveyance direction and facing the second bar, for forming a bead of the liquid agent between the bar and the substrate.

44. The coating device according to claim 43, wherein the second coating bar includes a circumferential surface and is rotated with the side of the circumferential surface thereof that faces the substrate moving in the same direction as the substrate conveyance direction on the side facing the substrate.

45. The coating device according to claim 43, wherein the upstream side block comprises a tip portion, and a bent portion is formed at the tip portion and is bent toward the second coating bar.

46. The coating device according to claim 45, wherein a surface of the bent portion on a side facing the second coating bar is formed parallel to a tangential plane that contacts a part of the bar facing a tip of the bent portion.

47. The coating device according to claim 45, wherein a shortest distance between a surface of the bent portion of the upstream side block on a side facing the second coating bar and the circumferential surface of the bar is 3 mm or less.

48. The coating device according to claim 47, wherein the shortest distance is in a range of 0.05 to 3 mm.

49. The coating device according to claim 45, wherein a distance from a tip of the upstream side block to the substrate surface is 3 mm or less and a shortest distance between a surface of the bent portion of the upstream side block on a side facing the second coating bar and the circumferential surface of the bar is 3 mm or less.

50. The coating device according to claim 45, wherein a shortest distance between a surface of the bent portion of the upstream side block on a side facing the second coating bar and the circumferential surface of the bar is in a range of 0.1 to 3 mm, and a distance from the tip of the upstream side block to the substrate surface is 0.05 to 3 mm.

51. The coating device according to claim 43, wherein a distance from a tip of the upstream side block to the substrate surface is 3 mm or less.

52. The coating device according to claim 43, wherein a distance between a tip of the upstream side block and the substrate surface is in a range of 0.1 to 3 mm.

53. The coating device according to claim 43, wherein the distance from a tip portion of the upstream side block of the coat-adjusting station to the circumferential surface of the second coating bar along the substrate conveyance direction is in a range of 1.2 to 11 mm.

54. The coating device according to claim 43, wherein the substrate is a support web for a planographic printing plate precursor.

55. The coating device according to claim 43, wherein the liquid agent used for coating is a plate-making layer forming liquid for forming a plate-making layer of a planographic printing plate precursor.

56. A coating device for coating a liquid agent on a band-shaped substrate running in a predetermined direction, the coating device comprising:

a coating station for coating a liquid agent on at least one surface of the substrate, the coating station comprising a first coating bar, a weir member and a rectifying member, disposed between the weir member and the first coating bar, wherein the rectifying member is a plate-shaped member having a tip portion and a bent portion that is bent toward the first coating bar is formed at the tip portion, and a coat-adjusting station disposed downstream of the coating station in the substrate conveyance direction, for adjusting the liquid agent amount to a predetermined thickness, wherein the first coating bar is disposed substantially parallel to the substrate surface and includes a circumferential surface, a side of which faces the substrate, the first coating bar for coating the liquid agent on the substrate surface and being rotated with the side of the circumferential surface that faces the substrate moving in the same direction as the substrate conveyance direction, the weir member is disposed upstream of the first coating bar in the substrate conveyance direction and faces the first coating bar, for forming a bead of the liquid agent between the first coating bar and the substrate; and the rectifying member is for forming a liquid agent flow to be raised along the surface of the first coating bar.

57. The coating device according to claim 56, wherein the bent portion of the rectifying member is formed parallel to a tangential plane that contacts a part of the first coating bar, which part faces the bent portion.

58. The coating device according to claim 56, wherein a shortest distance between a surface of the tip portion of the rectifying member on a side facing the first coating bar and the circumferential surface of the first coating bar is 1 mm or less.

59. The coating device according to claim 56, wherein a distance from a tip of the rectifying member to the substrate surface is 3 mm or less.

60. The coating device according to claim 56, wherein a shortest distance between a surface of the tip portion of the rectifying member on a side facing the first coating bar and the circumferential surface of the first coating bar is 1 mm or less, and a distance from the tip portion of the rectifying member to the substrate surface is 3 mm or less.

61. The coating device according to claim 56, wherein a shortest distance between a surface of the tip portion of the rectifying member on a side facing the first coating bar and the circumferential surface of the first coating bar is 0.05 to 1 mm.

62. The coating device according to claim 56, wherein a distance from a tip of the rectifying member to the substrate surface is 0.05 to 3 mm.

63. The coating device according to claim 56, wherein a shortest distance between a surface of the tip portion of the rectifying member on a side facing the first coating bar and the circumferential surface of the first coating bar is 0.05 to 1 mm, and a distance from the tip of the rectifying member to the substrate surface is 0.05 to 3 mm.

64. The coating device according to claim 56, wherein the substrate is a support web for forming a substrate of a planographic printing plate precursor.

65. The coating device according to claim 64, wherein the liquid agent used for coating is a plate-making layer forming liquid for forming a plate-making layer of the planographic printing plate precursor.

66. A coating device for coating a liquid agent on a band-shaped substrate running in a predetermined direction, the coating device comprising:

a bar disposed substantially parallel to at least one surface of the substrate for evening the liquid agent coated on the substrate surface to a predetermined thickness;

a primary side weir member disposed upstream of the bar in the substrate conveyance direction and facing the bar, for forming a bead of the coating liquid agent between the bar and the substrate; and a rectifying member, for forming a liquid agent flow to be raised along the surface of the first coating bar, disposed between the primary side weir member and the bar, wherein the rectifying member is a plate-shaped member having a tip portion and a bent portion that is bent toward the bar is formed at the tip portion.

67. The coating device according to claim 66, wherein the bar has a circumferential surface thereof, and a side of the circumferential surface facing the substrate moves at a speed different from the substrate conveyance speed.

68. The coating device according to claim 67, wherein the substrate is a support web for a planographic printing plate precursor.

69. The coating device according to claim 66, wherein the bar includes a circumferential surface and is disposed parallel to the coated surface of the substrate, with a side of the circumferential surface that faces the substrate moving in the same direction as the substrate conveyance direction.

70. The coating device according to claim 66, comprising wetting liquid coating means for coating a wetting liquid for wetting the downstream surface of the bar.

71. The coating device according to claim 70, wherein the wetting liquid coat means comprises a secondary side weir member, which has a height lower than that of the primary side weir member, is disposed downstream of the bar in the substrate conveyance direction and facing the bar, and is for ejecting the wetting liquid between the secondary side weir member and the bar for coating the same on the bar surface.

72. The coating device according to claim 70, wherein the wetting liquid is the coating liquid.

* * * * *